US008520037B2

(12) United States Patent
Origuchi et al.

(10) Patent No.: US 8,520,037 B2
(45) **Date of Patent: *Aug. 27, 2013**

(54) PLASMA DISPLAY DEVICE AND PLASMA DISPLAY PANEL DRIVING METHOD

(75) Inventors: Takahiko Origuchi, Osaka (JP); Tomoyuki Saito, Osaka (JP)

(73) Assignee: Panasonic Corporation, Osaka (JP)

( * ) Notice: Subject to any disclaimer, the term of this patent is extended or adjusted under 35 U.S.C. 154(b) by 258 days.

This patent is subject to a terminal disclaimer.

(21) Appl. No.: 13/127,605

(22) PCT Filed: Nov. 12, 2009

(86) PCT No.: PCT/JP2009/006037

§ 371 (c)(1), (2), (4) Date: May 4, 2011

(87) PCT Pub. No.: WO2010/055662

PCT Pub. Date: May 20, 2010

(65) Prior Publication Data

US 2011/0216108 A1 Sep. 8, 2011

(30) Foreign Application Priority Data

Nov. 13, 2008 (JP) ..... 2008-290542

(51) Int. Cl.
*G09G 3/28* (2013.01)

(52) U.S. Cl.
USPC ..... 345/690; 345/60

(58) Field of Classification Search
USPC ..... 345/690, 60–72
See application file for complete search history.

(56) References Cited

U.S. PATENT DOCUMENTS

| | | | | |
|---|---|---|---|---|
| 6,774,875 | B2 | 8/2004 | Tong et al. | |
| 7,091,934 | B2 * | 8/2006 | Kim et al. | 345/60 |
| 7,924,239 | B2 | 4/2011 | Yoshihama et al. | |
| 2002/0145575 | A1 | 10/2002 | Tong | |

(Continued)

FOREIGN PATENT DOCUMENTS

| | | | |
|---|---|---|---|
| EP | 1526499 | A2 | 4/2005 |
| JP | 2005-208369 | A | 8/2005 |

(Continued)

OTHER PUBLICATIONS

Supplementary European Search Report for EP 09 82 5915 dated Sep. 10, 2012.

(Continued)

*Primary Examiner* — Dorothy Harris
(74) *Attorney, Agent, or Firm* — RatnerPrestia

(57) ABSTRACT

Display luminance is uniformized to enhance image display quality. A sustain pulse generating circuit generates sustain pulses by selecting any one of a plurality of driving patterns, according to an all-cell light-emitting rate and a partial light-emitting rate. A loading correction part of the image signal processing circuit includes: number of lit cells calculator for calculating the number of discharge cells to be lit in each display electrode pair, in each subfield; load value calculator for calculating a load value of each discharge cell, according to the calculation result in number of lit cells calculator; correction gain calculator for calculating a correction gain of each discharge cell, according the calculation result in load value calculator, the driving pattern selected, and the position of the discharge cell; and corrector for correcting an input image signal, according to the output from correction gain calculator.

2 Claims, 33 Drawing Sheets

(56) References Cited

U.S. PATENT DOCUMENTS

| | | | | |
|---|---|---|---|---|
| 2004/0257310 | A1* | 12/2004 | Yu et al. | 345/63 |
| 2005/0068265 | A1* | 3/2005 | Joo et al. | 345/60 |
| 2005/0200571 | A1* | 9/2005 | Gotoda et al. | 345/63 |
| 2005/0248594 | A1* | 11/2005 | Usui et al. | 345/690 |
| 2006/0132659 | A1 | 6/2006 | Kimura et al. | |
| 2008/0074354 | A1 | 3/2008 | Yahagi et al. | |
| 2009/0146922 | A1* | 6/2009 | Yoshihama et al. | 345/60 |
| 2009/0201285 | A1* | 8/2009 | Nishimura et al. | 345/214 |

FOREIGN PATENT DOCUMENTS

| | | | |
|---|---|---|---|
| JP | 2005-208369 | A | 8/2005 |
| JP | 2005-257754 | A | 9/2005 |
| JP | 2006-184843 | A | 7/2006 |
| JP | 2006-301555 | A | 11/2006 |
| JP | 2006-301555 | A | 11/2006 |
| JP | 2006-301556 | A | 11/2006 |
| JP | 2006-301556 | A | 11/2006 |
| JP | 2006-337720 | A | 12/2006 |
| JP | 2006-337720 | A | 12/2006 |
| JP | 2007-010702 | A | 1/2007 |
| JP | 2007-010702 | A | 1/2007 |
| JP | 2008-076735 | A | 4/2008 |
| JP | 2008-145880 | A | 6/2008 |
| JP | 2008-145880 | A | 6/2008 |
| JP | 2008-209840 | A | 9/2008 |
| WO | WO2006/123599 | A1 | 11/2006 |
| WO | WO 2006123599 | A1 * | 11/2006 |

OTHER PUBLICATIONS

Japanese Office Action for 2010-513538 dated Oct. 30, 2012.

International Search Report for Application No. PCT/JP2009/006037, Feb. 16, 2010, Panasonic Corporation.

* cited by examiner

| | A | B | C | D | E | F | G | H | |
|---|---|---|---|---|---|---|---|---|---|
| Rising period (nsec) | 800 | 400 | 800 | 800 | 800 | 800 | 800 | 800 | |
| Falling period (nsec) | 550 | 500 | 550 | 550 | 550 | 550 | 550 | 550 | |
| Overlapping period (nsec) | | 150 | 150 | 150 | 150 | 150 | 150 | 150 | 150 |

| | A | B | C | D | E | F | G | H | |
|---|---|---|---|---|---|---|---|---|---|
| Rising period (nsec) | 650 | 450 | 650 | 650 | 650 | 650 | 650 | 650 | |
| Falling period (nsec) | 1000 | 850 | 1000 | 1000 | 1000 | 1000 | 1000 | 1000 | |
| Overlapping period (nsec) | | 150 | 150 | 150 | 150 | 150 | 150 | 150 | 150 |

| | A | B | C | D | E | F | G | H | |
|---|---|---|---|---|---|---|---|---|---|
| Rising period (nsec) | 700 | 450 | 700 | 750 | 700 | 750 | 700 | 750 | |
| Falling period (nsec) | 900 | 800 | 900 | 900 | 900 | 900 | 900 | 900 | |
| Overlapping period (nsec) | | 200 | 200 | 200 | 200 | 200 | 200 | 200 | 200 |

| | A | B | C | D | E | F | G | H | |
|---|---|---|---|---|---|---|---|---|---|
| Rising period (nsec) | 750 | 450 | 750 | 750 | 750 | 750 | 750 | 750 | |
| Falling period (nsec) | 900 | 800 | 900 | 900 | 900 | 900 | 900 | 900 | |
| Overlapping period (nsec) | | 150 | 150 | 150 | 150 | 150 | 150 | 150 | 150 |

| | A | B | C | D | E | F | G | H | |
|---|---|---|---|---|---|---|---|---|---|
| Rising period (nsec) | 750 | 450 | 750 | 650 | 750 | 650 | 750 | 650 | |
| Falling period (nsec) | 900 | 800 | 900 | 900 | 900 | 900 | 900 | 900 | |
| Overlapping period (nsec) | | 150 | 150 | 150 | 150 | 150 | 150 | 150 | 150 |

121

| | | | | | | | | | | | | | | | |
|---|---|---|---|---|---|---|---|---|---|---|---|---|---|---|---|
| First SF | 1 | 1 | 1 | 1 | 1 | 1 | 1 | 1 | 1 | 1 | 1 | 1 | 1 | 1 | 1 |
| Second SF | 1 | 1 | 1 | 1 | 1 | 1 | 1 | 1 | 1 | 1 | 1 | 1 | 1 | 1 | 1 |
| Third SF | 1 | 1 | 1 | 1 | 1 | 1 | 1 | 1 | 1 | 1 | 1 | 1 | 1 | 1 | 1 |
| Fourth SF | 1 | 1 | 1 | 1 | 1 | | | | | | 1 | 1 | 1 | 1 | 1 |
| Fifth SF | 1 | 1 | 1 | 1 | 1 | | | | | | 1 | 1 | 1 | 1 | 1 |
| Sixth SF | 1 | 1 | 1 | 1 | 1 | | | | | | 1 | 1 | 1 | 1 | 1 |
| Seventh SF | | | | | | | | | | | | | | | |
| Eighth SF | | | | | | | | | | | | | | | |

122

| | Number of lit cells | Luminance weight | Lighting state of discharge cell B | Calculated value |
|---|---|---|---|---|
| First SF | 15 | 1 | 1 | 15 |
| Second SF | 15 | 2 | 1 | 30 |
| Third SF | 15 | 4 | 1 | 60 |
| Fourth SF | 10 | 8 | 1 | 80 |
| Fifth SF | 10 | 16 | 1 | 160 |
| Sixth SF | 10 | 32 | 1 | 320 |
| Seventh SF | 0 | 64 | 0 | 0 |
| Eighth SF | 0 | 128 | 0 | 0 |

| | |
|---|---|
| Total sum of calculated values | 665 |

131

| | | | | | | | | | | | | | | | |
|---|---|---|---|---|---|---|---|---|---|---|---|---|---|---|---|
| First SF | 1 | 1 | 1 | 1 | 1 | 1 | 1 | 1 | 1 | 1 | 1 | 1 | 1 | 1 | 1 |
| Second SF | 1 | 1 | 1 | 1 | 1 | 1 | 1 | 1 | 1 | 1 | 1 | 1 | 1 | 1 | 1 |
| Third SF | 1 | 1 | 1 | 1 | 1 | 1 | 1 | 1 | 1 | 1 | 1 | 1 | 1 | 1 | 1 |
| Fourth SF | 1 | 1 | 1 | 1 | 1 | 1 | 1 | 1 | 1 | 1 | 1 | 1 | 1 | 1 | 1 |
| Fifth SF | 1 | 1 | 1 | 1 | 1 | 1 | 1 | 1 | 1 | 1 | 1 | 1 | 1 | 1 | 1 |
| Sixth SF | 1 | 1 | 1 | 1 | 1 | 1 | 1 | 1 | 1 | 1 | 1 | 1 | 1 | 1 | 1 |
| Seventh SF | | | | | | | | | | | | | | | |
| Eighth SF | | | | | | | | | | | | | | | |

132

| | Number of lit cells | Luminance weight | Lighting state of discharge cell B | Calculated value |
|---|---|---|---|---|
| First SF | 15 | 1 | 1 | 15 |
| Second SF | 15 | 2 | 1 | 30 |
| Third SF | 15 | 4 | 1 | 60 |
| Fourth SF | 15 | 8 | 1 | 120 |
| Fifth SF | 15 | 16 | 1 | 240 |
| Sixth SF | 15 | 32 | 1 | 480 |
| Seventh SF | 0 | 64 | 0 | 0 |
| Eighth SF | 0 | 128 | 0 | 0 |

| | |
|---|---|
| Total sum of calculated values | 945 |

PLASMA DISPLAY DEVICE AND PLASMA DISPLAY PANEL DRIVING METHOD

This application is a U.S. National Phase application of PCT International Application PCT/JP2009/006037.

TECHNICAL FIELD

The present invention relates to a plasma display device for use in a wall-mounted television or a large monitor, and to a driving method for a plasma display panel.

BACKGROUND ART

A typical alternating-current surface discharge panel used as a plasma display panel (hereinafter, simply referred to as "panel") has a large number of discharge cells that are formed between a front plate and a rear plate facing each other. The front plate has the following elements:

- a plurality of display electrode pairs, each formed of a scan electrode and a sustain electrode, disposed on a front glass substrate parallel to each other; and
- a dielectric layer and a protective layer formed so as to cover the display electrode pairs. The rear plate has the following elements:
- a plurality of parallel data electrodes formed on a rear glass substrate;
- a dielectric layer formed so as to cover the data electrodes;
- a plurality of barrier ribs formed on the dielectric layer parallel to the data electrodes; and
- phosphor layers formed on the surface of the dielectric layer and on the side faces of the barrier ribs.

The front plate and the rear plate face each other such that the display electrode pairs and the data electrodes three-dimensionally intersect, and are sealed together. A discharge gas containing xenon in a partial pressure ratio of 5%, for example, is sealed into the inside discharge space. Discharge cells are formed in portions where the display electrode pairs face the data electrodes. In a panel having such a structure, gas discharge generates ultraviolet light in each discharge cell. This ultraviolet light excites the red (R), green (G), and blue (G) phosphors so that the phosphors emit the corresponding colors for color display.

As a driving method for the panel, a subfield method is typically used. In the subfield method, one field period is divided into a plurality of subfields, and gradations are displayed by the combination of the subfields where light is emitted.

Each subfield has an initializing period, an address period, and a sustain period. In the initializing period, an initializing waveform is applied to the respective scan electrodes so as to cause an initializing discharge in the respective discharge cells. This initializing discharge forms wall charge necessary for the subsequent address operation in the respective discharge cells and generates priming particles (excitation particles for causing an address discharge) for stably causing the address discharge.

In the address period, a scan pulse is sequentially applied to the scan electrodes (hereinafter, this operation being also referred to as "scanning"). Further, an address pulse corresponding to a signal of an image to be displayed is selectively applied to the data electrodes (hereinafter, these operations being also generically referred to as "addressing"). Thus, an address discharge is selectively caused between the scan electrodes and the data electrodes so as to selectively form wall charge.

In the sustain period, a sustain pulse is alternately applied to display electrode pairs, each formed of a scan electrode and a sustain electrode, at a predetermined number of times corresponding to a luminance to be displayed. Thereby, a sustain discharge is selectively caused in the discharge cells where the address discharge has formed wall charge, and thus causes light emission in the discharge cells (hereinafter, causing light emission in a discharge cell being also referred to as "lighting", causing no light emission in a discharge cell as "non-lighting"). In this manner, an image is displayed in the display area of the panel.

In this subfield method, the following operations, for example, can minimize the light emission unrelated to gradation display and thus improve the contrast ratio. In the initializing period of one subfield among a plurality of subfields, an all-cell initializing operation for causing a discharge in all the discharge cells is performed. In the initializing periods of the other subfields, a selective initializing operation for causing an initializing discharge selectively in the discharge cells having undergone a sustain discharge is performed.

With a recent increase in the screen size and definition of a panel, the plasma display device is requested to have enhanced image display quality. However, a difference in drive impedance between display electrode pairs causes a difference in the voltage drop in drive voltage. This can produce a difference in emission luminance even with image signals having an equal luminance, in some cases.

To address this problem, the following technique is disclosed (see Patent Literature 1, for example). In this technique, the lighting patterns in the subfields in one field are changed when the drive impedance changes between display electrode pairs.

Another technique is disclosed to reduce an image persistence phenomenon in a panel and uniformize the display luminance in the respective discharge cells (see Patent Literature 2, for example). In this technique, an overlapping period is set such that a time period during which a sustain pulse applied to one electrode of a display electrode pair rises is overlapped with a time period during which a sustain pulse applied to the other electrode of the display electrode pair falls. Further, the overlapping period is changed according to the light-emitting rate detected in the light-emitting rate detecting circuit.

On the other hand, with an increase in the screen size and definition of a panel, the drive impedance of the panel tends to increase. Thus, even among the discharge cells formed on one display electrode pair, the difference in the voltage drop in drive voltage tends to increase between a discharge cell positioned nearer to the driving circuit and a discharge cell positioned farther from the driving circuit.

However, with the technique disclosed in Patent Literature 1, it is difficult to reduce the difference in emission luminance based on the difference in the voltage drop in drive voltage between a discharge cell positioned nearer to the driving circuit and a discharge cell positioned farther from the driving circuit on one display electrode pair.

The increase in the screen size and definition of a panel increases the interelectrode capacitance of the panel. The increased interelectrode capacitance increases reactive power, which is uselessly consumed without contributing to light emission when the panel is driven. This is one of the causes for increasing power consumption.

In a panel of which drive impedance is increased by the increase in the screen size and definition, a waveform distortion, such as ringing, is likely to occur in the driving waveforms. This is likely to increase variations in discharge, and thus cause variations in luminance, which is called luminance unevenness.

CITATION LIST

Patent Literature

[PTL1]
Japanese Patent Unexamined Publication No. 2006-184843
[PTL2]
Japanese Patent Unexamined Publication No. 2008-209840

SUMMARY OF INVENTION

A plasma display device includes the following elements:

a panel, the panel being driven by a subfield method in which a plurality of subfields are set in one field, each of the subfields has an initializing period, an address period, and a sustain period, a luminance weight is set for each of the subfields, and sustain pulses corresponding in number to the luminance weight are generated in the sustain period for gradation display, the panel having a plurality of discharge cells, the discharge cells having display electrode pairs, each of the display electrode pairs being formed of a scan electrode and a sustain electrode;

an image signal processing circuit for converting an input image signal into image data showing light emission and no light emission in the discharge cells in each subfield;

a sustain pulse generating circuit for generating and applying the sustain pulses alternately to the scan electrodes and the sustain electrodes of the display electrode pairs in the sustain period, the sustain pulse generating circuit including:

a power recovery circuit for causing resonance between an interelectrode capacitance of the display electrode pairs and an inductor, and thereby causing the sustain pulses to rise or fall; and a clamp circuit for clamping a voltage of the sustain pulses to a power supply voltage or a base voltage;

an all-cell light-emitting rate detecting circuit for detecting a rate of the number of discharge cells to be lit with respect to the number of all discharge cells in a display area of the panel, as an all-cell light-emitting rate, in each subfield; and a partial light-emitting rate detecting circuit for dividing the display area of the panel into a plurality of regions, and detecting a rate of the number of discharge cells to be lit with respect to the number of discharge cells in each of the regions, as a partial light-emitting rate, in each subfield.

The sustain pulse generating circuit generates the plurality of sustain pulses where the lengths of at least one of the rising period and the falling period are different, and generates the sustain pulses by selecting a driving pattern according to the all-cell light-emitting rate and the partial light-emitting rate, among a plurality of driving patterns where the sustain pulses are generated in different combinations. The image signal processing circuit includes the following elements:

a number of lit cells calculator for calculating the number of discharge cells to be lit in each display electrode pair, in each subfield;

a load value calculator for calculating a load value of each of the discharge cells, according to the calculation result in the number of lit cells calculator;

a correction gain calculator for calculating a correction gain of each of the discharge cells, according to the calculation result in the load value calculator, the driving pattern selected, and the position of the discharge cell; and a corrector for subtracting the multiplication result of the output from the correction gain calculator and the input image signal, from the input image signal.

With this structure, loading correction can be performed with a correction gain corresponding to the position of the discharge cell. Further, the loading correction is performed with the correction gain accommodating to the difference in the emission luminance caused according to the driving pattern. Thus, this structure can cause stable discharge while reducing power consumption, and enhance the image display quality by uniformizing the display luminance.

DESCRIPTION OF EMBODIMENTS

Hereinafter, a plasma display device in accordance with an exemplary embodiment of the present invention will be described, with reference to the accompanying drawings.

Example

Figure 1:
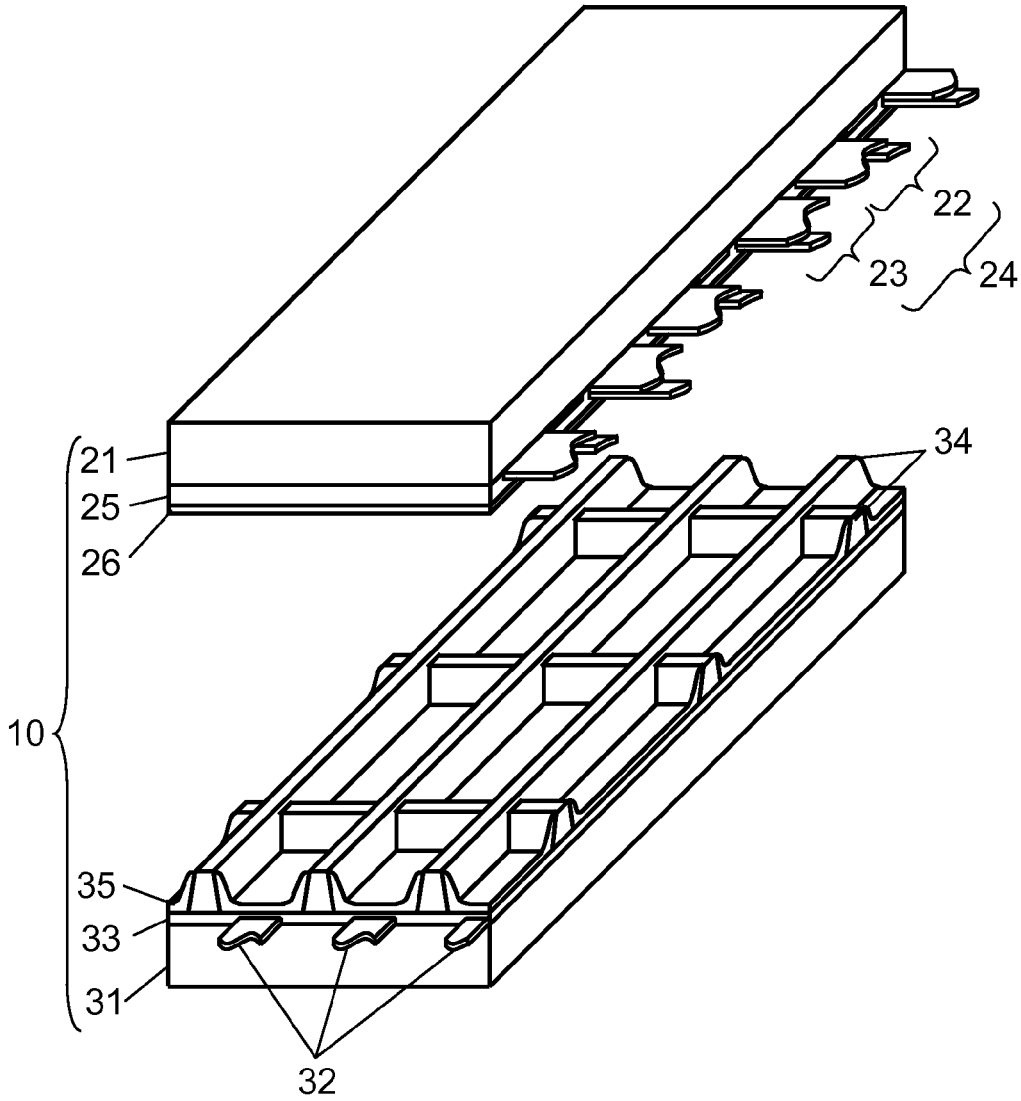
FIG. 1 is an exploded perspective view showing a structure of a panel in accordance with an exemplary embodiment of the present invention.

FIG. 1 is an exploded perspective view showing a structure of panel 10 in accordance with the exemplary embodiment of the present invention. A plurality of display electrode pairs 24, each formed of scan electrode 22 and sustain electrode 23, is disposed on glass front plate 21. Dielectric layer 25 is formed so as to cover scan electrodes 22 and sustain electrodes 23. Protective layer 26 is formed over dielectric layer 25.

In order to lower breakdown voltage in discharge cells, protective layer 26 is made of a material predominantly composed of MgO because MgO has proven performance as a panel material, and exhibits a large secondary electron emission coefficient and excellent durability when neon (Ne) and xenon (Xe) gas is sealed.

A plurality of data electrodes 32 is formed on rear plate 31. Dielectric layer 33 is formed so as to cover data electrodes 32, and mesh barrier ribs 34 are formed on the dielectric layer. On the side faces of barrier ribs 34 and dielectric layer 33, phosphor layers 35 for emitting light in red (R), green (G), and blue (B) colors are formed.

Front plate 21 and rear plate 31 face each other such that display electrode pairs 24 intersect with data electrodes 32 with a small discharge space sandwiched between the electrodes. The outer peripheries of the plates are sealed with a sealing material, e.g. a glass frit. In the inside discharge space, a mixed gas of neon and xenon is sealed as a discharge gas. In this exemplary embodiment, a discharge gas having a xenon partial pressure of approximately 10% is used to improve the emission efficiency. The discharge space is partitioned into a plurality of compartments by barrier ribs 34. Discharge cells are formed in the intersecting parts of display electrode pairs 24 and data electrodes 32. The discharge cells discharge and emit light (are lit) so as to display an image. In panel 10, three discharge cells for emitting the corresponding R, G, and B light form one pixel.

The structure of panel 10 is not limited to the above, and may include barrier ribs formed in a stripe pattern. The mixing ratio of the discharge gas is not limited to the above numerical value, and other mixing ratios may be used.

Figure 2:
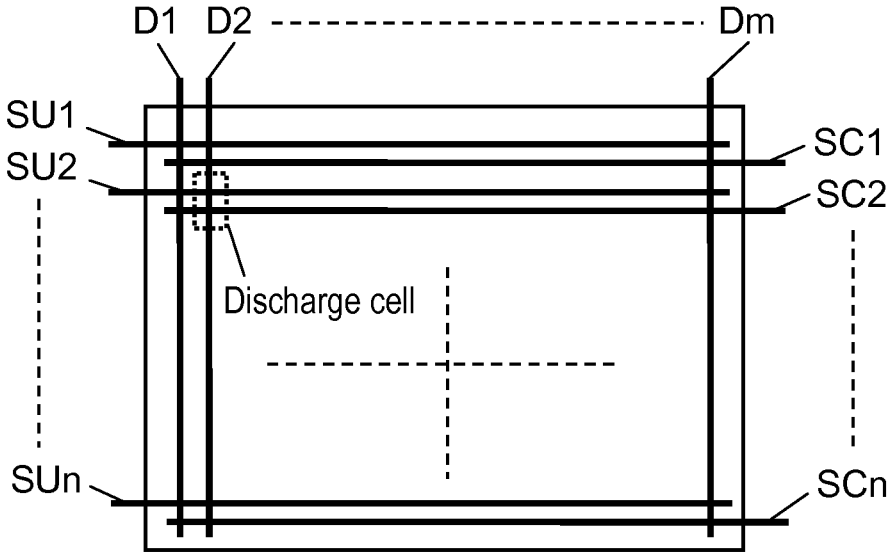
FIG. 2 is an electrode array diagram of the panel.

FIG. 2 is an electrode array diagram of panel 10 in accordance with the exemplary embodiment of the present invention. Panel 10 has n scan electrode SC1 through scan electrode SCn (scan electrodes 22 in FIG. 1) and n sustain electrode SU1 through sustain electrode SUn (sustain electrodes 23 in FIG. 1) both long in the row direction, and m data electrode D1 through data electrode Dm (data electrodes 32 in FIG. 1) long in the column direction. A discharge cell is formed in the part where a pair of scan electrode SCi (i being 1 through n) and sustain electrode SUi intersects with one data electrode Dj (j being 1 through m). Thus, m×n discharge cells are formed in the discharge space. The area where m×n discharge cells are formed is the display area of panel 10.

Next, driving voltage waveforms for driving panel 10 and the operation thereof are outlined. A plasma display device of this exemplary embodiment displays gradations by a subfield method: one field is divided into a plurality of subfields along a temporal axis, a luminance weight is set for each subfield, and light emission or no light emission of each discharge cell is controlled in each subfield.

In this subfield (SF) method, one field is formed of eight subfields (the first SF, and the second SF through the eighth SF), and the respective subfields have luminance weights of 1, 2, 4, 8, 16, 32, 64, and 128, for example. In the initializing period of one subfield among the plurality of subfields, an all-cell initializing operation for causing an initializing discharge in all the discharge cells is performed (hereinafter, a subfield for the all-cell initializing operation being referred to as "all-cell initializing subfield"). In the initializing periods of the other subfields, a selective initializing operation for causing an initializing discharge selectively in the discharge cells having undergone a sustain discharge is performed (hereinafter, a subfield for the selective initializing operation being referred to as "selective initializing subfield"). These operations can minimize the light emission unrelated to gradation display and improve the contrast ratio.

In this exemplary embodiment, in the initializing period of the first SF, the all-cell initializing operation is performed. In the initializing periods of the second SF through the eighth SF, the selective initializing operation is performed. With these operations, the light emission unrelated to image display is only the light emission caused by the discharge in the all-cell initializing operation in the first SF. The luminance of a black level, i.e. the luminance in an area displaying a black picture where no sustain discharge is caused, is determined only by the weak light emission in the all-cell initializing operation. Thus, an image having a high contrast can be displayed. In the sustain period of each subfield, sustain pulses equal in number to the luminance weight of the subfield multiplied by a predetermined proportionality factor are applied to respective display electrode pairs 24. This proportionality factor is a luminance magnification.

However, in this exemplary embodiment, the number of subfields, or the luminance weight of each subfield is not limited to the above values. The subfield structure may be switched according to image signals, for example.

In this exemplary embodiment, according to the light-emitting rate in each subfield measured in an all-cell light-emitting rate detecting circuit and a partial light-emitting rate detecting circuit to be described later, the following two operations are performed. One operation is to change the length of at least one of a period during which a power recovery circuit to be described later is operated to cause a sustain pulse to rise (hereinafter, referred to as "rising period") and a period during which the power recovery circuit is operated to cause the sustain pulse to fall (hereinafter, "falling period"). The other operation is to change an overlapping period during which the rising edge and the falling edge of the sustain pulses are overlapped. These operations cause a sustain discharge stably while reducing the power consumption of panel 10. Hereinafter, first, a description is provided for the outline of the driving voltage waveforms and the structure of driving circuits. Next, a description is provided for the "rising period", "falling period", and overlapping period corresponding to the light-emitting rate.

Figure 3:
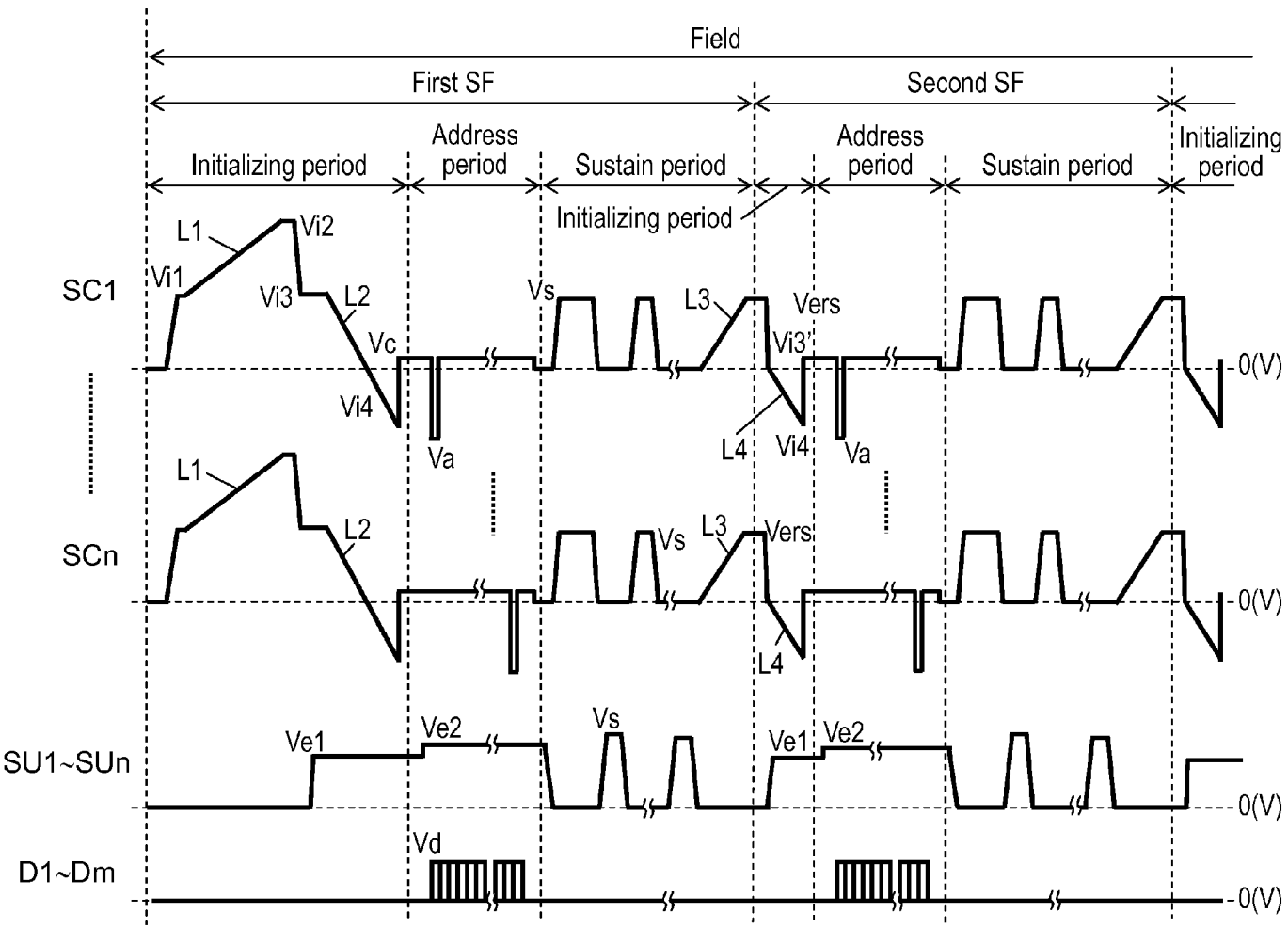
FIG. 3 is a waveform chart of driving voltages applied to the respective electrodes of the panel.

FIG. 3 is a waveform chart of driving voltages applied to the respective electrodes of panel 10 in accordance with the exemplary embodiment of the present invention. FIG. 3 shows driving waveforms applied to scan electrode SC1 to be scanned first in the address periods, scan electrode SCn to be scanned last in the address periods, sustain electrode SU1 through sustain electrode SUn, and data electrode D1 through data electrode Dm.

FIG. 3 shows driving voltage waveforms in two subfields: the first subfield (first SF), i.e. an all-cell initializing subfield; and the second subfield (second SF), i.e. a selective initializing subfield. The driving voltage waveforms in the other subfields are substantially similar to the driving voltage waveforms in the second SF, except for the numbers of sustain pulses generated in the sustain periods. Scan electrode SCi, sustain electrode SUi, and data electrode Dk to be described below show the electrodes selected from the corresponding electrodes, according to image data (data showing light emission or no light emission in each subfield).

First, a description is provided for the first SF, an all-cell initializing subfield. In the first half of the initializing period of the first SF, 0 (V) is applied to each of data electrode D1 through data electrode Dm and sustain electrode SU1 through sustain electrode SUn, and ramp voltage (hereinafter, referred to as "up-ramp voltage") L1 is applied to scan electrode SC1 through scan electrode SCn. Here, the up-ramp voltage gradually (e.g. at a gradient of approximately 1.3 V/μsec) rises from voltage Vi1, which is equal to or lower than a breakdown voltage, toward voltage Vi2, which exceeds the breakdown voltage, with respect to sustain electrode SU1 through sustain electrode SUn.

While up-ramp voltage L1 is rising, a weak initializing discharge continuously occurs between scan electrode SC1 through scan electrode SCn and sustain electrode SU1 through sustain electrode SUn, and between scan electrode SC1 through scan electrode SCn and data electrode D1 through data electrode Dm. Then, negative wall voltage accumulates on scan electrode SC1 through scan electrode SCn; positive wall voltage accumulates on data electrode D1 through data electrode Dm and sustain electrode SU1 through sustain electrode SUn. Here, this wall voltage on the electrodes means the voltage generated by the wall charge that is accumulated on the dielectric layers covering the electrodes, the protective layer, the phosphor layers, or the like.

In the second half of the initializing period, positive voltage Ve1 is applied to sustain electrode SU1 through sustain electrode SUn, 0 (V) is applied to data electrode D1 through data electrode Dm, and ramp voltage (hereinafter, referred to as "down-ramp voltage") L2 is applied to scan electrode SC1 through scan electrode SCn. Here, the down-ramp voltage gradually falls from voltage Vi3, which is equal to or lower than the breakdown voltage, toward voltage Vi4, which exceeds the breakdown voltage, with respect to sustain electrode SU1 through sustain electrode SUn.

During this application, a weak initializing discharge occurs between scan electrode SC1 through scan electrode SCn and sustain electrode SU1 through sustain electrode SUn, and between scan electrode SC1 through scan electrode SCn and data electrode D1 through data electrode Dm. This weak discharge reduces the negative wall voltage on scan electrode SC1 through scan electrode SCn, and the positive wall voltage on sustain electrode SU1 through sustain electrode SUn, and adjusts the positive wall voltage on data electrode D1 through data electrode Dm to a value appropriate for the address operation. In this manner, the all-cell initializing operation for causing an initializing discharge in all the discharge cells is completed.

As shown in the initializing period of the second SF in FIG. 3, driving voltage waveforms where the first half of the initializing period is omitted may be applied to the respective electrodes. That is, voltage Ve1 is applied to sustain electrode SU1 through sustain electrode SUn, 0 (V) is applied to data electrode D1 through data electrode Dm, and down-ramp voltage L4 is applied to scan electrode SC1 through scan electrode SCn. Here, down-ramp voltage L4 gradually falls from a voltage equal to or lower than the breakdown voltage (e.g. a ground potential) toward voltage Vi4. This application causes a weak initializing discharge in the discharge cells having undergone a sustain discharge in the sustain period of the immediately preceding subfield (the first SF in FIG. 3), and reduces the wall voltage on scan electrode SCi and sustain electrode SUi. The excess part of the wall voltage on data electrode Dk (k being 1 through m) is discharged, and the wall voltage is adjusted to a value appropriate for the address operation.

On the other hand, in the discharge cells having undergone no sustain discharge in the immediately preceding subfield, no discharge occurs and the wall charge at the completion of the initializing period of the immediately preceding subfield is maintained. In this manner, the initializing operation where the first half is omitted is a selective initializing operation for causing an initializing discharge in the discharge cells having undergone a sustain operation in the sustain period of the immediately preceding subfield.

In the subsequent address period, scan pulse voltage Va is sequentially applied to scan electrode SC1 through scan electrode SCn. Positive address pulse voltage Vd is applied to data electrode Dk (k being 1 through m) corresponding to a discharge cell to be lit among data electrode D1 through data electrode Dm. Thus, an address discharge is caused selectively in the corresponding discharge cells.

In the address period, first, voltage Vet is applied to sustain electrode SU1 through sustain electrode SUn, and voltage Vc is applied to scan electrode SC1 through scan electrode SCn.

Next, negative scan pulse voltage Va is applied to scan electrode SC1 in the first row, and positive address pulse voltage Vd is applied to data electrode Dk (k being 1 through m) of the discharge cell to be lit in the first row among data electrode D1 through data electrode Dm. At this time, the voltage difference in the intersecting part of data electrode Dk and scan electrode SC1 is obtained by adding the difference between the wall voltage on data electrode Dk and the wall voltage on scan electrode SC1 to a difference in externally applied voltage (voltage Vd-voltage Va), and thus exceeds the breakdown voltage.

Then, a discharge occurs between data electrodes Dk and scan electrode SC1. Since voltage Ve2 is applied to sustain electrode SU1 through sustain electrode SUn, the voltage difference between sustain electrode SU1 and scan electrode SC1 is obtained by adding the difference between the wall voltage on sustain electrode SU1 and the wall voltage on scan electrode SC1 to a difference in externally applied voltage (voltage Ve2-voltage Va). At this time, setting voltage Ve2 to a value slightly lower than the breakdown voltage can make a state where a discharge is likely to occur but not actually occurs between sustain electrode SU1 and scan electrode SC1.

With this setting, the discharge caused between data electrode Dk and scan electrode SC1 can trigger a discharge between the areas of sustain electrode SU1 and scan electrode SC1 intersecting with data electrode Dk. Thus, an address discharge occurs in the discharge cells to be lit. Positive wall voltage accumulates on scan electrode SC1 and negative wall voltage accumulates on sustain electrode SU1. Negative wall voltage also accumulates on data electrode Dk.

In this manner, the address operation is performed so as to cause the address discharge in the discharge cells to be lit in the first row and accumulate wall voltages on the corresponding electrodes. On the other hand, the voltage in the intersecting parts of scan electrode SC1 and data electrode D1 through data electrode Dm applied with no address pulse voltage Vd does not exceed the breakdown voltage, and thus no address discharge occurs. The above address operation is repeated until the operation reaches the discharge cells in the n-th row, and the address period is completed.

In the subsequent sustain period, sustain pulses equal in number to the luminance weight multiplied by a predetermined luminance magnification are alternately applied to display electrode pairs 24. Thereby, a sustain discharge is caused in the discharge cells having undergone the address discharge, for light emission.

In this sustain period, first, positive sustain pulse voltage Vs is applied to scan electrode SC1 through scan electrode SCn, and the ground potential as a base potential, i.e. 0 (V), is applied to sustain electrode SU1 through sustain electrode SUn. Then, in the discharge cells having undergone the address discharge, the voltage difference between scan electrode SCi and sustain electrode SUi is obtained by adding the difference between the wall voltage on scan electrode SCi and the wall voltage on sustain electrode SUi to sustain pulse voltage Vs, and thus exceeds the breakdown voltage.

Then, a sustain discharge occurs between scan electrode SCi and sustain electrode SUi, and ultraviolet light generated at this time causes phosphor layers 35 to emit light. Thus, negative wall voltage accumulates on scan electrode SCi, and positive wall voltage accumulates on sustain electrode SUi. Positive wall voltage also accumulates on data electrode Dk. In the discharge cells having undergone no address discharge in the address period, no sustain discharge occurs and the wall voltage at the completion of the initializing period is maintained.

Subsequently, 0 (V) as the base potential is applied to scan electrode SC1 through scan electrode SCn, and sustain pulse voltage Vs is applied to sustain electrode SU1 through sustain electrode SUn. In the discharge cell having undergone the sustain discharge, the voltage difference between sustain electrode SUi and scan electrode SCi exceeds the breakdown voltage. Thereby, a sustain discharge occurs between sustain electrode SUi and scan electrode SCi again. Thus, negative wall voltage accumulates on sustain electrode SUi, and positive wall voltage accumulates on scan electrode SCi. Similarly, sustain pulses equal in number to the luminance weight multiplied by the luminance magnification are alternately applied to scan electrode SC1 through scan electrode SCn and sustain electrode SU1 through sustain electrode SUn so as to cause a potential difference between the electrodes of display electrode pairs 24. Thereby, the sustain discharge is continued in the discharge cells having undergone the address discharge in the address period.

After the sustain pulses have been generated in the sustain period, ramp voltage (hereinafter, referred to as "erasing ramp voltage") L3, which gradually rises from 0 (V) toward voltage Vers, is applied to scan electrode SC1 through scan electrode SCn. Thereby, in the discharge cells having undergone the sustain discharge, a weak discharge is continuously caused, and a part or the whole of the wall voltages on scan electrode SCi and sustain electrode SUi is erased while the positive wall voltage is left on data electrode Dk.

The respective operations in the subsequent second SF and thereafter are substantially similar to the above operation except for the numbers of sustain pulses in the sustain periods, and thus the description is omitted. The above description has outlined the driving voltage waveforms applied to the respective electrodes of panel 10 in this exemplary embodiment.

Figure 4:
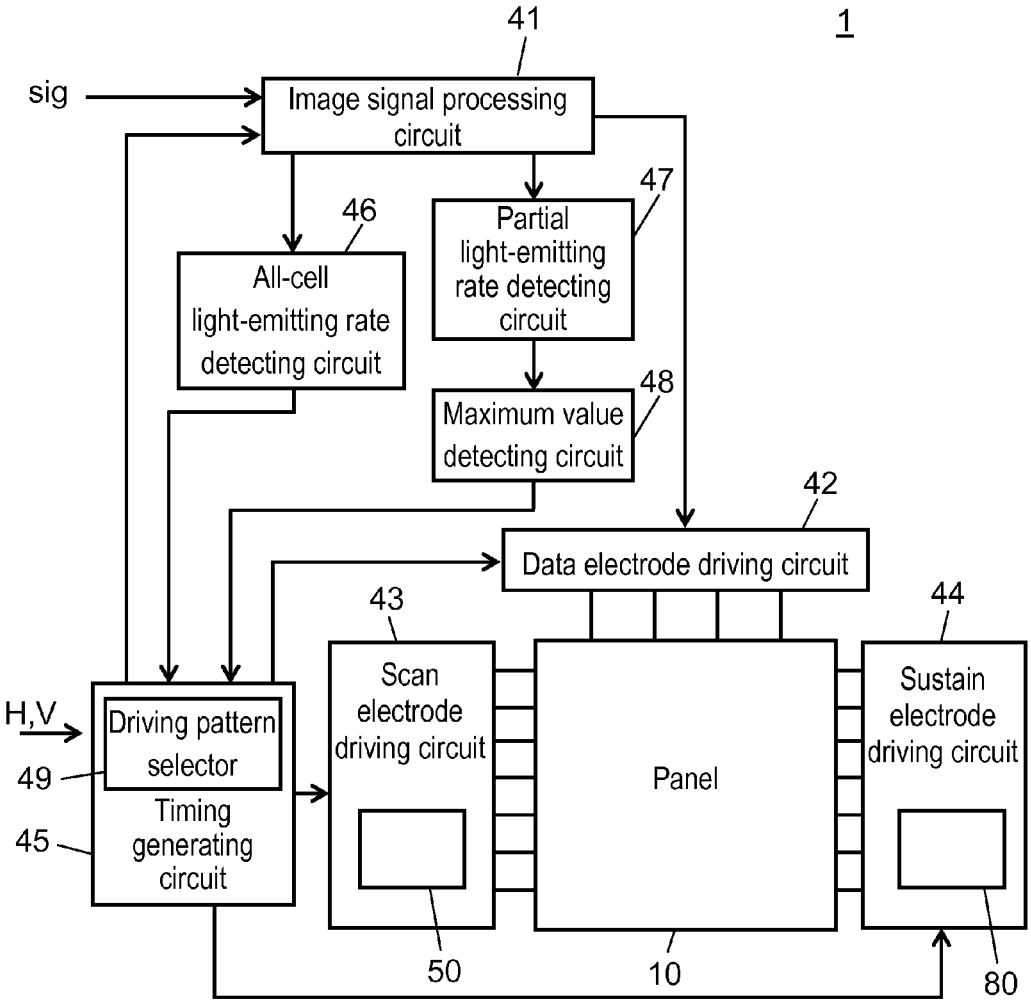
FIG. 4 is a circuit block diagram of a plasma display device in accordance with the exemplary embodiment of the present invention.

Next, a structure of a plasma display device in this exemplary embodiment is described. FIG. 4 is a circuit block diagram of a plasma display device in accordance with the exemplary embodiment of the present invention. Plasma display device 1 has the following elements:

panel 10;
image signal processing circuit 41;
data electrode driving circuit 42;
scan electrode driving circuit 43;
sustain electrode driving circuit 44;
timing generating circuit 45;
all-cell light-emitting rate detecting circuit 46;
partial light-emitting rate detecting circuit 47;
maximum value detecting circuit 48; and
power supply circuits (not shown) for supplying power necessary for each circuit block.

Image signal processing circuit 41 converts input image signal sig to image data showing light emission and no light emission in the discharge cells in each subfield.

All-cell light-emitting rate detecting circuit 46 detects a rate of the number of discharge cells to be lit with respect to the number of all discharge cells on the image display surface of panel 10, as "all-cell light-emitting rate", in each subfield, according to image data in each subfield. Then, the all-cell light-emitting rate detecting circuit compares the detected all-cell light-emitting rate with a plurality of predetermined light-emitting rate threshold values (30% and 70%, in this exemplary embodiment), and outputs a signal showing the result to timing generating circuit 45.

Partial light-emitting rate detecting circuit 47 divides the display area of panel 10 into a plurality of regions, and detects a rate of the number of discharge cells to be lit with respect to the number of discharge cells in each region, as "partial light-emitting rate", for each region, in each subfield. Partial light-emitting rate detecting circuit 47 may detect a light-emitting rate in each display electrode pair 24, for example, as a partial light-emitting rate. However, herein, the area that is formed of a plurality of scan electrodes 22 connected to one of integrated circuits for driving scan electrodes 22 (hereinafter, referred to as "scan IC") is set as one region, and a partial light-emitting rate is detected for each region.

Maximum value detecting circuit 48 compares the values of the partial light-emitting rate in the respective regions detected in partial light-emitting rate detecting circuit 47, and detects the maximum value in each subfield. Then, the maximum value detecting circuit compares the detected maximum value with a plurality of predetermined maximum value threshold values (70%, in this exemplary embodiment), and outputs a signal showing the result to timing generating circuit 45.

The light-emitting rate threshold value and the maximum value threshold value are not limited to the above numerical values. Preferably, these numerical values are set to optimum values for the characteristics of panel 10, the specifications of plasma display device 1, or the like.

Timing generating circuit 45 has driving pattern selector 49, and generates various timing signals for controlling the operation of each circuit block according to horizontal synchronizing signal H, vertical synchronizing signal V, and the output from all-cell light-emitting rate detecting circuit 46 and maximum value detecting circuit 48, and supplies the timing signals to each circuit block. In this exemplary embodiment, as described above, the "rising period" on the rising edge of a sustain pulse, the "falling period" on the falling edge of the sustain pulse, and the overlapping period during which the rising edge and the falling edge of the sustain pulses are overlapped are controlled, according to the output from all-cell light-emitting rate detecting circuit 46 and maximum value detecting circuit 48. The details will be given later. In this exemplary embodiment, a plurality of sustain pulses where lengths of at least one of the "rising period" and the "falling period" are different is generated, and a plurality of driving patterns (e.g. five driving patterns of a first driving pattern, a second driving pattern, a third driving pattern, a fourth driving pattern, and a fifth driving pattern) where the sustain pulses are generated in different combinations with different lengths of the "overlapping period" is set. Then, any one of the driving patterns is selected in driving pattern selector 49, according to the output from all-cell light-emitting rate detecting circuit 46 and maximum value detecting circuit 48. The timing signals for making each control according to the selection result are generated in timing generating circuit 45 and supplied to each circuit block.

Scan electrode driving circuit 43 has the following elements:

an initializing waveform generating circuit for generating initializing waveforms to be applied to scan electrode SC1 through scan electrode SCn in the initializing periods;
sustain pulse generating circuit 50 for generating sustain pulses to be applied to scan electrode SC1 through scan electrode SCn in the sustain periods; and
a scan pulse generating circuit having a plurality of scan ICs, for generating scan pulse voltage Va to be applied to scan electrode SC1 through scan electrode SCn in the address periods. The scan electrode driving circuit drives each of scan electrode SC1 through scan electrode SCn, in response to the timing signals.

Data electrode driving circuit 42 converts image data in each subfield into signals corresponding to each of data electrode D1 through data electrode Dm, and drives each of data electrode D1 through data electrode Dm, in response to the timing signals.

Sustain electrode driving circuit 44 has sustain pulse generating circuit 80 and a circuit for generating voltage Ve1 and voltage Ve2 (not shown), and drives sustain electrode SU1 through sustain electrode SUn, in response to the timing signals.

Next, the details and operation of scan electrode driving circuit 43 are described. In the following description, the operation of bringing a switching element into conduction is denoted as "ON", and the operation of bringing a switching element out of conduction is denoted as "OFF". A signal for setting a switching element to ON is denoted as "Hi", and a signal for setting a switching element to OFF is denoted as "Lo".

Figure 5:
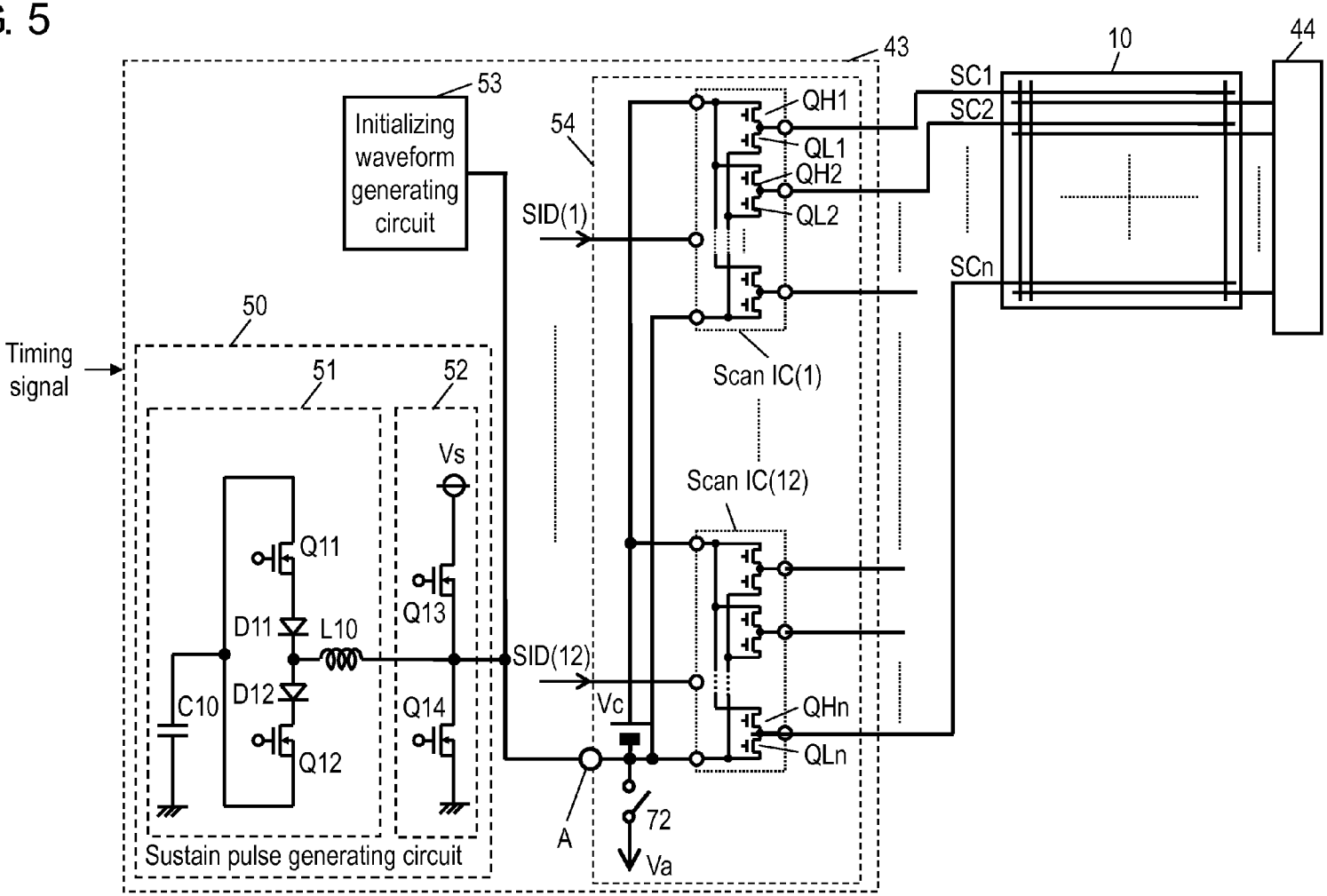
FIG. 5 is a circuit diagram showing a structure of a scan electrode driving circuit of the plasma display device in accordance with the exemplary embodiment.

FIG. 5 is a circuit diagram showing a structure of scan electrode driving circuit 43 of plasma display device 1 in accordance with the exemplary embodiment of the present invention. Scan electrode driving circuit 43 has sustain pulse generating circuit 50 on the side of scan electrodes 22, initializing waveform generating circuit 53, and scan pulse generating circuit 54. Each output of scan pulse generating circuit 54 is connected to corresponding one of scan electrode SC1 through scan electrode SCn of panel 10.

Initializing waveform generating circuit 53 causes reference potential A (voltage to be input to scan pulse generating circuit 54) of scan pulse generating circuit 54 to rise or fall in a ramp form in the initializing periods, thereby generating the initializing waveforms shown in FIG. 3.

Sustain pulse generating circuit 50 has power recovery circuit 51 and clamp circuit 52.

Power recovery circuit 51 has power recovery capacitor C10, switching element Q11, switching element Q12, blocking diode D11, blocking diode D12, and resonance inductor L10. The power recovery circuit causes LC resonance between interelectrode capacitance Cp and inductor L10 so as to make a sustain pulse rise and fall. Power recovery circuit 51 drives scan electrodes SC1 through SCn by causing LC resonance without power supplied from the power supply. Thus, ideally, the power consumption is 0. Power recovery capacitor C10 has a capacitance sufficiently larger than interelectrode capacitance Cp, and is charged to approximately Vs/2, i.e. a half of voltage Vs, so as to serve as the power supply of power recovery circuit 51.

Clamp circuit 52 has switching element Q13 for clamping scan electrodes SC1 through SCn to voltage Vs, and switching element Q14 for clamping scan electrodes SC1 through SCn to 0 (V) as the base potential. Scan electrodes SC1 through SCn are connected to power supply VS via switching element Q13 and clamped to voltage Vs, and scan electrodes SC1 through SCn are grounded via switching element Q14 and clamped to 0 (V). Therefore, the impedance during voltage application of clamp circuit 52 is small, and thus a large discharge current can be supplied by a strong sustain discharge in a stable manner.

In sustain pulse generating circuit 50, power recovery circuit 51 and clamp circuit 52 are operated by bringing switching element Q11, switching element Q12, switching element Q13, and switching element Q14 into and out of conduction, in response to the timing signals output from timing generating circuit 45. Thereby, the sustain pulse generating circuit generates sustain pulse waveforms.

For example, when a sustain pulse is caused to rise, the following operations are performed. Switching element Q11 is set to ON so that resonance is caused between interelectrode capacitance Cp and inductor L10. Thus, power is supplied from power recovery capacitor C10 to scan electrodes SC1 through SCn via switching element Q11, diode D11, and inductor L10. Then, at a time point when the voltage of scan electrodes SC1 through SCn approaches voltage Vs, switching element Q13 is set to ON, so that the circuit for driving scan electrodes SC1 through SCn is switched from power recovery circuit 51 to clamp circuit 52 and scan electrodes SC1 through SCn are clamped to voltage Vs.

In reverse, when a sustain pulse is caused to fall, the following operations are performed. Switching element Q12 is set to ON so that resonance is caused between interelectrode capacitance Cp and inductor L10. Thus, power is recovered from interelectrode capacitance Cp to power recovery capacitor C10 via inductor L10, diode D12, and switching element Q12. Then, at a time point when the voltage of scan electrodes SC1 through SCn approaches 0 (V), switching element Q14 is set to ON, so that the circuit for driving scan electrodes SC1 through SCn is switched from power recovery circuit 51 to clamp circuit 52 and scan electrodes SC1 through SCn are clamped to 0 (V) as the base potential.

In this manner, sustain pulse generating circuit 50 generates sustain pulses. These switching elements can be formed of generally known devices, such as a metal-oxide-semiconductor field-effect transistor (MOSFET) and an insulated gate bipolar transistor (IGBT).

Scan pulse generating circuit 54 has the following elements:

- switch 72 for connecting reference potential A to negative voltage Va in the address periods;
- power supply VC for supplying voltage Vc; and
- switching element QH1 through switching element QHn and switching element QL1 through switching element QLn for applying scan pulse voltage Va to n scan electrode SC1 through scan electrode SCn, respectively.

Switching element QH1 through switching element QHn and switching element QL1 through switching element QLn are grouped in a plurality of outputs and formed into ICs. These ICs are scan ICs. By setting switching element QHi to OFF and setting switching element QLi to ON, negative scan pulse voltage Va is applied to scan electrode SCi via switching element QLi.

When initializing waveform generating circuit 53 or sustain pulse generating circuit 50 is operated, the initializing waveform voltage or sustain pulse voltage Vs is applied to scan electrode SC1 through scan electrode SCn via switching element QL1 through switching element QLn, by setting switching element QH1 through switching element QHn to OFF and switching element QL1 through switching element QLn to ON, respectively.

The following description is provided for a case where switching elements for 90 outputs are integrated into one monolithic IC and panel 10 has 1,080 scan electrodes 22. Then, 12 scan ICs form scan pulse generating circuit 54, and drive 1,080 electrodes, i.e. scan electrode SC1 through scan electrode SCn. In this manner, integrating a large number of switching element QH1 through switching element QHn and switching element QL1 through switching element QLn into ICs can reduce the number of components and thus the mounting area. However, the above numerical values are only examples, and the present invention is not limited to these values.

In this embodiment, SID (1) through SID (12) output from timing generating circuit 45 are input to scan IC (1) through scan IC (12), respectively, in the address periods. These SID (1) through SID (12) are operation start signals for causing the scan ICs to start address operations.

Figure 6:
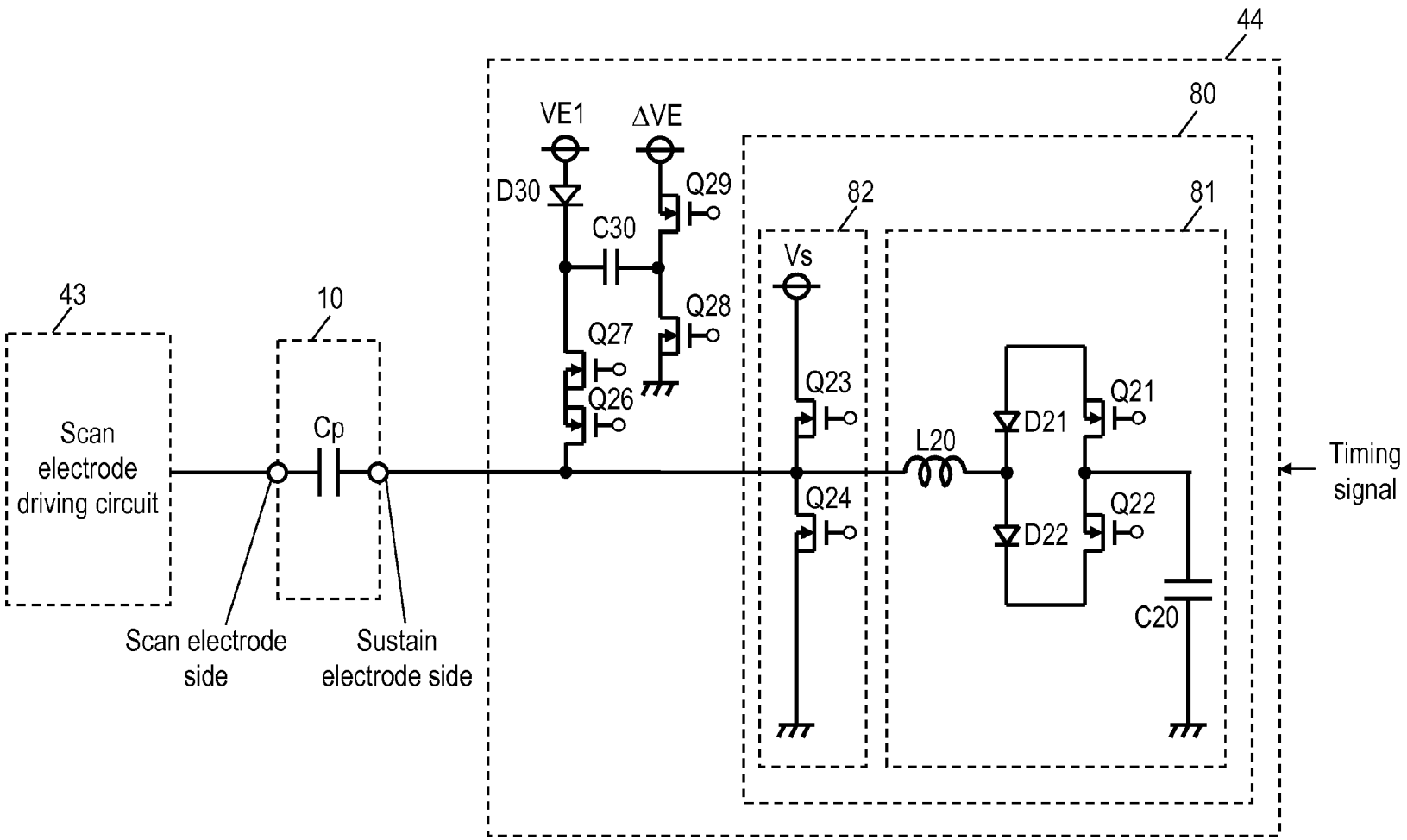
FIG. 6 is a circuit diagram showing a structure of a sustain electrode driving circuit of the plasma display device in accordance with the exemplary embodiment.

FIG. 6 is a circuit diagram showing a structure of sustain electrode driving circuit 44 of plasma display device 1 in accordance with the exemplary embodiment of the present invention. In FIG. 6, the interelectrode capacitance is shown as Cp and the circuit diagram of scan electrode driving circuit 43 is omitted.

Sustain electrode driving circuit 44 has sustain pulse generating circuit 80 substantially identical in structure to sustain pulse generating circuit 50. Sustain pulse generating circuit 80 has power recovery circuit 81 and clamp circuit 82, and connected to sustain electrode SU1 through sustain electrode SUn of panel 10.

Power recovery circuit 81 has power recovery capacitor C20, switching element Q21, switching element Q22, blocking diode D21, blocking diode D22, and resonance inductor L20. Clamp circuit 82 has switching element Q23 for clamping sustain electrode SU1 through sustain electrode SUn to voltage Vs, and switching element Q24 for clamping sustain electrode SU1 through sustain electrode SUn to the ground potential (0 (V)).

Sustain pulse generating circuit 80 generates sustain pulse waveforms by switching ON and OFF the corresponding switching elements, in response to the timing signals output from timing generating circuit 45. The operation of sustain pulse generating circuit 80 is similar to that of sustain pulse generating circuit 50, and thus the description is omitted.

Sustain electrode driving circuit 44 has the following elements:

- power supply VE1 for generating voltage Ve1;
- switching element Q26 and switching element Q27 for applying voltage Ve1 to sustain electrode SU1 through sustain electrode SUn;
- power supply ΔVE for generating voltage ΔVe;
- blocking diode D30;
- pumping-up capacitor C30 for adding voltage ΔVe to voltage Ve1; and switching element Q28 and switching element Q29 for providing voltage Ve2 by adding voltage ΔVe to voltage Ve1.

For example, at the timing of application of voltage Ve1 shown in FIG. 3, switching element Q26 and switching element Q27 are set to ON, so that positive voltage Ve1 is applied to sustain electrode SU1 through sustain electrode SUn via diode D30, switching element Q26, and switching element Q27. At this time, switching element Q28 is set to ON so that capacitor C30 is charged to voltage Ve1. At the timing of application of voltage Ve2 shown in FIG. 3, while switching element Q26 and switching element Q27 are kept at ON, switching element Q28 is set to OFF, and switching element Q29 to ON. Thereby, voltage ΔVe is superimposed on the voltage of capacitor C30, and voltage (Ve1+ΔVe), i.e. voltage Ve2, is applied to sustain electrodes SU1 to sustain electrode SUn. At this time, blocking diode D30 serves to block the current from capacitor C30 to power supply VE1.

The circuit for applying voltage Ve1 and Ve2 is not limited to the circuit shown in FIG. 6. For example, the circuit may be configured such that a power supply for generating voltage Ve1, a power supply for generating voltage Ve2, and a plurality of switching elements for applying each of voltage Ve1 and voltage Ve2 to sustain electrode SU1 through sustain electrode SUn are used to apply each voltage to sustain electrode SU1 through sustain electrode SUn at necessary timings.

The period of LC resonance between inductor L10 of power recovery circuit 51 and interelectrode capacitance Cp of panel 10, and the period of LC resonance between inductor L20 of power recovery circuit 81 and the same interelectrode capacitance Cp (hereinafter, referred to as "resonance period") can be obtained with the formula "$2\pi\sqrt{(LCp)}$" where L represents the inductance of each of inductor L10 and inductor L20. In this exemplary embodiment, inductor L10 and inductor L20 are set such that the resonance period in each of power recovery circuit 51 and power recovery circuit 81 is approximately 2,000 nsec. This numerical value is only an example and can be set to an optimum value for the characteristics of panel 10, the specifications of plasma display device 1, or the like.

Next, the driving voltage waveforms in the sustain periods are detailed. The output impedance of each power recovery circuit is larger than the output impedance of each clamp circuit. For this reason, when the rate of the discharge cells to be lit and thus the load in driving increase, a discharge can occur unstably.

Figure 7:
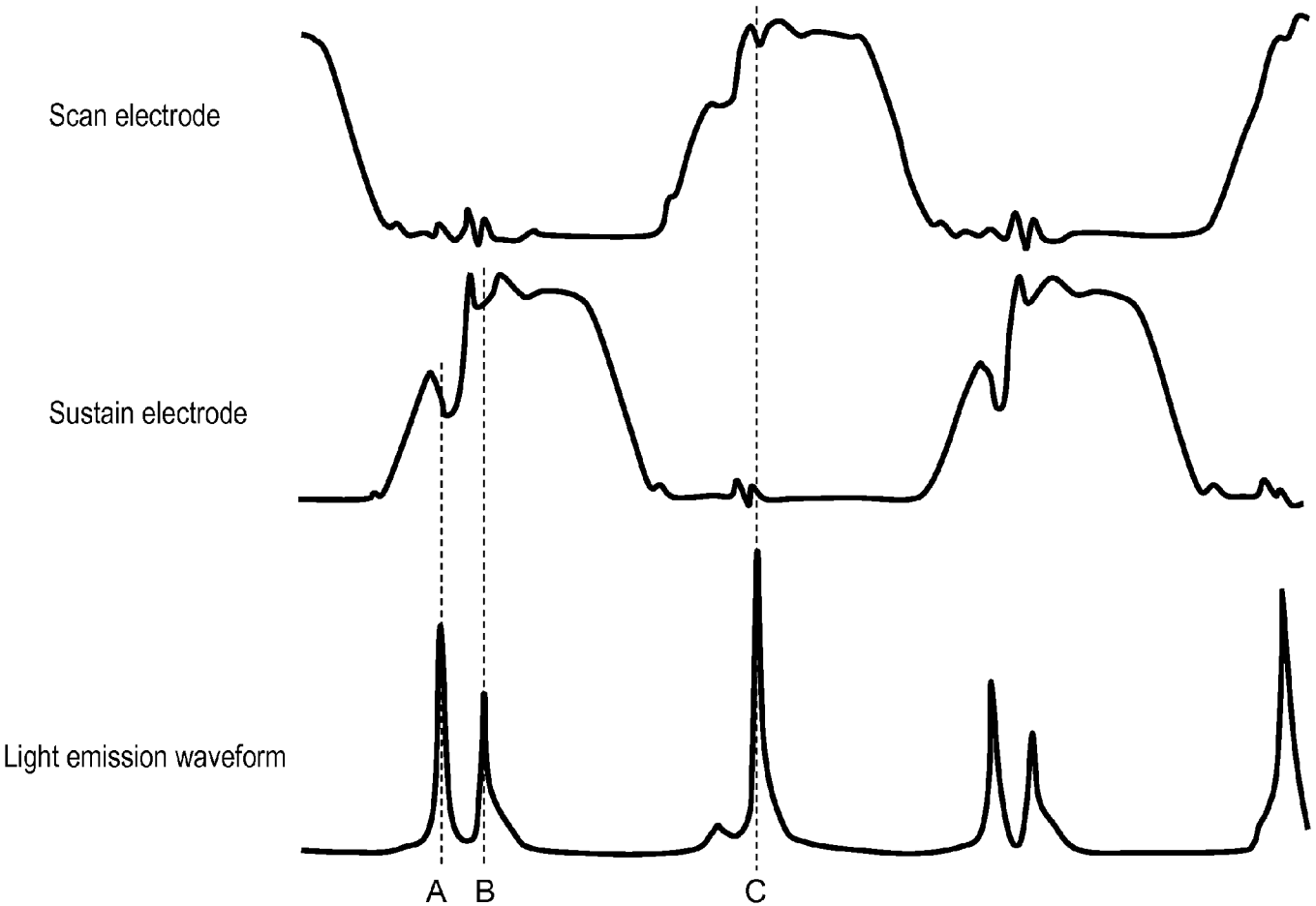
FIG. 7 is a schematic waveform chart showing an example of sustain pulses and a state of light emission in accordance with the exemplary embodiment.

FIG. 7 is a schematic waveform chart showing an example of sustain pulses and a state of light emission in accordance with the exemplary embodiment of the present invention. The waveforms of FIG. 7 are those showing an example of changes in voltage that are observed in scan electrode SCi and sustain electrode SUi in the sustain period of a subfield having a relatively high light-emitting rate. These waveforms also show the intensity of light emission at that time.

First, when the power recovery circuit causes a sustain pulse to rise, a first discharge occurs, as shown by A in the drawing, at a time point when the voltage obtained by adding the wall voltage to the sustain pulse voltage exceeds the breakdown voltage. At this time, in a subfield having a relatively high light-emitting rate, this discharge instantaneously supplies a large amount of discharge current, and thus the sustain pulse voltage temporarily drops. Thereafter, when the power recovery circuit is switched to the clamp circuit and the sustain pulse voltage is clamped to voltage Vs, a second discharge occurs as shown by B in the drawing, for example. However, because a part of the wall charge is consumed by the first discharge, the second discharge does not occur strongly. For this reason, the amount of wall charge accumulated is smaller than that accumulated when a strong discharge occurs.

As a result, on the rising edge of the immediately succeeding sustain pulse caused by the power recovery circuit, no discharge or only an extremely weak discharge occurs. Thereafter, when the power recovery circuit is switched to the clamp circuit and the sustain pulse voltage is clamped to voltage Vs, an extremely strong discharge occurs as shown by C in the drawing.

The strong discharge shown by C in the drawing accumulates sufficient wall charge in the discharge cell. Thus, on the rising edge of the next sustain pulse, two discharges occur as shown by A and B in the drawing.

In this manner, in the sustain period of a subfield having a relatively high light-emitting rate, one extremely strong discharge (a discharge shown by C in the drawing) and two consecutive discharges (discharges shown by A and B in the drawing) weaker than the strong discharge are repeated. As a result, variations in luminance called luminance unevenness can occur.

Though not shown, it is verified that the above variations in discharge decrease at a low light-emitting rate, and a stable sustain discharge occurs.

On the other hand, it is also verified that when the overlapping period during which the rising edge of a sustain pulse is overlapped with the falling edge of a sustain pulse is increased, variations in discharge can be reduced even in a subfield having a high light-emitting rate.

Figure 8:
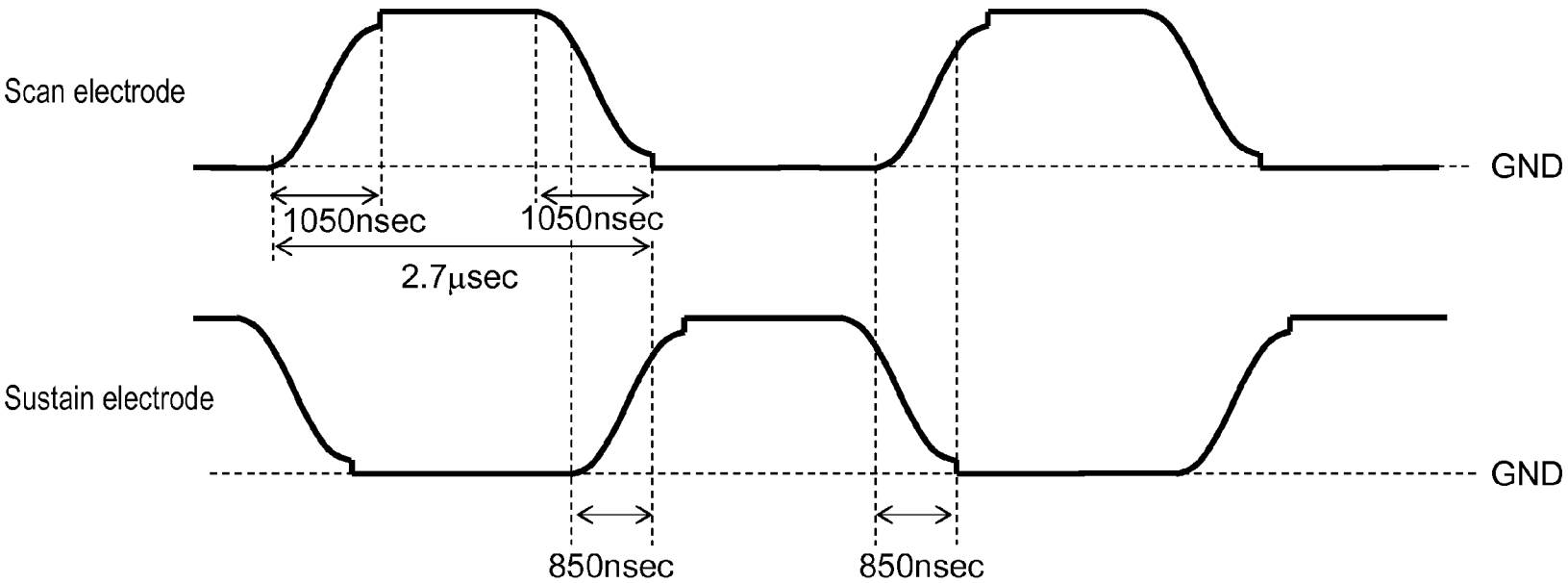
FIG. 8 is a schematic waveform chart showing an example of sustain pulses in accordance with the exemplary embodiment.

FIG. 8 is a schematic waveform chart showing an example of sustain pulses in accordance with the exemplary embodiment of the present invention. FIG. 8 shows an example where each of the "rising period" and the "falling period" of each of the sustain pulses is 1050 nsec, and the pulse width thereof is 2.7 μsec. This "pulse width" shows a period after the sustain pulse starts to rise from the base potential (0 (V)) toward sustain pulse voltage Vs until the sustain pulse is clamped to the base potential again.

As a result of consideration, the inventor has verified that variations in discharge can be reduced by setting the overlapping period during which the rising edge of such a sustain pulse is overlapped with the falling edge of such a sustain pulse to 850 nsec. Next, this verification is detailed.

Figure 9:
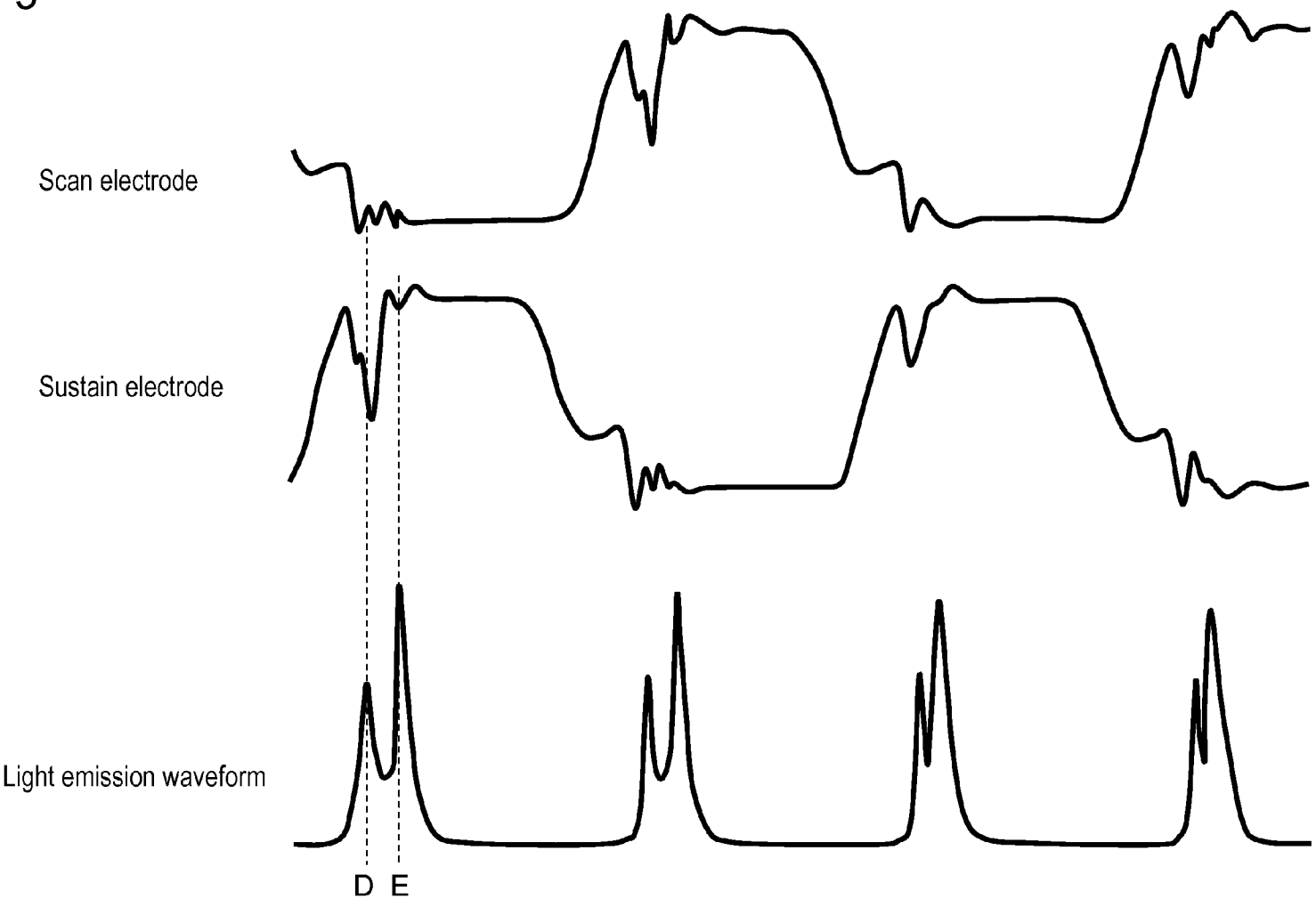
FIG. 9 is a schematic waveform chart showing an example of sustain pulses and a state of light emission in accordance with the exemplary embodiment.

FIG. 9 is a schematic waveform chart showing an example of sustain pulses and a state of light emission in accordance with the exemplary embodiment of the present invention. The waveforms of FIG. 9 are those showing an example of changes in voltage that are observed in scan electrode SCi and sustain electrode SUi in the sustain period of a subfield having a relatively high light-emitting rate when panel 10 is driven with sustain pulses shown in FIG. 8. These waveforms also show the intensity of light emission at that time.

As a result of detailed consideration, the inventor has verified the following facts. When the overlapping period is sufficiently long, a first discharge can be forced to occur, as shown by D in the drawing, at a time point when the power recovery circuit is switched to the clamp circuit and the sustain pulse voltage is clamped to the ground potential on the falling edge of the immediately preceding sustain pulse. By forcing this first discharge to occur, a second discharge is caused as shown by E in the drawing, subsequently at a time point when the power recovery circuit is switched to the clamp circuit and the sustain pulse voltage is clamped to voltage Vs on the rising edge of the sustain pulse. Further, these two discharges can be caused with suppressed variations.

As shown in FIG. 7, in a driving waveform with no overlapping period, a discharge may occur or may not occur while a sustain pulse is caused to rise by the power recovery circuit, depending on the state of wall charge. As a result, variations in discharge occur.

In contrast, in the driving waveform shown in FIG. 8, a first discharge (a discharge shown by D in the drawing) can be forced to occur irrespective of variations in wall charge. Thus, two consecutive discharges (discharges shown by D and E in the drawing) can be caused with discharge variations suppressed, and thus the luminance unevenness can be prevented.

It is also verified that simply setting an overlapping period does not necessarily cause the above two consecutive discharges with suppressed variations and a sufficiently long overlapping period is necessary.

On the other hand, variations in discharge and power consumption are correlated to the "rising period" of the sustain pulse. Depending on the length of the "rising period", variations in discharge and power consumption change. First, variations in discharge and the "rising period" are described.

Figure 10:
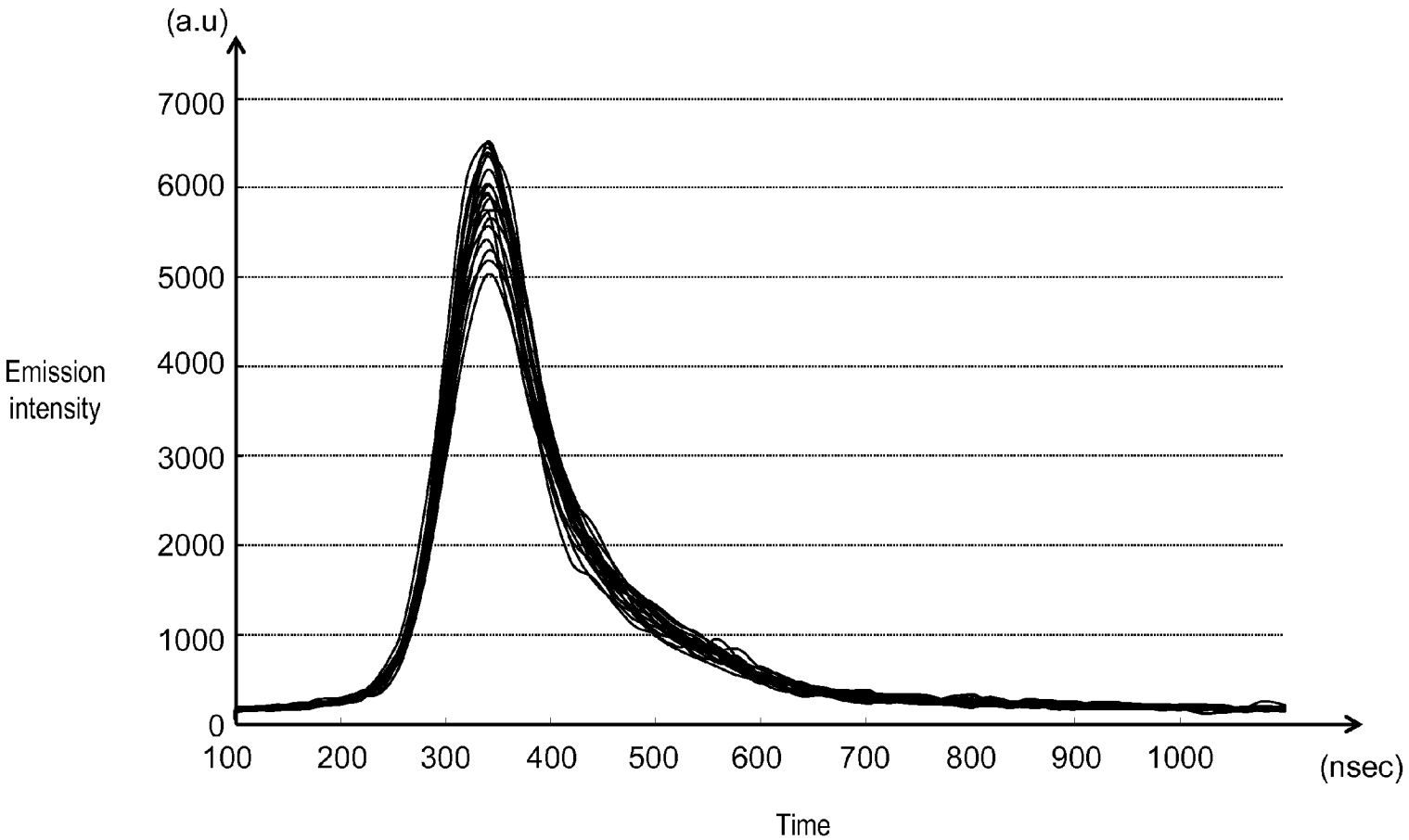
FIG. 10 is a characteristics chart showing the relation between a "rising period" of a sustain pulse and variations in discharge in accordance with the exemplary embodiment.
Figure 11:
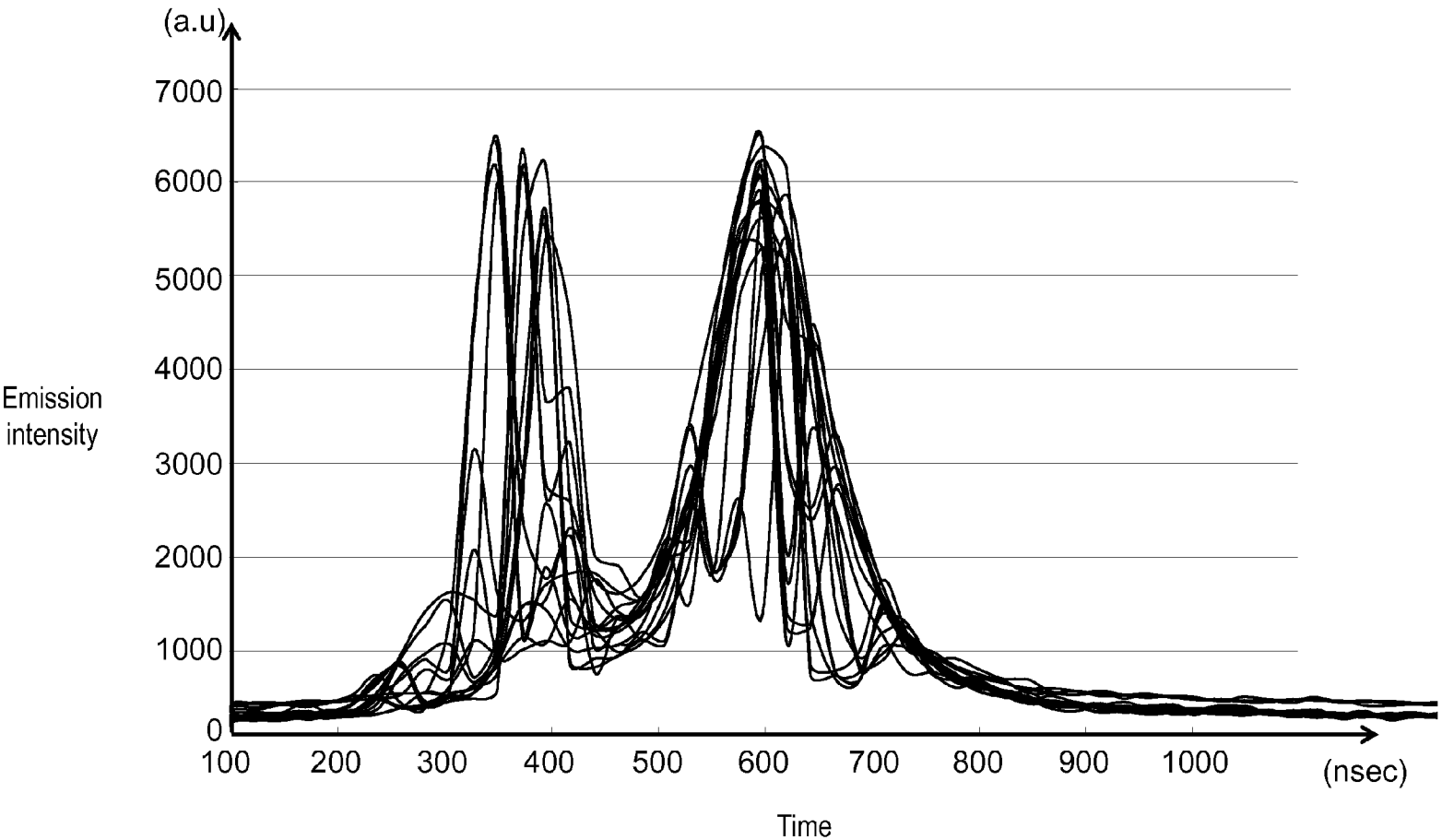
FIG. 11 is a characteristics chart showing the relation between a "rising period" of a sustain pulse and variations in discharge in accordance with the exemplary embodiment.
Figure 12:
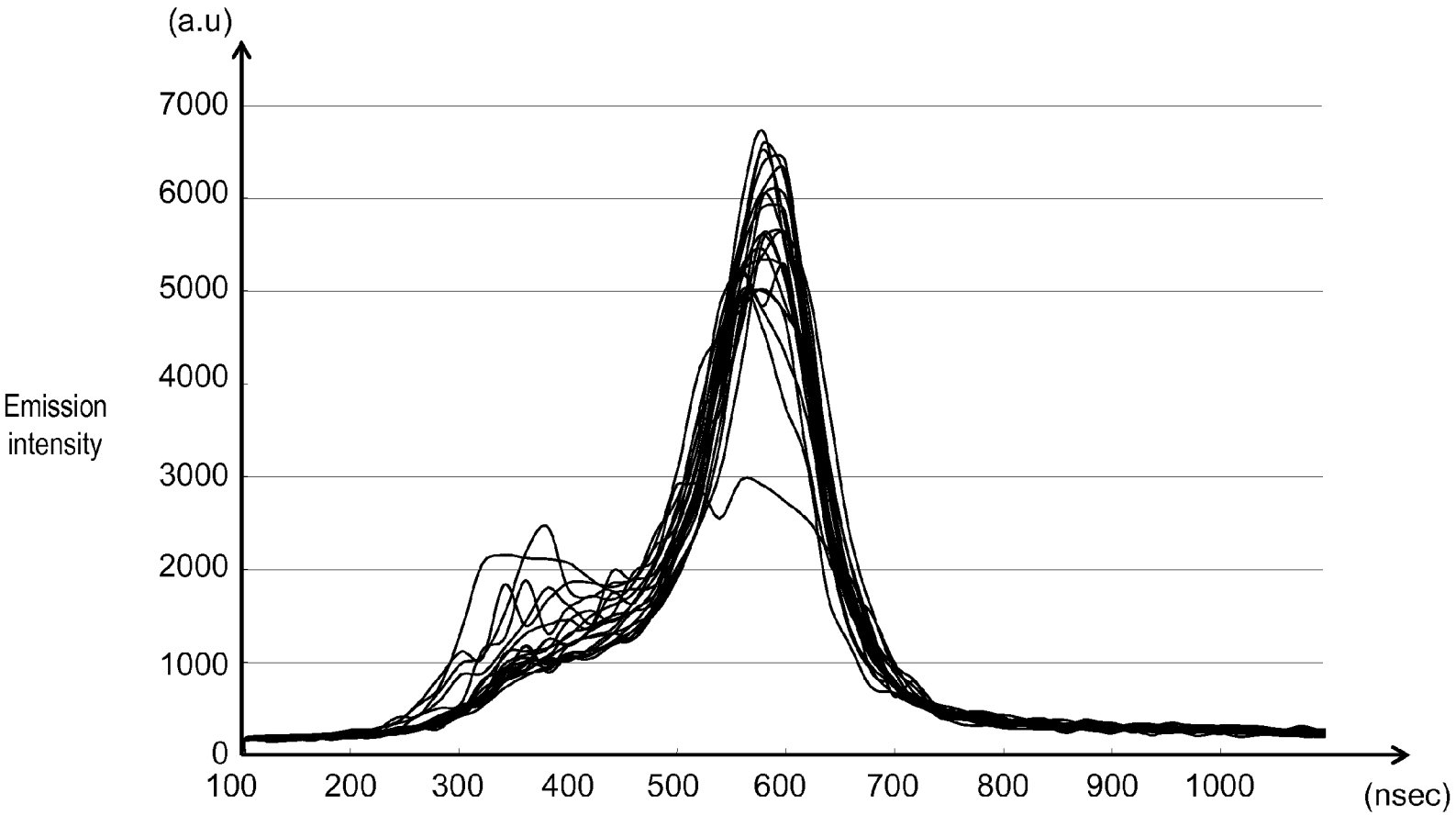
FIG. 12 is a characteristics chart showing the relation between a "rising period" of a sustain pulse and variations in discharge in accordance with the exemplary embodiment.

Each of FIG. 10, FIG. 11, and FIG. 12 is a characteristics chart showing the relation between a "rising period" of a sustain pulse and variations in discharge in accordance with the exemplary embodiment of the present invention. Herein, experiments are conducted under the following conditions: in each power recovery circuit, the resonance period is set to 1200 nsec, the pulse width is set to 2.7 μsec, the overlapping period is set to 0 nsec, the "falling period" is set to 900 nsec, and the "rising period" is changed to 400 nsec, 500 nsec, and 550 nsec. FIG. 10 is a chart showing a measurement result when the "rising period" is set to 400 nsec. FIG. 11 is a chart showing a measurement result when the "rising period" is set to 500 nsec. FIG. 12 is a chart showing a measurement result when the "rising period" is set to 550 nsec. In each of FIG. 10, FIG. 11, and FIG. 12, the measurement results in a plurality of discharge cells are superimposed in one graph.

In each of FIG. 10, FIG. 11, and FIG. 12, the vertical axis shows emission intensity; the horizontal axis shows a lapse of time since the start of the operation of the power recovery circuit. The unit (a. u.) in the vertical axis shows an arbitrary unit.

The following facts are verified. For example, as shown in FIG. 10, when the "rising period" is set to 400 nsec, which is relatively short, almost all the discharge cells emit light substantially at the same time and variations in discharge are suppressed. It is considered for the following reason: since the "rising period" is short, the first discharge described with reference to FIG. 7 occurs strongly in almost all the discharge cells.

As shown in FIG. 11, when the "rising period" is set to 500 nsec, which is 100 nsec longer than that of FIG. 10, the light emission time of the discharge cells varies, and thus variations in discharge increase. This is considered for the following reason: since the "rising period" is set improperly, the first discharge described with reference to FIG. 7 occurs strongly in some of the discharge cells and the second discharge occurs strongly in a similar manner in the other discharge cells.

As shown in FIG. 12, when the "rising period" is set to 550 nsec, which is sufficiently long, almost all of the discharge cells emit light substantially at the same time, later than the light emission timing of FIG. 10, and variations in discharge are suppressed. This is considered for the following reason: since the "rising period" is sufficiently long, the second discharge described with reference to FIG. 7 occurs strongly in almost all the discharge cells.

In this manner, variations in discharge can be reduced by setting the "rising period" in a sustain pulse to either of the following two lengths: the length with which the first discharge of FIG. 7 occurs strongly in almost all the discharge cells; and the length with which the second discharge occurs strongly in almost all the discharge cells in a similar manner.

Next, power consumption and the "rising period" are described. As the factors that exert influences on the power consumption, emission efficiency, emission luminance, reactive power, and sustain pulse voltage Vs necessary for stably causing a sustain discharge are considered. Herein, the relation between each factor and the "rising period" is described in this order.

Figure 13:
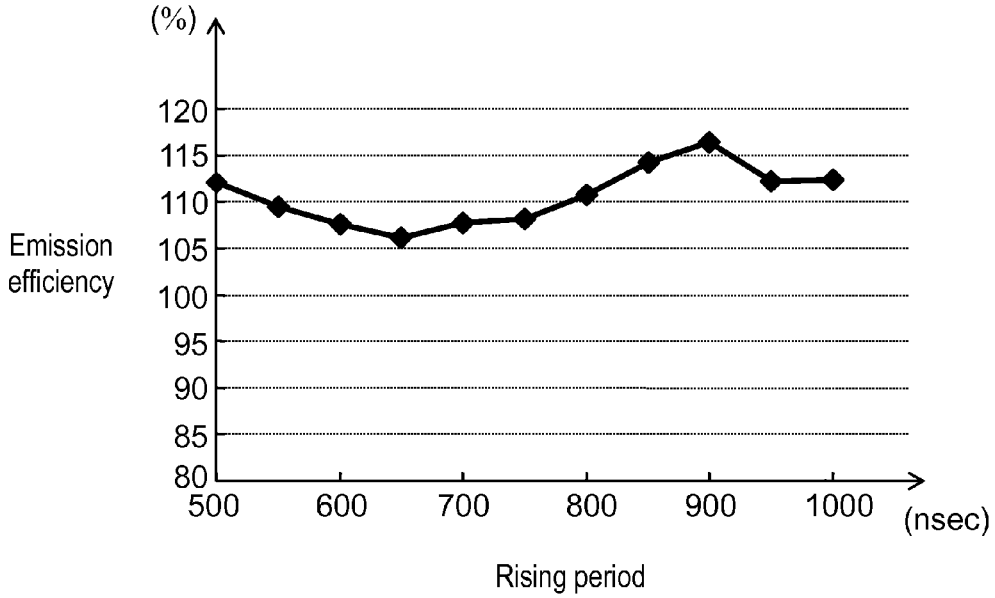
FIG. 13 is a characteristics chart showing the relation between a "rising period" of a sustain pulse and emission efficiency in accordance with the exemplary embodiment.

FIG. 13 is a characteristics chart showing the relation between a "rising period" of a sustain pulse and emission efficiency in accordance with the exemplary embodiment of the present invention. In FIG. 13, the vertical axis shows a relative rate of emission efficiency; the horizontal axis shows a length of the "rising period". As the unit (%) in the vertical axis, a relative rate of the detection result of emission efficiency (Im/W: emission luminance per unit power) is shown with respect to a predetermined value set to 100%. A larger numerical value shows higher emission efficiency. With reference to FIG. 13, and FIG. 14 through FIG. 16, experiments are conducted under the following conditions: in each power recovery circuit, the resonance period is set to 2000 nsec, the pulse width is set to 2.7 μsec, the overlapping period is set to 0 nsec, the "falling period" is set to 900 nsec, and the "rising period" is changed from 500 nsec to 1000 nsec in increments of 50 nsec.

As shown in FIG. 13, the emission efficiency changes with the length of the "rising period". More specifically, as shown in FIG. 13, as the "rising period" increases, the emission efficiency gradually decreases, thereafter increases, and decreases again. This result shows that there are two points (approximately 500 nsec and approximately 900 nsec, in FIG. 13) at which emission efficiency can be improved. This is considered for the following reason: by gradually increasing the "rising period", a state where one discharge occurs stably in a sustain pulse (a first emission efficiency improving point) is changed to a state where the first discharge and the two consecutive discharges repeatedly occur, and thereafter to a state where the two consecutive discharges stably occur (a second emission efficiency improving point).

Figure 14:
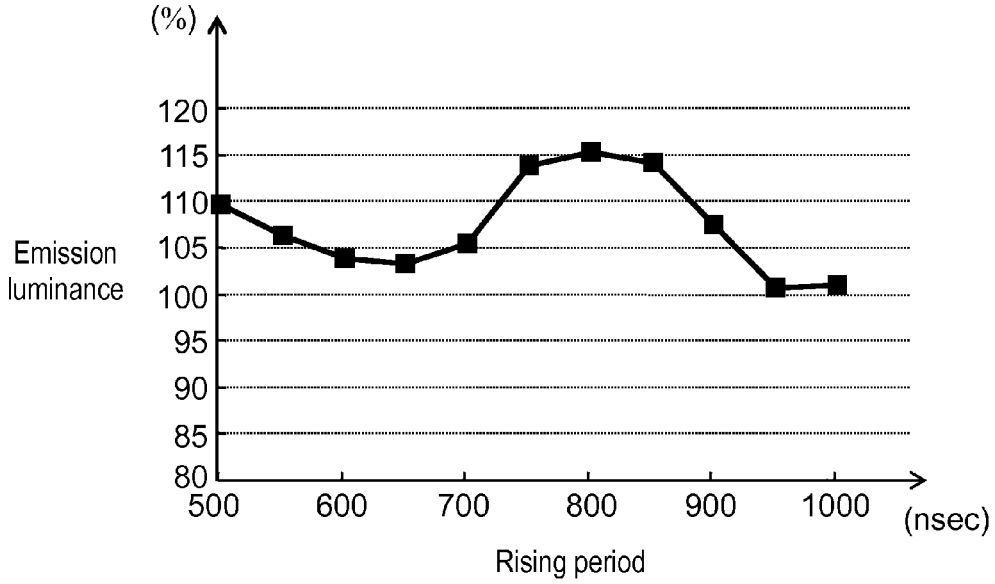
FIG. 14 is a characteristics chart showing the relation between the "rising period" of the sustain pulse and emission luminance in accordance with the exemplary embodiment.

FIG. 14 is a characteristics chart showing the relation between the "rising period" of the sustain pulse and emission luminance in accordance with the exemplary embodiment of the present invention. In FIG. 14, the vertical axis shows a relative rate of emission luminance; the horizontal axis shows the length of the "rising period". As the unit (%) in the vertical axis, a relative rate of the detection result of emission luminance (lm) is shown with respect to a predetermined value set to 100%. A larger numerical value shows higher emission luminance.

As shown in FIG. 14, the emission luminance changes with the length of the "rising period". More specifically, similarly to FIG. 13, as the "rising period" increases, the emission luminance gradually decreases, thereafter increases, and decreases again. This result shows that there are two points (approximately 500 nsec and approximately 800 nsec, in FIG. 14) at which emission luminance can be improved, similarly to FIG. 13. This is considered for the following reason, similarly to FIG. 13: by gradually increasing the "rising period", a state where one discharge occurs stably in a sustain pulse (a first emission luminance improving point) is changed to a state where the first discharge and the two consecutive discharges repeatedly occur, and thereafter to a state where the two consecutive discharges stably occur (a second emission luminance improving point). The second improving point in FIG. 13 is approximately 100 nsec different from that in FIG. 14. This is considered for the following reason: the "rising period" for achieving the highest emission efficiency is different from the "rising period" for achieving the highest emission luminance, and this difference is related to which of the first discharge and the second discharge in the two consecutive discharges is caused more strongly.

Figure 15:
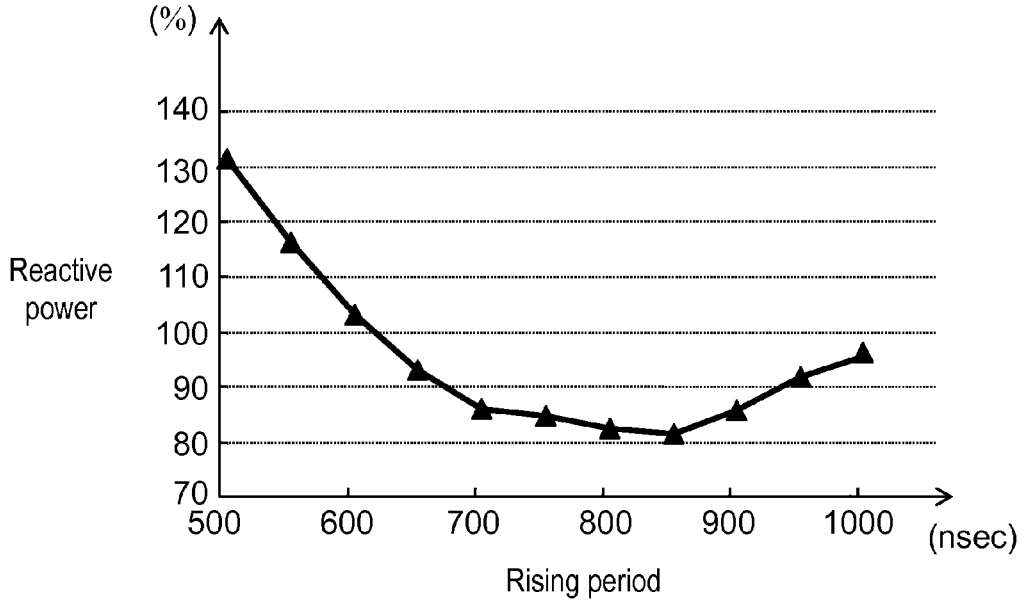
FIG. 15 is a characteristics chart showing the relation between the "rising period" of the sustain pulse and reactive power in accordance with the exemplary embodiment.

FIG. 15 is a characteristics chart showing the relation between the "rising period" of the sustain pulse and reactive power in accordance with the exemplary embodiment of the present invention. In FIG. 15, the vertical axis shows a relative rate of reactive power; the horizontal axis shows the length of the "rising period". As the unit (%) in the vertical axis, a relative rate of the detection result of reactive power (W) is shown with respect to a predetermined value set to 100%. A larger numerical value shows higher reactive power.

As shown in FIG. 15, the reactive power changes with the length of the "rising period". More specifically, as the "rising period" decreases, the reactive power increases. This is considered because the power recovered to the power recovery circuit is used for a discharge at a lower rate in a shorter "rising period".

Figure 16:
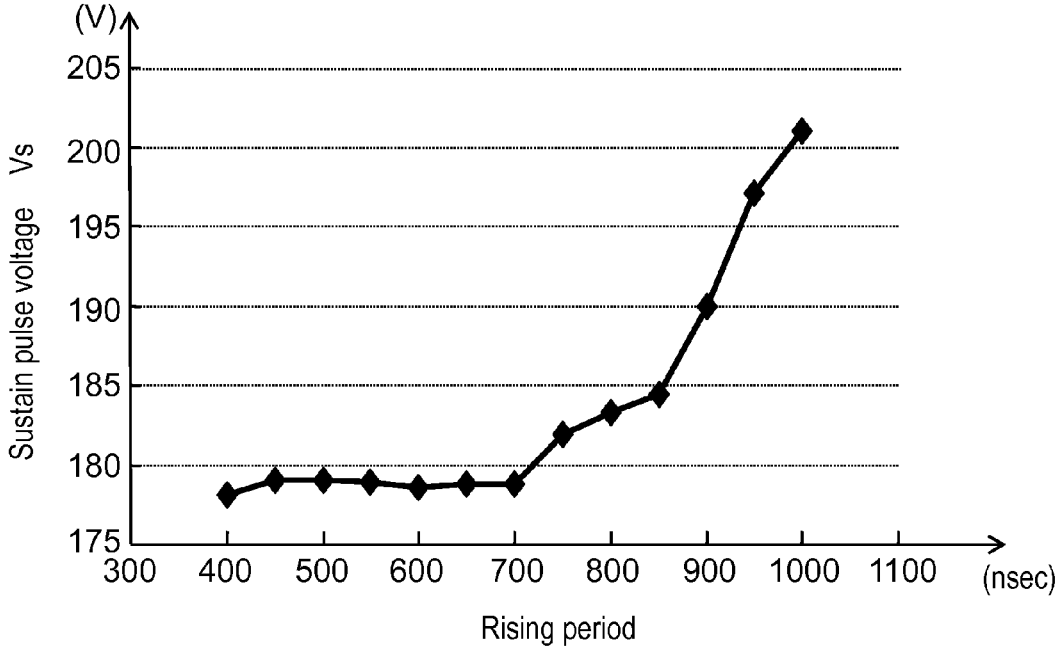
FIG. 16 is a characteristics chart showing the relation between the "rising period" of the sustain pulse and sustain pulse voltage Vs in accordance with the exemplary embodiment.

FIG. 16 is a characteristics chart showing the relation between the "rising period" of the sustain pulse and sustain pulse voltage Vs in accordance with the exemplary embodiment of the present invention. In FIG. 16, the vertical axis shows sustain pulse voltage Vs necessary for causing a stable sustain discharge; the horizontal axis shows the length of the "rising period".

As shown in FIG. 16, according to the length of the "rising period", the value of sustain pulse voltage Vs necessary for causing a stable sustain discharge changes. More specifically, as the "rising period" increases, necessary sustain pulse voltage Vs increases. This is considered for the following reason: in a longer "rising period", a strong discharge like a sustain discharge cannot be caused by the clamp circuit, and thus the wall charge accumulated in the discharge cells reduces.

According to the above results, the following facts are verified. Appropriately controlling the "rising period" can improve the factors that exert influences on power consumption, i.e. emission efficiency, emission luminance, reactive power, and sustain pulse voltage Vs for stably causing a sustain discharge. The values of the "rising period" for maximizing the improving effects are not necessarily equal in the respective factors, and the "rising period" may be set according to the focused factor.

The relation between the above each effect and the length of the "rising period" changes with the resonance period. Thus, preferably, the length of the "rising period" is set optimally for the resonance period.

Next, an all-cell light-emitting rate and a partial light-emitting rate are described. As described above, generating an "overlapping period" or setting the length of the "rising period" optimally for the characteristics of panel 10, for example, can provide advantages of reducing variations in discharge and reducing power consumption. However, these ranges considered optimum also change with the light-emitting rate of the discharge cells. This is because the output impedance of the power recovery circuit is larger than the output impedance of the clamp circuit, and thus a change in the rate of the discharge cells to be lit (hereinafter also referred to as "lit cells") changes the waveform shape in the "rising period".

Therefore, it is considered that each setting can be optimized by detecting a light-emitting rate and making control according to the detection result. In this exemplary embodiment, an all-cell light-emitting rate showing a rate of lit cells with respect to all the discharge cells on the image display surface of panel 10 is detected and used for each control. However, even at an equal all-cell light-emitting rate, the number of lit cells on one display electrode pair 24 and thus the drive load considerably change, depending on display image patterns, i.e. the distributions of lit cells.

Figure 17:
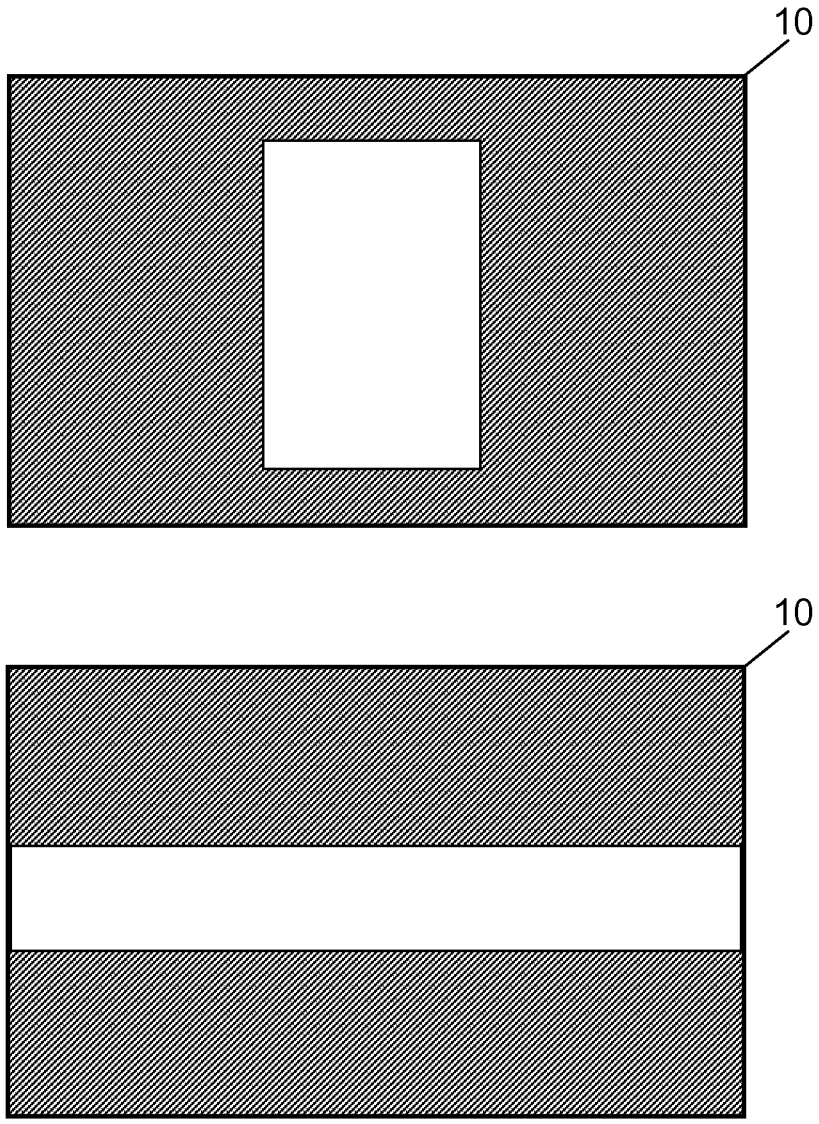
FIG. 17 is a schematic diagram for explaining patterns having an equal all-cell light-emitting rate and different distributions of lit cells.

FIG. 17 is a schematic diagram for explaining patterns having an equal all-cell light-emitting rate and different distributions of lit cells. In FIG. 17, display electrode pairs 24 are arranged so as to extend in the horizontal direction of the drawing, similar to those of FIG. 2. In FIG. 17, the diagonally shaded portions show the distributions of unlit cells where no sustain discharge is caused. The outline portions not diagonally shaded show the distributions of lit cells.

For example, when the lit cells are distributed in a shape extending in the vertical direction (of the drawing) as shown in the top diagram of FIG. 17, the number of lit cells on one display electrode pair 24 is relatively small, and thus the drive load on one display electrode pair 24 is small. In contrast, when the lit cells are distributed in a shape extending in the horizontal direction (of the drawing) as shown in the bottom diagram of FIG. 17, even at the equal all-cell light-emitting rate, the number of lit cells on one display electrode pair 24 is large and thus the drive load of one display electrode pair 24 is large.

In this manner, even at an equal all-cell light-emitting rate, a partial difference in the drive load occurs depending on the patterns, and some of display electrode pairs 24 partially have a large drive load in some patterns.

Thus, in this exemplary embodiment, in addition to the all-cell light-emitting rate, the display area of panel 10 is divided into a plurality of regions and the light-emitting rate in each region is detected as a partial light-emitting rate.

Figure 18:
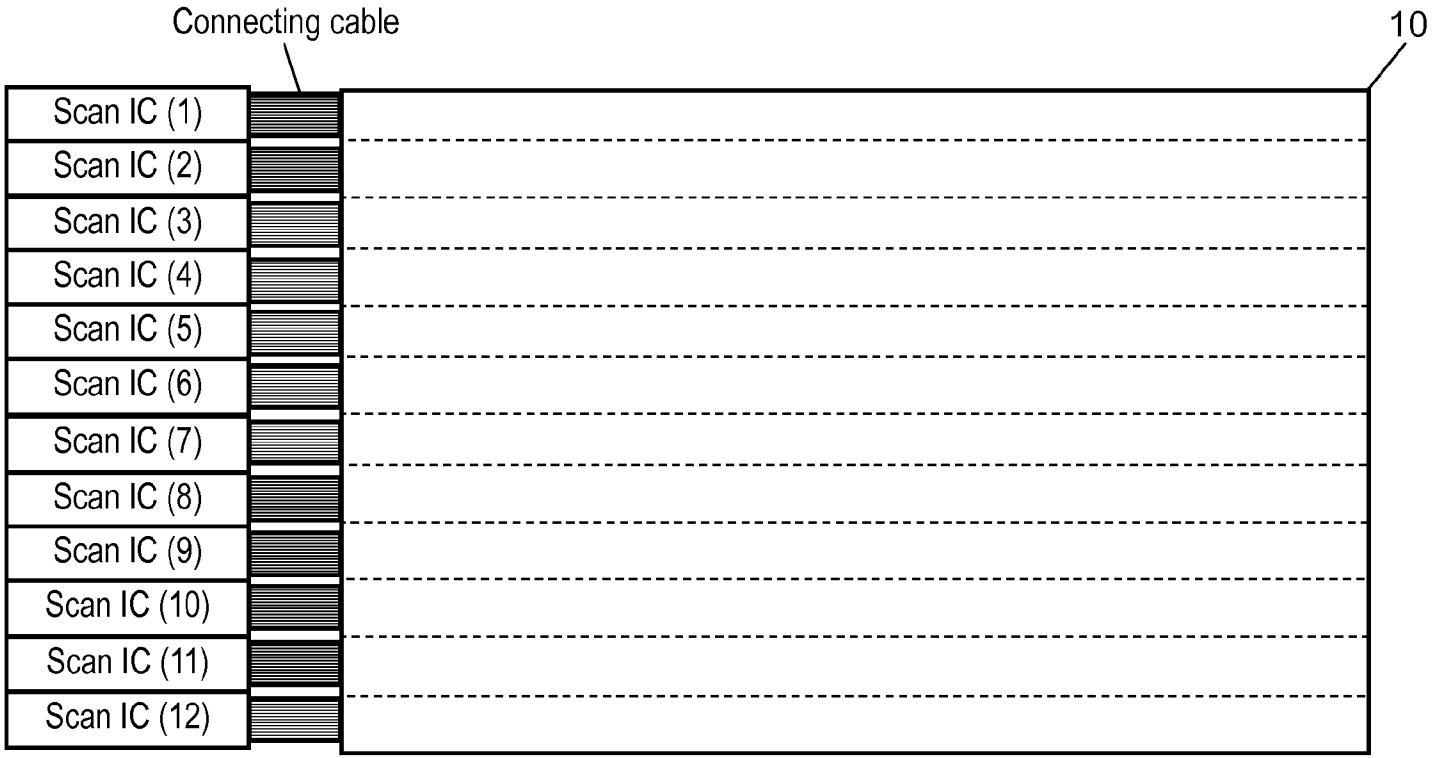
FIG. 18 is a schematic diagram showing an example of regions where partial light-emitting rates are to be detected in accordance with the exemplary embodiment.

FIG. 18 is a schematic diagram showing an example of regions where partial light-emitting rates are to be detected in accordance with the exemplary embodiment of the present invention. FIG. 18 shows panel 10, scan ICs (e.g. scan IC (1) through scan IC (12)), and connecting cables for connecting the interconnect lines (not shown) of scan electrodes 22 and the output terminals of the scan ICs. The drawing schematically shows how panel 10 and the scan ICs are connected via connecting cables. The broken lines are shown in panel 10 for the convenience and facilitating understanding of the regions where partial light-emitting rates are to be detected. Actually, these broken lines are not formed in panel 10. In this exemplary embodiment, the area surrounded by the broken lines is set as one region, and a partial light-emitting rate is detected in each region. Display electrode pairs 24 are arranged so as to extend in the horizontal direction of the drawing, similar to those of FIG. 2.

In this exemplary embodiment, as shown in FIG. 18, the display area of panel 10 is divided into a plurality of regions with respect to the scan ICs. That is, partial light-emitting rate detecting circuit 47 sets the area that is formed of a plurality of scan electrodes 22 connected to one scan IC, as one region, and detects partial light-emitting rates. For example, the number of scan electrodes 22 connected to one scan IC is 90, and scan electrode driving circuit 43 has 12 scan ICs (scan IC (1) through scan IC (12)). In this case, as shown in FIG. 18, partial light-emitting rate detecting circuit 47 sets 90 scan electrodes 22 connected to each of scan IC (1) through scan IC (12) as one region, divides the display area of panel 10 into 12 regions, and detects a partial light-emitting rate for each region. Maximum value detecting circuit 48 compares the values of the partial light-emitting rates detected in partial light-emitting rate detecting circuit 47, and detects the partial light-emitting rate having the largest value.

In this exemplary embodiment, a plurality of sustain pulses where the lengths of at least one of the "rising period" and the "falling period" are different is generated, and a plurality of driving patterns (herein, five driving patterns of a first driving pattern, a second driving pattern, a third driving pattern, a fourth driving pattern, and a fifth driving pattern) where the sustain pulses are generated in different combinations with different lengths of the "overlapping period" is set. Then, the sustain pulses are generated such that the driving patterns are switched in each subfield, according to the maximum partial light-emitting rate and all-cell light-emitting rate detected.

It is verified that when a strong discharge is caused on the rising edge of a sustain pulse, a weak discharge can occur on the falling edge of the sustain pulse. This weak discharge reduces the wall charge formed by the sustain discharge. Thus, when this discharge occurs on the falling edge, the insufficient wall charge can make the subsequent sustain discharge unstable, which is not preferable. It is experimentally verified that decreasing the time taken for falling can reduce the weak discharge on the falling edge. On the other hand, the intensity of the discharge occurring on the rising edge of the sustain pulse changes with the drive load of panel 10 and the waveform shape of the sustain pulse on the riding edge. Thus, in this exemplary embodiment, the "falling period" is set in consideration of the all-cell light-emitting rate and maximum partial light-emitting rate detected, and the "rising period" of the sustain pulse to be generated, for example.

Figure 19:
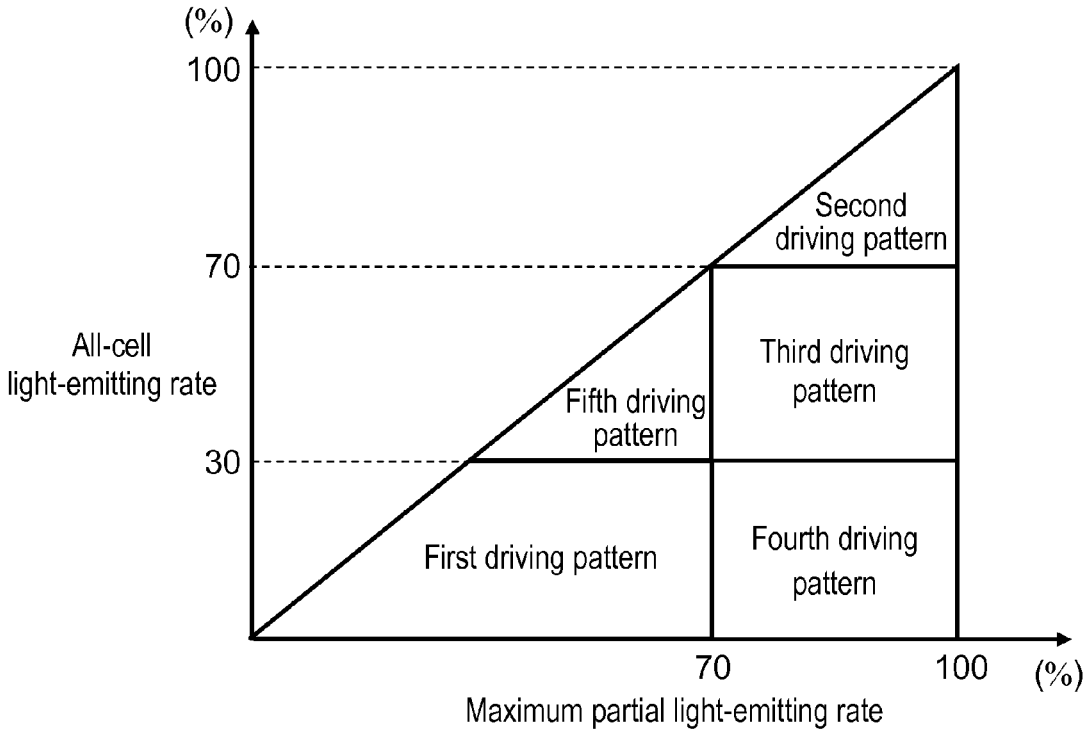
FIG. 19 is a chart showing an example of the relation between all-cell light-emitting rates and maximum partial light-emitting rates, and switching of driving patterns in accordance with the exemplary embodiment.

FIG. 19 is a chart showing an example of the relation between all-cell light-emitting rates and maximum partial light-emitting rates, and switching of driving patterns in accordance with the exemplary embodiment of the present invention.

In this exemplary embodiment, as shown in FIG. 19, in a subfield where the maximum partial light-emitting rate is not high (e.g. lower than 70%) and the all-cell light-emitting rate is low (e.g. lower than 30%), sustain pulses are generated in the first driving pattern. The first driving pattern is a driving pattern intended to enhance emission luminance. With this driving pattern, when the all-cell light-emitting rate is low and the maximum partial light-emitting rate is not high, i.e. when the drive load of panel 10 is overall low, emission luminance is enhanced so as to enhance the image display quality.

In a subfield where the maximum partial light-emitting rate is high (e.g. 70% or higher) and the all-cell light-emitting rate is high (e.g. 70% or higher), sustain pulses are generated in the second driving pattern. The second driving pattern is a driving pattern intended to reduce reactive power and improve emission efficiency. With this driving pattern, when the all-cell light-emitting rate is high and the maximum partial light-emitting rate is high, i.e. when the drive load of panel 10 is overall high, reactive power is reduced and emission efficiency is improved so as to reduce power consumption.

In a subfield where the maximum partial light-emitting rate is high (e.g. 70% or higher) and the all-cell light-emitting rate is within a predetermined range (e.g. 30% or higher and lower than 70%), sustain pulses are generated in the third driving pattern. The third driving pattern is a driving pattern intended to enhance emission luminance, reduce reactive power, and improve emission efficiency. With this driving pattern, when the all-cell light-emitting rate is slightly high and the maximum partial light-emitting rate is high, i.e. the drive load of panel 10 is partially high, emission luminance is enhanced so as to enhance the image display quality, and reactive power is reduced and emission efficiency is improved so as to reduce power consumption.

In a subfield where the maximum partial light-emitting rate is high (e.g. 70% or higher) and the all-cell light-emitting rate is low (e.g. lower than 30%), sustain pulses are generated in the fourth driving pattern. The fourth driving pattern is a driving pattern intended to maximize the reduction in reactive power and improvement in emission efficiency. With this driving pattern, when an image having a low all-cell light-emitting rate and a high maximum partial light-emitting rate, which is considered to be relatively frequently seen in general dynamic images, is displayed, reduction in power consumption caused by reduction in reactive power and improvement in emission efficiency is enhanced.

In a subfield where the maximum partial light-emitting rate is not high (e.g. lower than 70%) and the all-cell light-emitting rate is within a predetermined range (e.g. 30% or higher and lower than 70%), sustain pulses are generated in the fifth driving pattern. The fifth driving pattern is a driving pattern intended to enhance the reduction in reactive power and the improvement in emission efficiency. With this driving pattern, when the all-cell light-emitting rate is slightly high and the maximum partial light-emitting rate is not high, i.e. when a region in panel 10 having a high drive load is distributed in a more balanced manner than that of the case to which the third driving pattern is applied, and the overall drive load is slightly high, reactive power is reduced and emission efficiency is improved so as to reduce power consumption.

Figure 20:
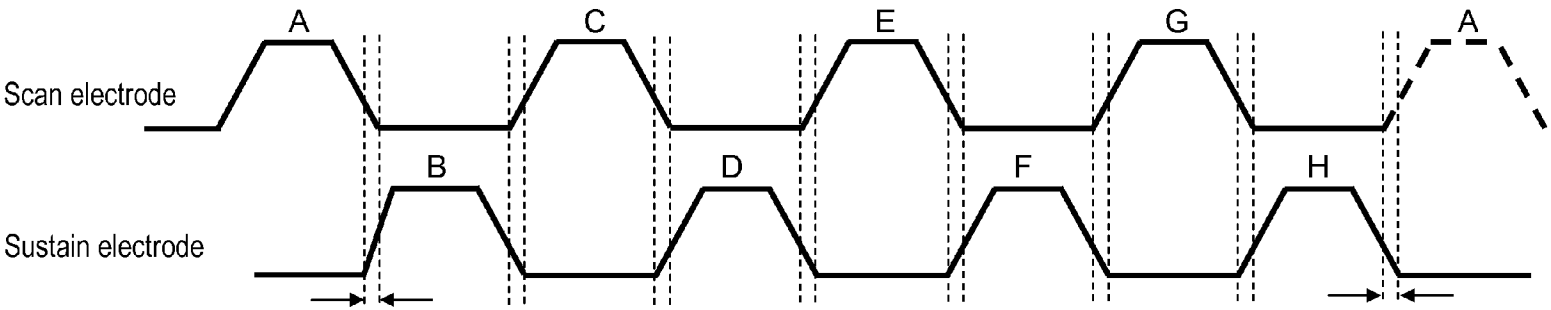
FIG. 20 is a schematic waveform chart of sustain pulses generated in a first driving pattern in accordance with the exemplary embodiment.
Figure 21:
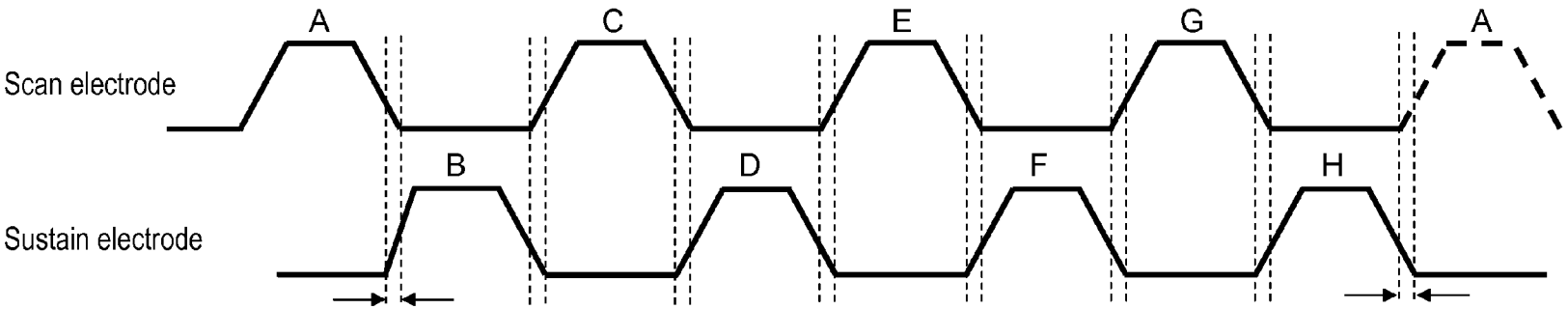
FIG. 21 is a schematic waveform chart of sustain pulses generated in a second driving pattern in accordance with the exemplary embodiment.
Figure 22:
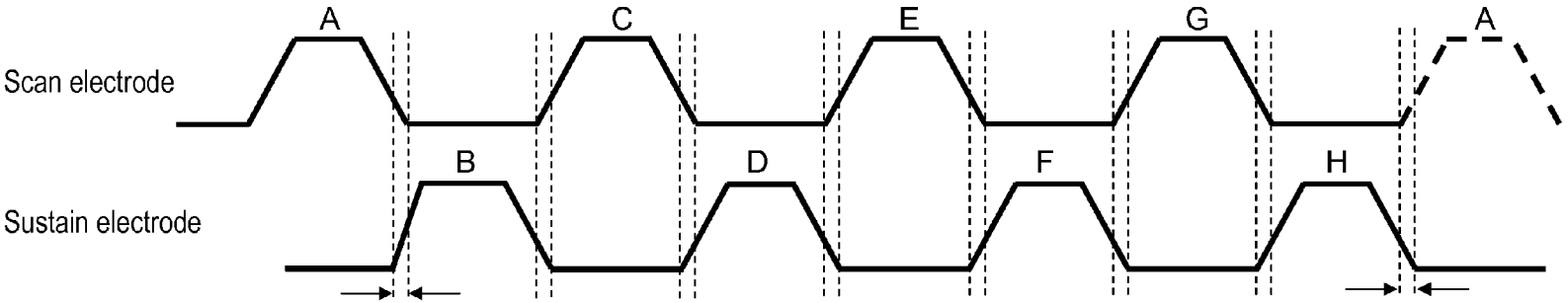
FIG. 22 is a schematic waveform chart of sustain pulses generated in a third driving pattern in accordance with the exemplary embodiment.
Figure 23:
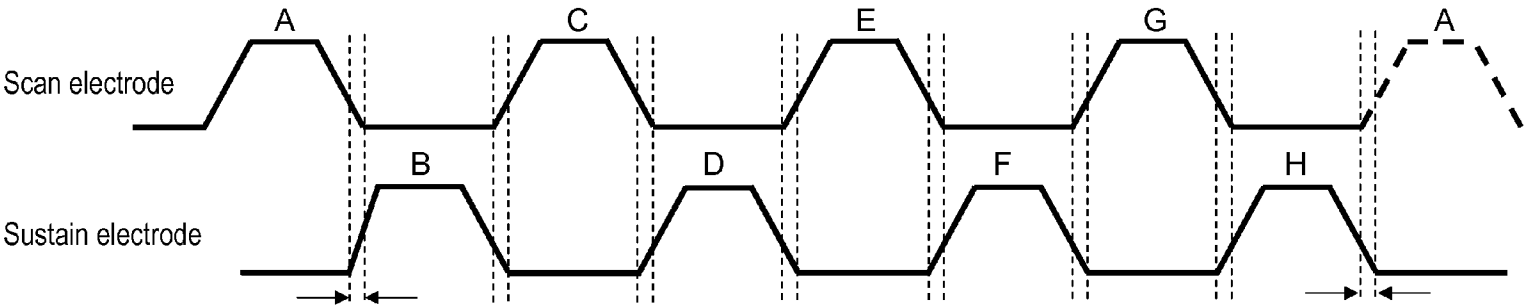
FIG. 23 is a schematic waveform chart of sustain pulses generated in a fourth driving pattern in accordance with the exemplary embodiment.
Figure 24:
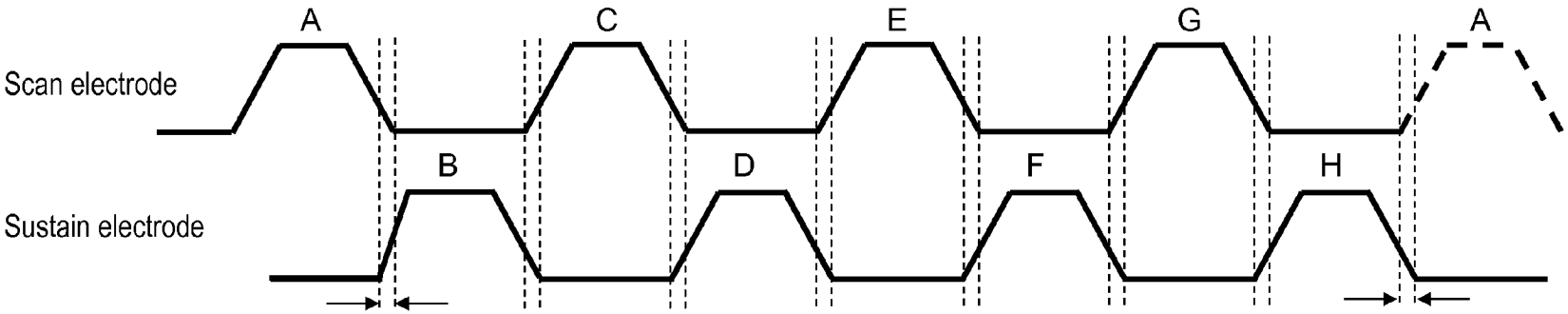
FIG. 24 is a schematic waveform chart of sustain pulses generated in a fifth driving pattern in accordance with the exemplary embodiment.

Next, each driving pattern is detailed with reference to FIG. 20 through FIG. 24. FIG. 20 is a schematic waveform chart of sustain pulses generated in the first driving pattern in accordance with the exemplary embodiment of the present invention. FIG. 21 is a schematic waveform chart of sustain pulses generated in the second driving pattern in accordance with the exemplary embodiment. FIG. 22 is a schematic waveform chart of sustain pulses generated in the third driving pattern in accordance with the exemplary embodiment. FIG. 23 is a schematic waveform chart of sustain pulses generated in the fourth driving pattern in accordance with the exemplary embodiment. FIG. 24 is a schematic waveform chart of sustain pulses generated in the fifth driving pattern in accordance with the exemplary embodiment. In each of FIG. 20, FIG. 21, FIG. 22, FIG. 23, and FIG. 24, the top chart shows schematic waveform shapes of sustain pulses generated, and the bottom chart in the drawing shows the lengths of the "rising period", "falling period", and "overlapping period". In each of FIG. 20, FIG. 21, FIG. 22, FIG. 23, and FIG. 24, the pulse width of each sustain pulse is 2.7 μsec.

In this exemplary embodiment, as shown in each of FIG. 20, FIG. 21, FIG. 22, FIG. 23, and FIG. 24, a pattern formed of eight sustain pulses is repeatedly generated. In all the driving patterns, the resonance period of each power recovery circuit is set to 2000 nsec.

In this exemplary embodiment, sustain pulses are generated in the following manner. In the first driving pattern, as shown in FIG. 20, the first sustain pulse (A in the drawing) has a "rising period" of 800 nsec, and a "falling period" of 550 nsec. The second sustain pulse (B in the drawing) has a "rising period" of 400 nsec, and a "falling period" of 500 nsec. Each of the third sustain pulse (C in the drawing) through the eighth sustain pulse (H in the drawing) has a "rising period" of 800 nsec, and a "falling period" of 550 nsec. The "overlapping period" is set to 150 nsec.

In the second driving pattern, as shown in FIG. 21, the first sustain pulse (A in the drawing) has a "rising period" of 650 nsec, and a "falling period" of 1000 nsec. The second sustain pulse (B in the drawing) has a "rising period" of 450 nsec, and a "falling period" of 850 nsec. Each of the third sustain pulse (C in the drawing) through the eighth sustain pulse (H in the drawing) has a "rising period" of 650 nsec, and a "falling period" of 1000 nsec. The "overlapping period" is set to 150 nsec.

In the third driving pattern, as shown in FIG. 22, the first sustain pulse (A in the drawing) has a "rising period" of 700 nsec, and a "falling period" of 900 nsec. The second sustain pulse (B in the drawing) has a "rising period" of 450 nsec, and a "falling period" of 800 nsec. Each of the third sustain pulse (C in the drawing), the fifth sustain pulse (E in the drawing), and the seventh sustain pulse (G in the drawing) has a "rising period" of 700 nsec, and a "falling period" of 900 nsec. Each of the fourth sustain pulse (D in the drawing), the sixth sustain pulse (F in the drawing), and the eighth sustain pulse (H in the drawing) has a "rising period" of 750 nsec, and a "falling period" of 900 nsec. The "overlapping period" is set to 200 nsec.

In the fourth driving pattern, as shown in FIG. 23, the first sustain pulse (A in the drawing) has a "rising period" of 750 nsec, and a "falling period" of 900 nsec. The second sustain pulse (B in the drawing) has a "rising period" of 450 nsec, and a "falling period" of 800 nsec. Each of the third sustain pulse (C in the drawing) through the eighth sustain pulse (H in the drawing) has a "rising period" of 750 nsec, and a "falling period" of 900 nsec. The "overlapping period" is set to 150 nsec.

In the fifth driving pattern, as shown in FIG. 24, the first sustain pulse (A in the drawing) has a "rising period" of 750 nsec, and a "falling period" of 900 nsec. The second sustain pulse (B in the drawing) has a "rising period" of 450 nsec, and a "falling period" of 800 nsec. Each of the third sustain pulse (C in the drawing), the fifth sustain pulse (E in the drawing), and the seventh sustain pulse (G in the drawing) has a "rising period" of 750 nsec, and a "falling period" of 900 nsec. Each of the fourth sustain pulse (D in the drawing), the sixth sustain pulse (F in the drawing), and the eighth sustain pulse (H in the drawing) has a "rising period" of 650 nsec, and a "falling period" of 900 nsec. The "overlapping period" is set to 150 nsec.

Panel 10 is driven by switching these five driving patterns according to the all-cell light-emitting rate and the maximum partial light-emitting rate. It is verified that this driving method can reduce the power consumption by approximately 10 to 30 W on average when a general dynamic image is displayed, although this effect depends on the pattern of the display image. It is also verified that the effect of reducing discharge variations enhances the image display quality.

In this exemplary embodiment, a description is provided for a structure where a pattern formed of eight sustain pulses is repeatedly generated. However, in a sustain period where the total number of sustain pulses is smaller than eight, all the sustain pulses may have an identical waveform shape. Alternatively, the sustain pulses may be set optionally according to the specifications of plasma display device 1, for example.

The structure of each driving pattern is only an example, and may be set optimally as required. The present invention is not limited to the example where one pattern is formed of eight sustain pulses. One pattern may be formed of a larger number or a smaller number of sustain pulses. Further, the resonance period is not limited to the above numerical value. Preferably, these structures are set optimally for the characteristics of panel 10, the specifications of plasma display device 1, or the like.

Figure 25A:
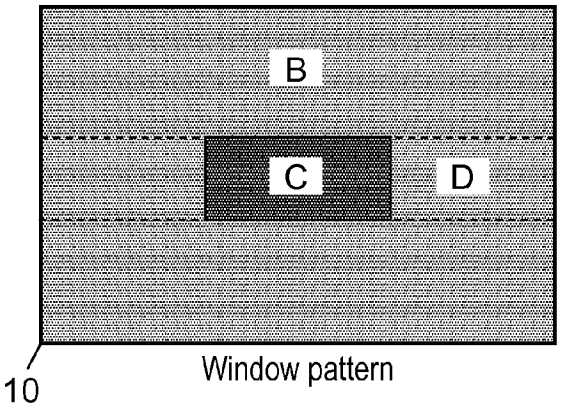
FIG. 25A is a schematic diagram for explaining a difference in emission luminance caused by a change in drive load.
Figure 25B:
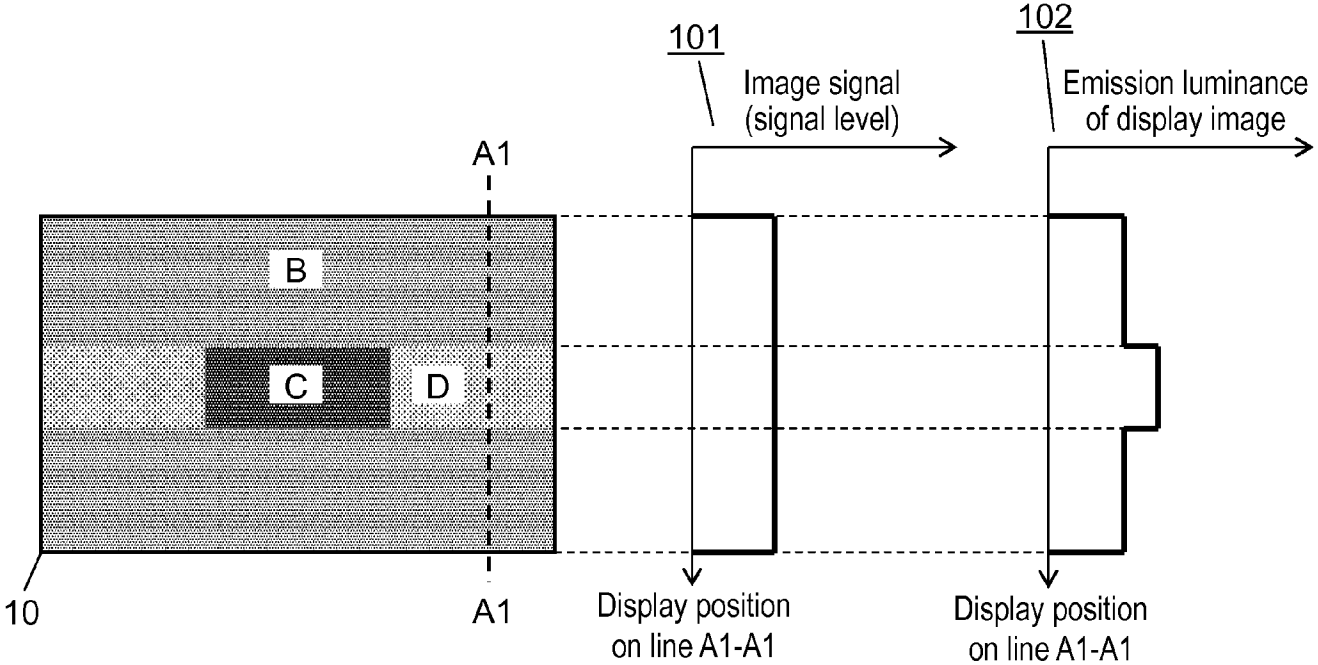
FIG. 25B is a schematic diagram for explaining the difference in emission luminance caused by the change in drive load.

Next, a description is provided for a difference in emission luminance caused by a change in drive load. FIG. 25A and FIG. 25B are schematic diagrams for explaining a difference in emission luminance caused by a change in drive load. FIG. 25A shows an ideal display image when an image generally called "window pattern" is displayed on panel 10. Region B and region D shown in the drawings are at an equal signal level (e.g. 20%), and region C is at a signal level (e.g. 5%) lower than that of region B and region D. The "signal level" in this exemplary embodiment may be the gradation value of a luminance signal, or may be the gradation value of an R signal, the gradation value of a B signal, or the gradation value of a G signal.

FIG. 25B includes a diagram schematically showing a display image when the "window pattern" of FIG. 25A is shown on panel 10, and diagrams showing signal level 101 and emission luminance 102. In panel 10 of FIG. 25B, display electrode pairs 24 are arranged so as to extend in the row direction (the transverse direction in the drawing), similar to those of panel 10 shown in FIG. 2. Signal level 101 of FIG. 25B shows a signal level of an image signal on line A1-A1 shown in panel 10 of FIG. 25B. The horizontal axis shows the magnitude of the signal level of the image signal; the vertical axis shows the display position on line A1-A1 in panel 10. Emission luminance 102 of FIG. 25B shows an emission luminance of a display image on line A1-A1 shown in panel 10 of FIG. 25B. The horizontal axis shows the magnitude of the emission luminance of the display image; the vertical axis shows the display position on line A1-A1 in panel 10.

As shown in FIG. 25B, when the "window pattern" is displayed on panel 10, region B and region D may have different emission luminances as shown in emission luminance 102 even though region B and region D are at an equal signal level as shown in signal level 101. This is considered for the following reason.

Display electrode pairs 24 are arranged so as to extend in the row direction (the transverse direction in the drawing). Thus, when the "window pattern" is displayed on panel 10 as shown in panel 10 of FIG. 25B, some of display electrode pairs 24 pass only through region B and some of display electrode pairs 24 pass through both region C and region D. The drive load of display electrode pairs 24 passing through region C and region D is smaller than the drive load of display electrode pairs 24 passing through region B. This is because a lower signal level of region C makes the discharge current that flows through display electrode pairs 24 passing through region C and region D smaller than the discharge current that flows through display electrode pairs 24 passing through region B.

Therefore, in display electrode pairs 24 passing through region C and region D, a voltage drop in drive voltage, e.g. a voltage drop in sustain pulses, is smaller than that in display electrode pairs 24 passing through region B. That is, the following phenomenon is considered to occur. The voltage drop in sustain pulses in display electrode pairs 24 passing through region C and region D is smaller than that in display electrode pairs 24 passing through region B, and thus the discharge intensity of the sustain discharge in the discharge cells in region D is higher than that of the sustain discharge in the discharge cells in region B. As a result, region D has an emission luminance higher than that of region B, even through both regions are at an equal signal level. Hereinafter, such a phenomenon is referred to as "loading phenomenon".

Figure 26A:
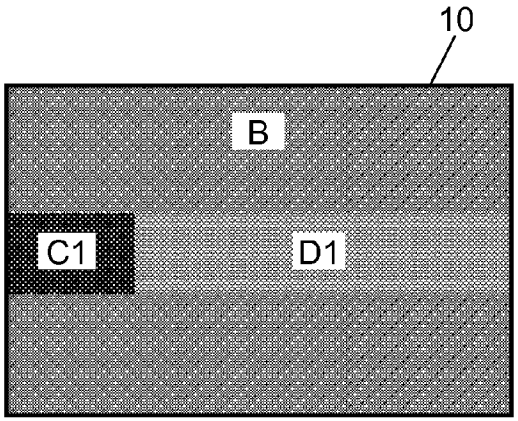
FIG. 26A is a diagram for schematically explaining a loading phenomenon.
Figure 26B:
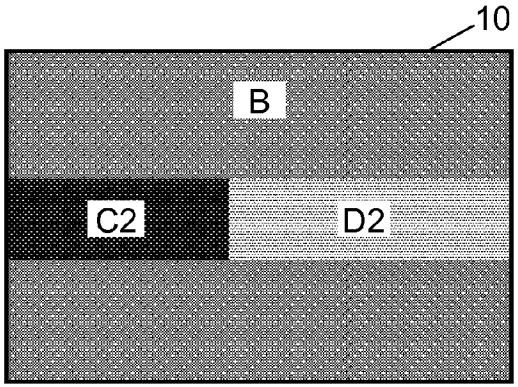
FIG. 26B is a diagram for schematically explaining a loading phenomenon.
Figure 26C:
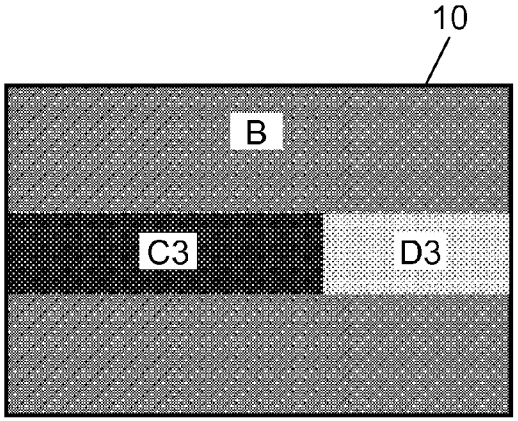
FIG. 26C is a diagram for schematically explaining a loading phenomenon.
Figure 26D:
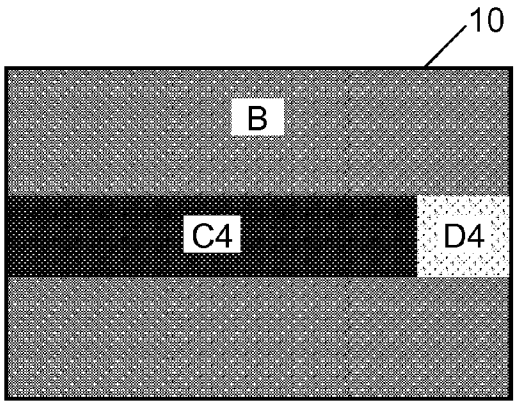
FIG. 26D is a diagram for schematically explaining a loading phenomenon.

FIG. 26A, FIG. 26B, FIG. 26C, and FIG. 26D are diagrams each for schematically explaining a loading phenomenon. Each of these drawings schematically shows a display image displayed on panel 10 while the area of region C at a low signal level (e.g. 5%) in the "window pattern" is gradually changed. Each of region D1 in FIG. 26A, region D2 in FIG. 26B, region D3 in FIG. 26C, and region D4 in FIG. 26D is at a signal level (e.g. 20%) equal to that of region B.

As shown in FIG. 26A, FIG. 26B, FIG. 26C, and FIG. 26D, as the area of region C increases in the order of region C1, region C2, region C3, and region C4, the drive load of display electrode pairs 24 passing through region C and region D decreases. As a result, the discharge intensity of the discharge cells in region D increases and the emission luminance in region D gradually increases in the order of region D1, region D2, region D3, and region D4. In this manner, the emission luminance increased by a loading phenomenon changes as the drive load varies. This exemplary embodiment is intended to reduce this loading phenomenon and enhance the image display quality in plasma display device 1. In this exemplary embodiment, the processing performed to reduce the loading phenomenon is referred to as "loading correction".

Figure 27:
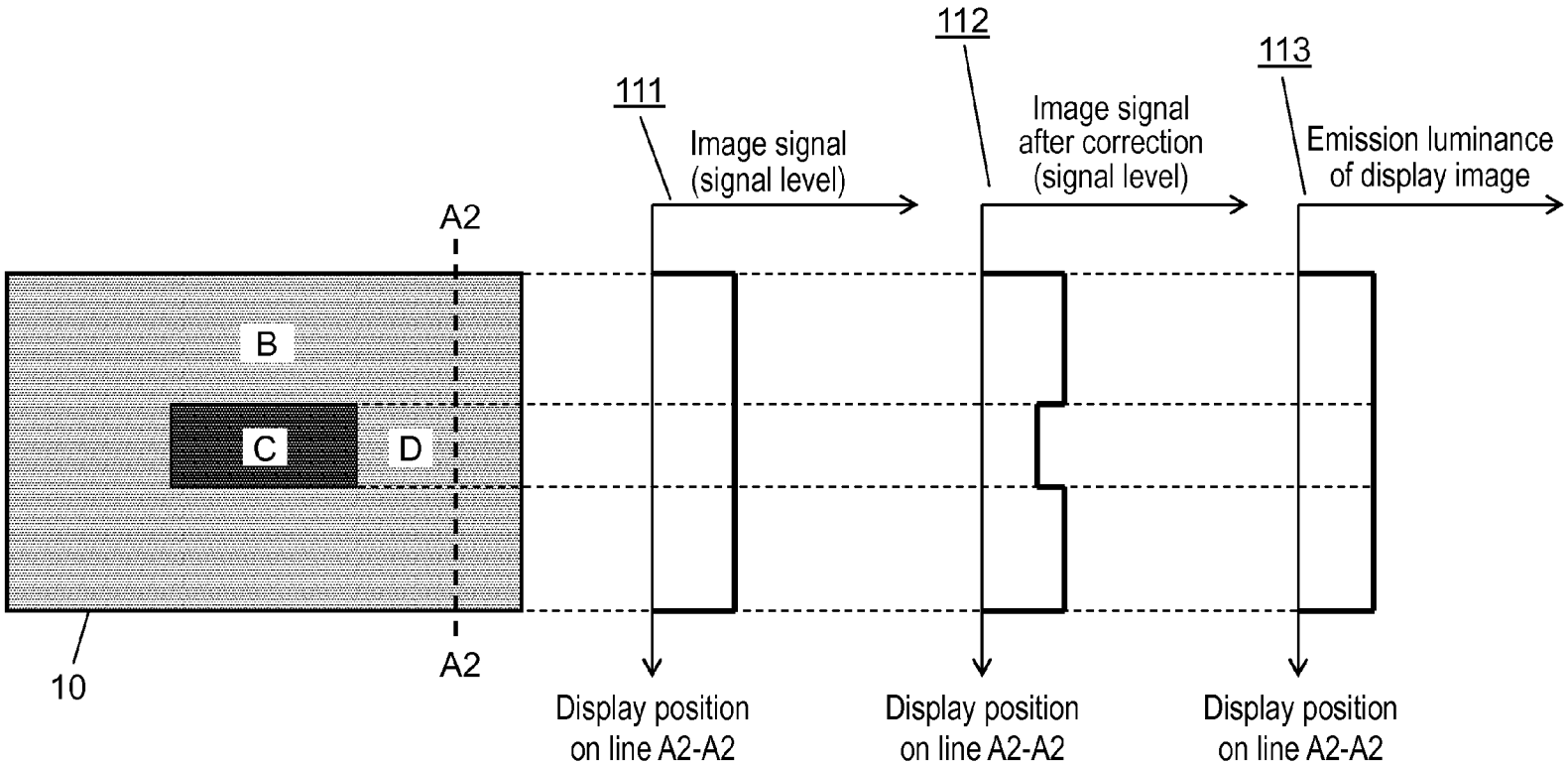
FIG. 27 is a diagram for schematically explaining loading correction in accordance with the exemplary embodiment of the present invention.

FIG. 27 is a diagram for schematically explaining loading correction in accordance with the exemplary embodiment of the present invention. This drawing includes a diagram schematically showing a display image when the "window pattern" of FIG. 25A is shown on panel 10, and diagrams showing signal level 111, signal level 112, and emission luminance 113. The display image in panel 10 of FIG. 27 schematically shows a display image when the "window pattern" of FIG. 25A is displayed on panel 10 after the loading correction of this exemplary embodiment has been performed. Signal level 111 of FIG. 27 shows a signal level of an image signal on line A2-A2 shown in panel 10 of FIG. 27. The horizontal axis shows the magnitude of the signal level of the image signal; the vertical axis shows the display position on line A2-A2 in panel 10. Signal level 112 of FIG. 27 shows the signal level of the image signal on line A2-A2 after the loading correction of this exemplary embodiment has been performed. The horizontal axis shows the magnitude of the signal level of the image signal after the loading correction; the vertical axis shows the display position on line A2-A2 in panel 10. Emission luminance 113 of FIG. 27 shows an emission luminance of the display image on line A2-A2. The horizontal axis shows the magnitude of the emission luminance of the display image; the vertical axis shows the display position on line A2-A2 in panel 10.

In this exemplary embodiment, loading correction is performed in the following manner. For each discharge cell, a correction value based on the drive load of display electrode pair 24 passing through the discharge cell is calculated so as to correct the image signal. For example, when an image as shown in panel 10 of FIG. 27 is displayed on panel 10, it is determined that display electrode pairs 24 passing through region D also pass through region C and thus have a smaller drive load, although region B and region D are at an equal signal level. Then, the signal level of region D is corrected as shown in signal level 112 of FIG. 27. With this correction, as shown in emission luminance 113 of FIG. 27, the magnitudes of emission luminance in region B and region D in the display image are equalized so that the loading phenomenon is reduced.

In this manner, the image signal in a region where a loading phenomenon is likely to occur is corrected such that the emission luminance in the region of the display image is reduced. Thereby, the loading phenomenon is reduced. At this time, in this exemplary embodiment, a correction gain for loading correction is calculated according to the drive load, the type of driving pattern selected, and the position of the discharge cell in the row direction of panel 10, and the loading correction is performed using the correction gain.

Figure 28:
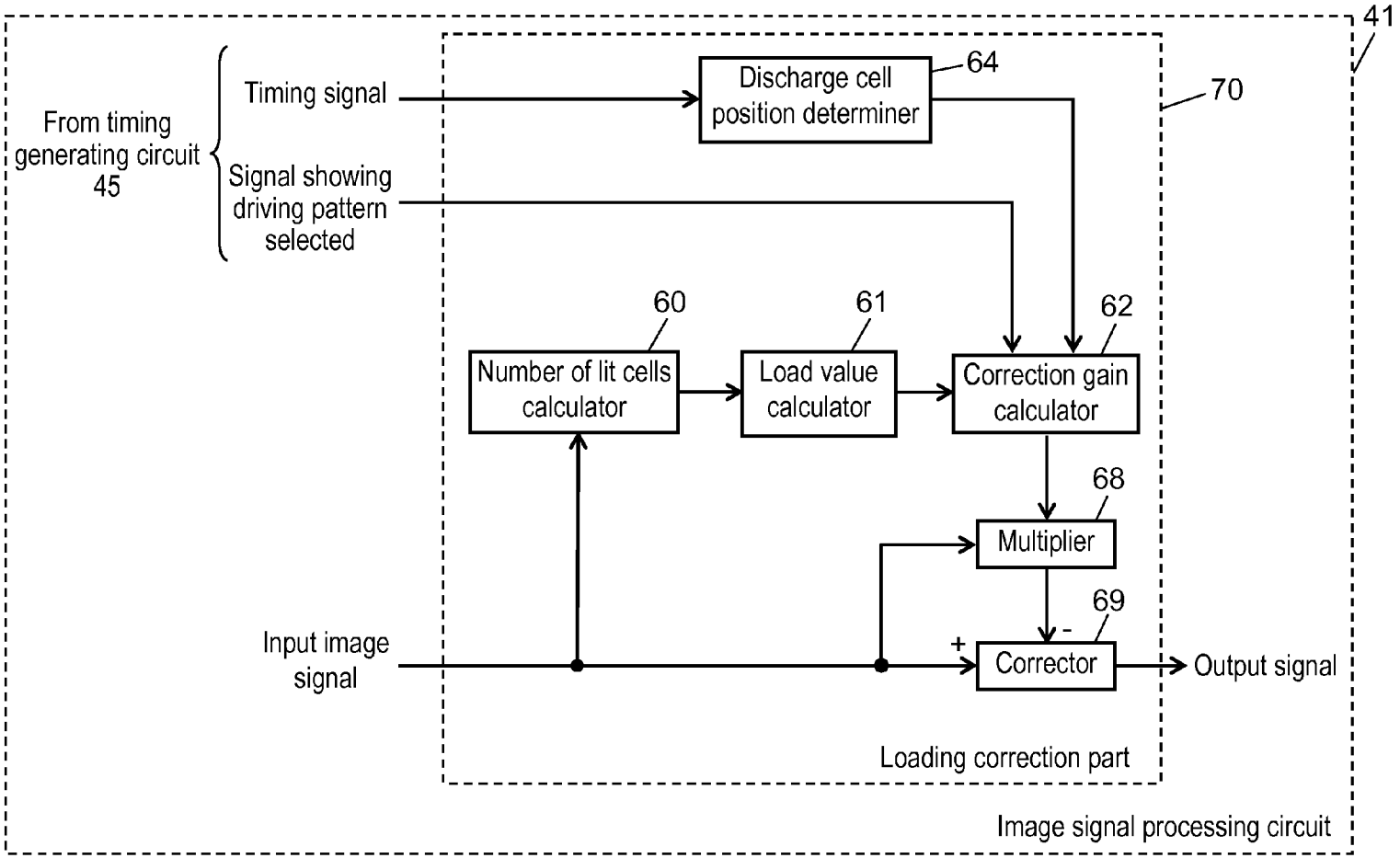
FIG. 28 is a circuit block diagram of an image signal processing circuit in accordance with the exemplary embodiment.

The loading correction in this exemplary embodiment is detailed. FIG. 28 is a circuit block diagram of image signal processing circuit 41 in accordance with the exemplary embodiment of the present invention. In FIG. 28, the blocks related to the loading correction in this exemplary embodiment are shown, and the other circuit blocks are omitted.

Image signal processing circuit 41 has loading correction part 70 including the following elements:

number of lit cells calculator 60;
load value calculator 61;
correction gain calculator 62;
discharge cell position determiner 64;
multiplier 68; and
corrector 69.

Number of lit cells calculator 60 calculates the number of discharge cells to be lit (hereinafter, a discharge cell to be lit being referred to as "lit cell", and a discharge cell to be unlit as "unlit cell") in each display electrode pair 24, in each subfield.

Upon receiving the calculation result in number of lit cells calculator 60, load value calculator 61 performs operations based on the method for calculating a drive load in this exemplary embodiment (calculation of a "load value" and a "maximum load value" to be described later, in this exemplary embodiment).

In response to the timing signals, discharge cell position determiner 64 determines the position of a discharge cell of which correction gain is to be calculated in correction gain calculator 62 (hereinafter, referred to as "focused discharge cell") in the row direction (the position in the extending direction of display electrode pair 24).

Correction gain calculator 62 calculates a correction gain, according to the type of driving pattern selected, the determination result of the discharge cell position in discharge cell position determiner 64, and the calculation result in load value calculator 61. In this exemplary embodiment, the signal showing the type of driving pattern selected is output from driving pattern selector 49 included in timing generating circuit 45, and input to correction gain calculator 62.

Multiplier 68 multiplies an image signal by the correction gain output from correction gain calculator 62, and outputs the obtained result as a correction signal. Corrector 69 subtracts the correction signal output from multiplier 68, from the image signal, and outputs the obtained result as the image signal after correction.

Next, the method for calculating a correction gain in this exemplary embodiment is described. In this exemplary embodiment, this operation is performed in number of lit cells calculator 60, load value calculator 61, and correction gain calculator 62.

In this exemplary embodiment, two numerical values referred to as "load value" and "maximum load value" are calculated, according to the calculation result in number of lit cells calculator 60. These "load value" and "maximum load value" are the numerical values to be used to estimate the loading phenomenon amount in a focused discharge cell.

Figure 29:
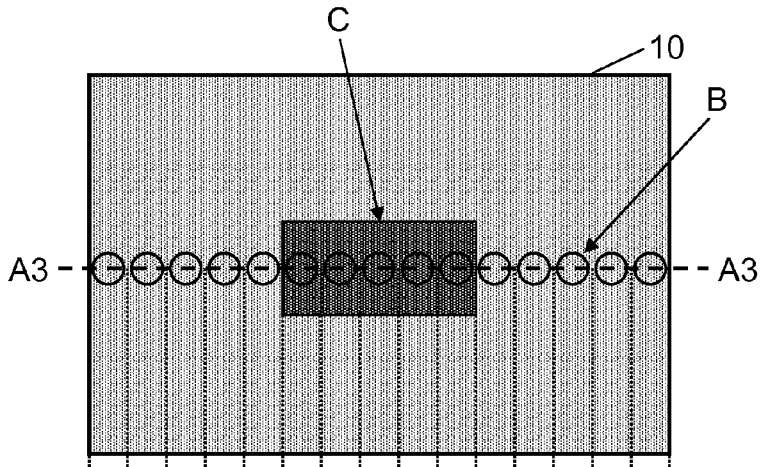
FIG. 29 is a schematic chart for explaining a method for calculating a "load value" in accordance with the exemplary embodiment.

First, a description is provided for the "load value" in this exemplary embodiment, with reference to FIG. 29. Next, a description is provided for the "maximum load value" in this exemplary embodiment, with reference to FIG. 30.

FIG. 29 is a schematic chart for explaining a method for calculating a "load value" in accordance with the exemplary embodiment of the present invention. This drawing shows a schematic diagram of the display image of the "window pattern" of FIG. 25A displayed on panel 10, and lighting state 121 and calculated value 122. Lighting state 121 of FIG. 29 is a schematic chart showing lighting or non-lighting of each discharge cell on line A3-A3 in panel 10 of FIG. 29 in each subfield. The horizontal columns show display positions on line A3-A3 in panel 10; the vertical columns show the subfields. Further, "1" shows lighting, and the blank shows non-lighting. Calculated value 122 of FIG. 29 is a chart schematically showing the method for calculating a "load value" in this exemplary embodiment. The horizontal columns show "number of lit cells", "luminance weight", "lighting state of discharge cell B", and "calculated value" in this order from the left of the chart; the vertical columns show the subfields. In this exemplary embodiment, for simplifying the explanation, the number of discharge cells in the row direction is set to 15. Therefore, the following description is provided, assuming that 15 discharge cells are disposed on line A3-A3 in panel 10 of FIG. 29. Actually, the following operations are performed on the number of discharge cells in the row direction of panel 10 (e.g. 1920×3).

Assume that the lighting states of 15 discharge cells disposed on line A3-A3 in panel 10 of FIG. 29 in the respective subfields are as shown in lighting state 121, for example. That is, five discharge cells in the center included in region C in panel 10 of FIG. 29 are lit in the first SF through the third SF, and unlit in the fourth SF through the eighth SF. Further, five discharge cells on the left side and five discharge cells on the right side excluded from region C are lit in the first SF through the sixth SF, and unlit in the seventh SF and the eighth SF.

When the 15 discharge cells disposed on line A3-A3 are in such a lighting state, the "load value" of one of the discharge cells, e.g. discharge cell B in the drawing, is obtained in the following manner.

First, the number of lit cells in each subfield is calculated. Since all the 15 discharge cells on line A3-A3 are lit in the first SF through the third SF, the number of lit cells in each of the first SF through the third SF is 15, as shown in the columns under "number of lit cells" corresponding to the first SF through the third SF in calculated value 122 of FIG. 29. Next, since 10 out of the 15 discharge cells on line A3-A3 are lit in the fourth SF through the sixth SF, the number of lit cells in each of the fourth SF through the sixth SF is 10, as shown in the columns under "number of lit cells" corresponding to the fourth SF through the sixth SF in calculated value 122. Next, since all the 15 discharge cells on line A3-A3 are unlit in the seventh SF and the eighth SF, the number of lit cells in each of the seventh SF and the eighth SF is 0, as shown in the columns under "number of lit cells" corresponding to the seventh SF and the eighth SF in calculated value 122.

Next, the number of lit cells in each subfield thus obtained is multiplied by the luminance weight and the lighting state of discharge cell B in the corresponding subfield. In this exemplary embodiment, as shown in the respective columns under "luminance weight" corresponding to the first SF through the eighth SF in calculated value 122 of FIG. 29, the luminance weights of the respective subfields are 1, 2, 4, 8, 16, 32, 64, and 128 in this order from the first SF. In this exemplary embodiment, lighting is 1 and non-lighting is 0. Therefore, as shown in the respective columns under "lighting state of discharge cell B" corresponding to the first SF through the eighth SF in calculated value 122, the lighting states of discharge cell B are 1, 1, 1, 1, 1, 1, 0, and 0 in this order from the first SF. As shown in the respective columns under "calculated value" corresponding to the first SF through the eighth SF in calculated value 122, the multiplication results are 15, 30, 60, 80, 160, 320, 0, and 0 in this order from the first SF. Then, the total sum of the calculated values is obtained. In the example shown in calculated value 122 of FIG. 29, the total sum of the calculated values is 665. This total sum is the "load value" in discharge cell B. In this exemplary embodiment, such operations are performed on each discharge cell, and thus a "load value" is obtained for each discharge cell.

Figure 30:
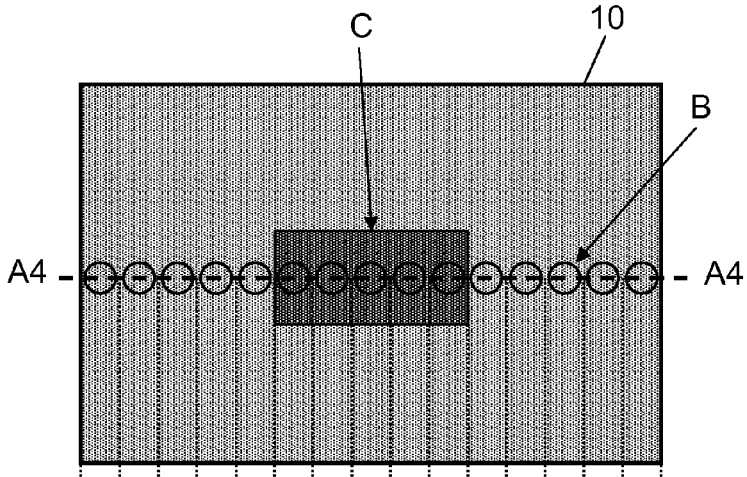
FIG. 30 is a schematic chart for explaining a method for calculating a "maximum load value" in accordance with the exemplary embodiment.

FIG. 30 is a schematic chart for explaining a method for calculating a "maximum load value" in accordance with the exemplary embodiment of the present invention. This drawing shows a schematic diagram of the display image of the "window pattern" of FIG. 25A displayed on panel 10, and lighting state 131 and calculated value 132. Lighting state 131 of FIG. 30 is a schematic chart showing lighting or non-lighting in each subfield when the lighting state of discharge cell B is applied to all the discharge cells on line A4-A4 in panel 10 of FIG. 30 for calculation of the "maximum load value". The horizontal columns show display positions on line A4-A4 in panel 10; the vertical columns show the subfields. Calculated value 132 of FIG. 30 is a chart schematically showing the method for calculating a "maximum load value" in this exemplary embodiment. The horizontal columns show "number of lit cells", "luminance weight", "lighting state of discharge cell B", and "calculated value" in this order from the left of the chart, and the vertical columns show the subfields.

In this exemplary embodiment, a "maximum load value" is calculated in the following manner. For calculation of the "maximum load value" in discharge cell B, for example, the number of lit cells in each subfield is calculated, assuming that every discharge cell on line A4-A4 is in a lighting state equal to that of discharge cell B, as shown in lighting state 131 of FIG. 30. As shown in the respective columns under "lighting state of discharge cell B" corresponding to the first SF through the eighth SF in calculated value 122 of FIG. 29, the lighting states of discharge cell B in the respective subfields are 1, 1, 1, 1, 1, 1, 0, and 0 in this order from the first SF. Then, the lighting states are allocated to all the discharge cells on line A4-A4. Therefore, the lighting states of all the discharge cells on line A4-A4 are 1 in the first SF through the sixth SF, and 0 in the seventh SF and the eighth SF, as shown in lighting state 131 of FIG. 30. As a result, the numbers of lit cells are 15, 15, 15, 15, 15, 15, 0, and 0 in this order from the first SF, as shown in the respective columns under "number of lit cells" corresponding to the first SF through the eighth SF in calculated value 132 of FIG. 30. However, in this exemplary embodiment, each of the discharge cells on line A4-A4 is not actually brought into the lighting states shown in lighting state 131. The lighting states shown in lighting state 131 are those when it is assumed that each of the discharge cells is brought into a lighting state equal to that of discharge cell B for calculation of the "maximum load value". The "number of lit cells" shown in calculated value 132 are the numbers of lit cells based on that assumption.

Next, the number of lit cells in each subfield thus obtained is multiplied by the luminance weight and the lighting state of discharge cell B in the corresponding subfield. As described above, in this exemplary embodiment, as shown in the respective columns under "luminance weight" corresponding to the first SF through the eighth SF in calculated value 132 of FIG. 30, the luminance weights of the respective subfields are 1, 2, 4, 8, 16, 32, 64, and 128 in this order from the first SF. Further, as shown in the respective columns under "lighting state of discharge cell B" corresponding to the first SF through the eighth SF in calculated value 132, the lighting states of discharge cell B are 1, 1, 1, 1, 1, 1, 0, and 0 in this order from the first SF. Therefore, as shown in the respective columns under "calculated value" corresponding to the first SF through the eighth SF in calculated value 132, the multiplication results are 15, 30, 60, 120, 240, 480, 0, and 0 in this order from the first SF. Then, the total sum of the calculated values is obtained. In the example shown in calculated value 132 of FIG. 30, the total sum of the calculated values is 945. This total sum is the "maximum load value" in discharge cell B. In this exemplary embodiment, such operations are performed on each discharge cell, and thus a "maximum load value" is obtained for each discharge cell.

The "maximum load value" in discharge cell B may be obtained also in the following manner. The number of all discharge cells on display electrode pair 24 (15, in this example) is multiplied by the luminance weights of the respective subfields (e.g. 1, 2, 4, 8, 16, 32, 64, and 128 in this order from the first SF). Next, each multiplication result and the lighting state of discharge cell B in the corresponding subfield (e.g. 1, 1, 1, 1, 1, 1, 0, and 0 in this order from the first SF) are multiplied. Then, the total sum of these calculated values (15, 30, 60, 120, 240, 480, 0, and 0 in this order from the first SF, in this example) is obtained. Also by such a calculation method, the result equal to that of the above operations (945, in this example) can be obtained.

Further, in this exemplary embodiment, using a numerical value obtained with the following Expression (1), the correction gain of a focused discharge cell (discharge cell B) is calculated.

(Maximum load value−load value)/maximum load value  Expression (1)

For example, from the "load value"=665 and the "maximum load value"=945 in the above discharge cell B, the following numerical value:

(945−665)/945=0.296 can be obtained. Using the thus calculated numerical value in the following Expression (2), the correction gain is calculated. That is, the correction gain is obtained by multiplying the result of Expression (1) by a predetermined coefficient (a coefficient predetermined according to the characteristics of panel 10, for example), and further by a predetermined correction amount based on the driving pattern selected, and the position of the discharge cell in the row direction of panel 10.

Correction gain=result of Expression (1)×predetermined coefficient×correction amount  Expression (2)

Then, this correction gain is substituted into the following Expression (3) so as to correct the input image signal.

Output image signal=input image signal−input image signal×correction gain  Expression (3)

This operation can suppress an unnecessary increase in the luminance in the region where a loading phenomenon is likely to occur, and reduce the loading phenomenon.

In recent panel 10 having a large screen and high definition, the impedances of scan electrodes 22 and sustain electrode 23 are increased. Thus, between a discharge cell positioned relatively nearer to the driving circuit and a discharge cell positioned relatively farther from the driving circuit, the difference in the voltage drop in sustain pulses tends to increase. However, in this exemplary embodiment, a "load value" and a "maximum load value" are calculated, a correction amount is preset according to the driving pattern selected and the position of the discharge cell in the row direction of panel 10, and these values are used to calculate a correction gain. Thus, the correction gain corresponding to the expected increase in emission luminance can be calculated with high accuracy. Therefore, loading correction can be performed with high accuracy.

Figure 31:
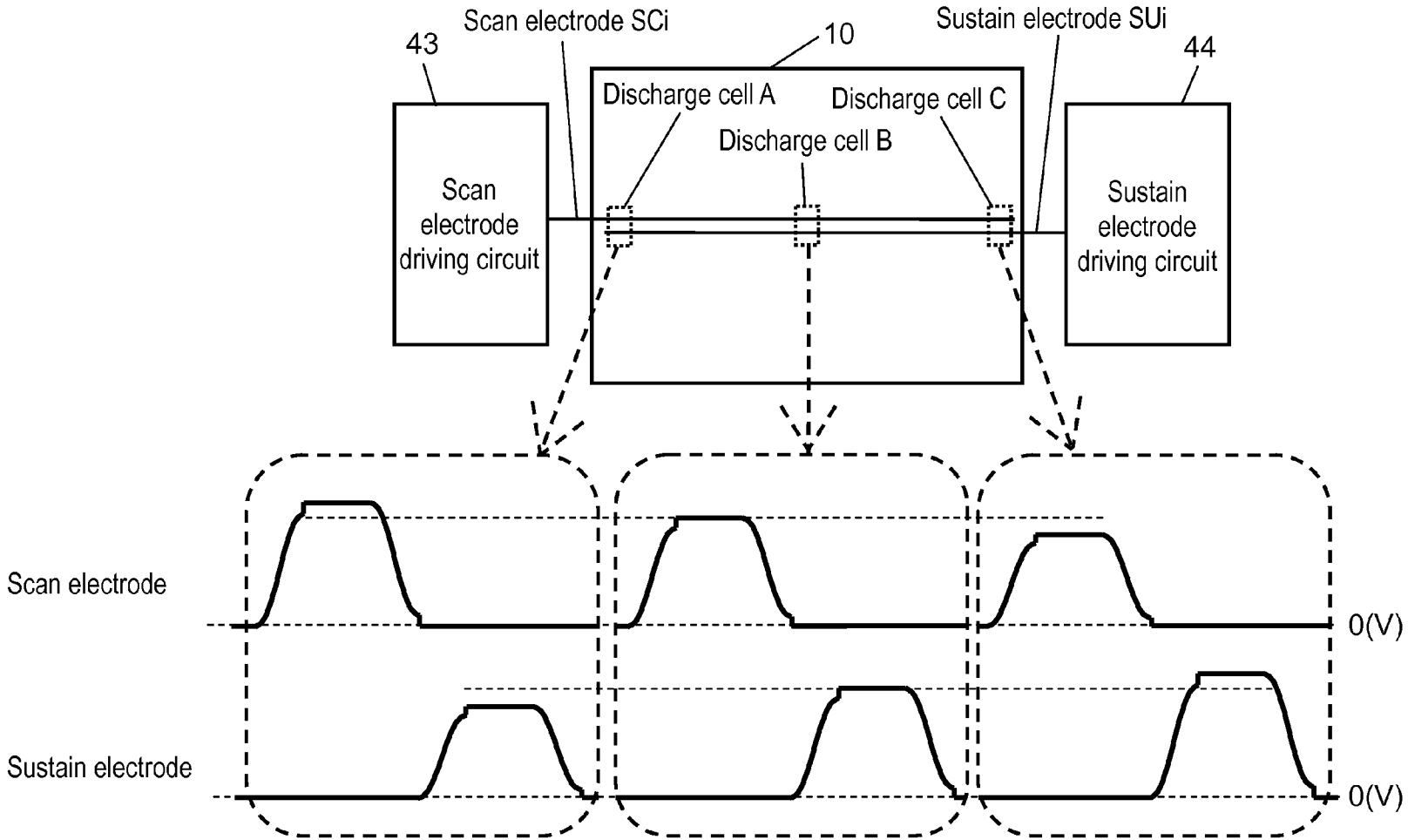
FIG. 31 is a schematic chart showing differences in the voltage drop in sustain pulses based on the positions of discharge cells in the row direction of the panel.

FIG. 31 is a schematic chart showing differences in the voltage drop in sustain pulses based on the positions of discharge cells in the row direction of panel 10. FIG. 31 shows only one display electrode pair 24 for facilitating explanation. The chart also schematically shows sustain pulses in the following three discharge cells: discharge cell A positioned nearest to scan electrode driving circuit 43, discharge cell C positioned farthest from scan electrode driving circuit 43, and discharge cell B positioned intermediately between them.

As shown in FIG. 31, discharge cell A positioned nearest to scan electrode driving circuit 43 is farthest from sustain electrode driving circuit 44. Thus, the drive impedance of discharge cell A with respect to scan electrode driving circuit 43 is relatively low. In contrast, the drive impedance of discharge cell A with respect to sustain electrode driving circuit 44 is relatively high. Therefore, while the voltage drop in the sustain pulse applied to discharge cell A by scan electrode driving circuit 43 is relatively small, the voltage drop in the sustain pulse applied to discharge cell A by sustain electrode driving circuit 44 is relatively large.

On the other hand, discharge cell C positioned farthest from scan electrode driving circuit 43 is nearest to sustain electrode driving circuit 44. Therefore, while the voltage drop in the sustain pulse applied to discharge cell C by scan electrode driving circuit 43 is relatively large, the voltage drop in the sustain pulse applied to discharge cell C by sustain electrode driving circuit 44 is relatively small. The magnitudes of the voltage drop in the sustain pulses applied to discharge cell B are substantially intermediate between those applied to discharge cells A and C.

The emission luminance caused by a sustain discharge varies with the magnitude of a sustain pulse. Typically, a larger sustain pulse causes a stronger sustain discharge, and thus higher emission luminance. In contrast, a smaller sustain pulse causes a weaker, less stable discharge, and thus lower emission luminance. However, which of the emission luminance caused by the combination of a sustain pulse having a relatively large amplitude and a sustain pulse having a relatively small amplitude (e.g. the emission luminance in discharge cell A or discharge cell C) and the emission luminance caused by sustain pulses each having an intermediate amplitude between them (e.g. the emission luminance in discharge cell B) is higher depends on the characteristics of panel 10.

Figure 32:
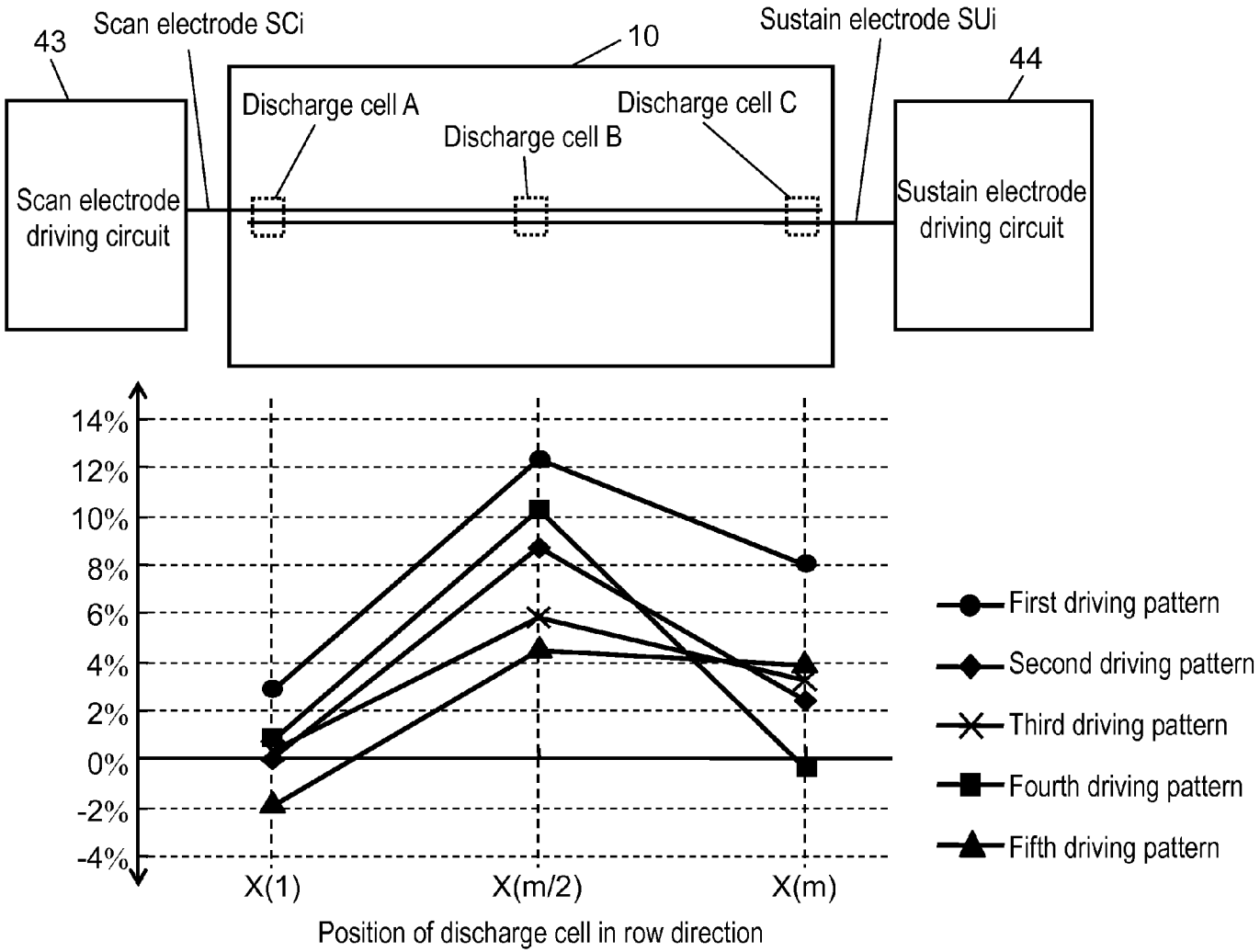
FIG. 32 is a characteristics chart showing the relation between a driving pattern for driving the panel and the position of a discharge cell, and emission luminance in accordance with the exemplary embodiment.

The emission luminance also varies with driving patterns. FIG. 32 is a characteristics chart showing the relation between a driving pattern for driving panel 10 and the position of a discharge cell, and emission luminance in accordance with the exemplary embodiment of the present invention. FIG. 32 shows a measurement result of emission luminance in discharge cell A positioned nearest to scan electrode driving circuit 43, in discharge cell C positioned farthest from scan electrode driving circuit 43, i.e. nearest to sustain electrode driving circuit 44, and in discharge cell B positioned intermediately between them, when panel 10 is driven in the first driving pattern through the fifth driving pattern.

The horizontal axis in FIG. 32 shows the position of a discharge cell in the row direction. X (1) shows the position of discharge cell A, X (m) shows the position of discharge cell C, and X (m/2) shows the position of discharge cell B. The vertical axis in FIG. 32 shows a relative rate of a difference from a reference luminance (e.g. emission luminance in discharge cell A when panel 10 is driven in the second driving pattern).

As shown in FIG. 32, in panel 10, emission luminance is higher in a discharge cell in the central portion (e.g. X (m/2)) than in a discharge cell in the peripheral portion (e.g. X (1) or X (m)). Further, the driving in the third driving pattern is compared with the driving in the fifth driving pattern. While the difference in emission luminance between discharge cell B and discharge cell A is approximately 5% in the third driving pattern, the difference in emission luminance between discharge cell B and discharge cell A is approximately 9% in the fifth driving pattern, which is approximately 4% larger than that in the third driving pattern.

According to these results, preferably, the correction gain to be used for the loading correction is produced so as to correct the difference in emission luminance between the positions of the discharge cells and to correct the difference in emission luminance between the driving patterns.

Then, in this exemplary embodiment, a correction gain for the loading correction is calculated by adding the correction based on a driving pattern and the position of a discharge cell in the row direction to a numerical value calculated with Expression (1).

Specifically, correction data is set for each driving pattern, according to the measurement result of the relation between a driving pattern and the position of a discharge cell, and an emission luminance shown in FIG. 32. Then, a correction amount is selected from the correction data, according to the driving pattern selected and the position of each discharge cell in the row direction, and a correction gain is calculated using the correction amount.

Figure 33:
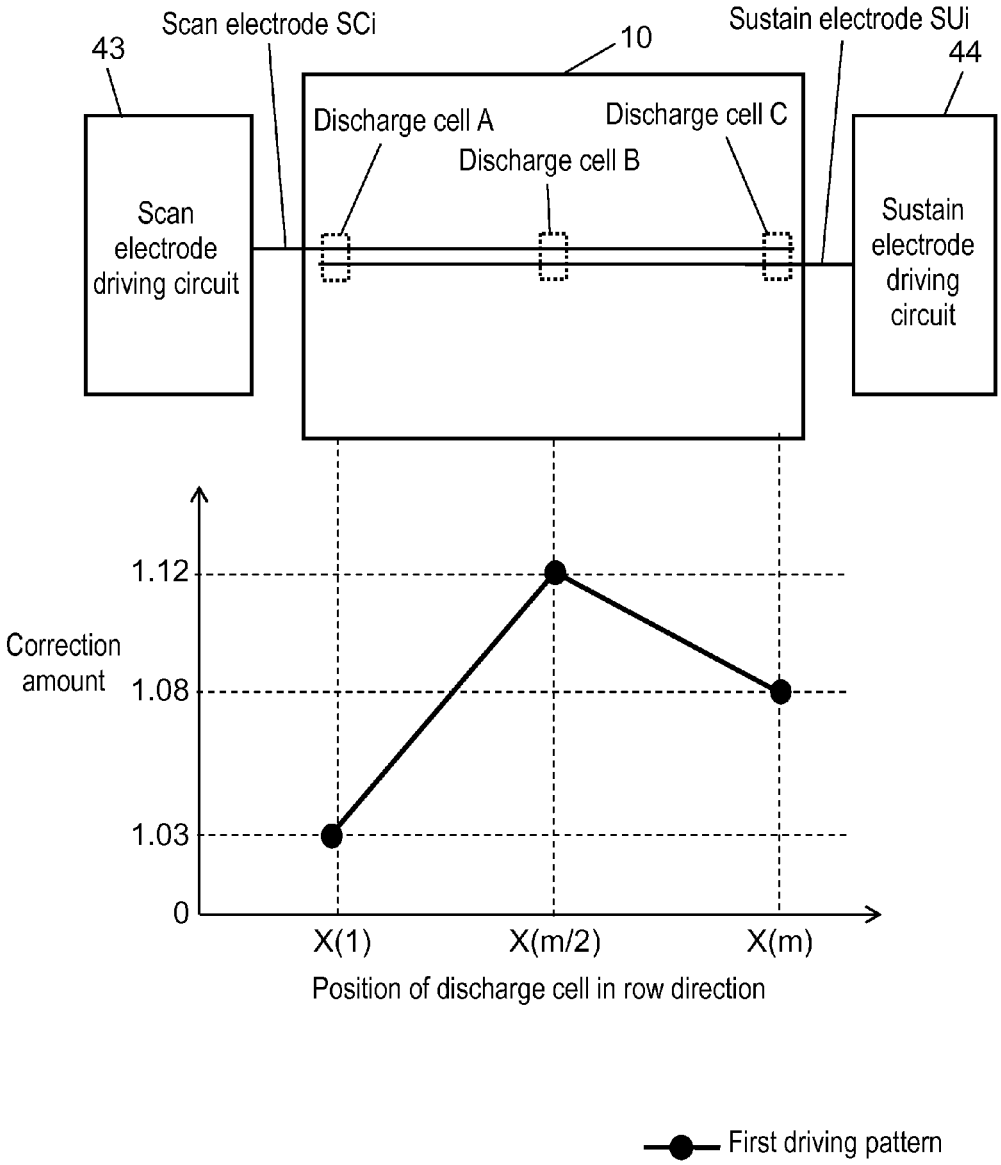
FIG. 33 is a schematic diagram showing an example of correction data in accordance with the exemplary embodiment.

FIG. 33 is a schematic diagram showing an example of correction data in accordance with the exemplary embodiment of the present invention. This drawing shows correction data of the first driving pattern as an example. The horizontal axis in FIG. 33 shows the position of a discharge cell in the row direction; the vertical axis shows a correction amount.

For example, when panel 10 is driven in the first driving pattern, discharge cell A positioned at X (1) has an emission luminance approximately 3% higher, discharge cell B positioned at X (m/2) has an emission luminance approximately 12% higher, and discharge cell C positioned at X (m) has an emission luminance approximately 8% higher than the reference emission luminance, as shown in FIG. 32. Thus, correction data is set such that the correction gain calculated with Expression (1) is multiplied by 1.03 in discharge cell A positioned at X (1), by 1.12 in discharge cell B positioned at X (m/2), and by 1.08 in discharge cell C positioned at X (m), by a numerical value between 1.03 and 1.12 in a discharge cell positioned between X (1) and X (m/2) according to its position, and by a numerical value between 1.12 and 1.08 in a discharge cell positioned between X (m/2) and X (m) according to its position.

Then, such correction data is set for each driving pattern, according to the characteristics shown in FIG. 32. With this operation, a correction gain according to the driving pattern selected and the position of the discharge cell can be calculated for the loading correction.

Figure 34:
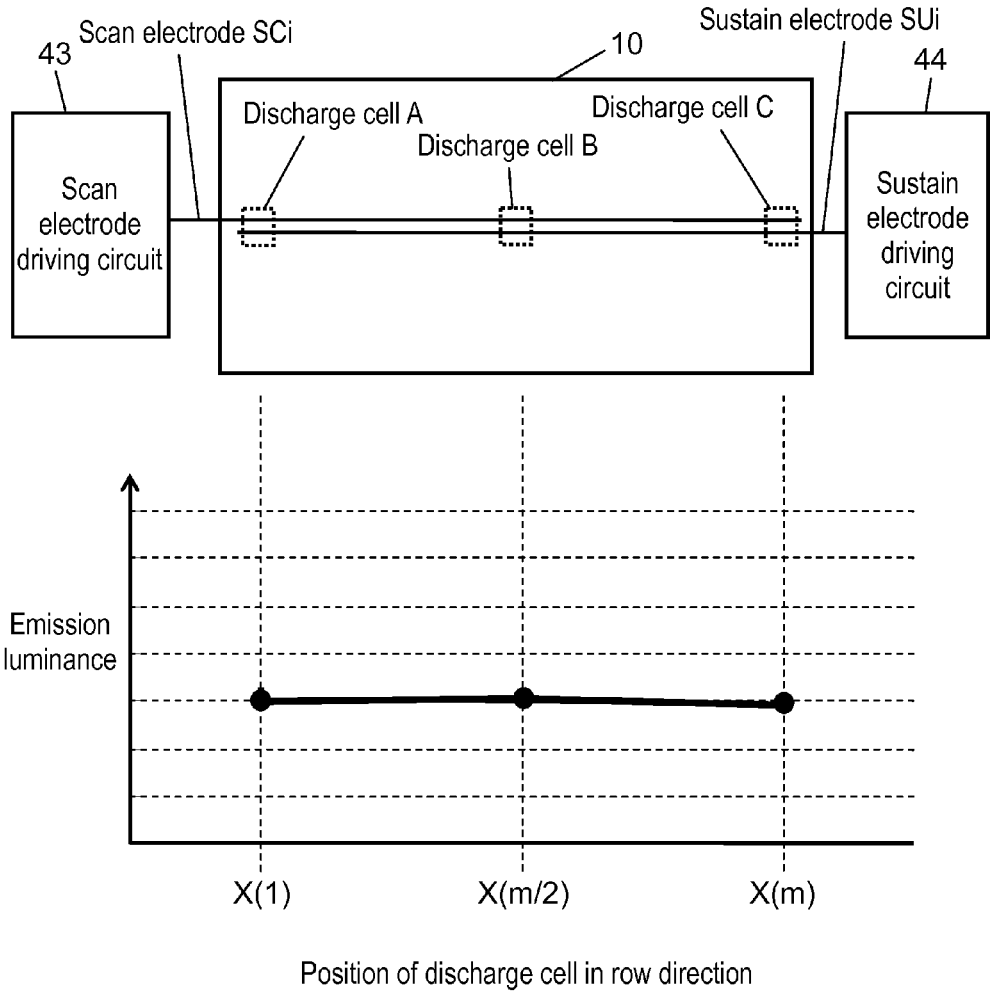
FIG. 34 is a characteristics chart showing the relation between the position of a discharge cell and emission luminance when loading correction is performed using a correction gain in accordance with the exemplary embodiment.

FIG. 34 is a characteristics chart showing the relation between the position of a discharge cell and emission luminance when loading correction is performed using a correction gain in accordance with the exemplary embodiment of the present invention. FIG. 34 shows a measurement result of emission luminance in discharge cell A, discharge cell B, and discharge cell C, under the following conditions: while panel 1 is driven in the first driving pattern and the display image is switched between an image having a loading phenomenon in discharge cell A, an image having a loading phenomenon in discharge cell B, and an image having a loading phenomenon in discharge cell C, loading correction is performed using the correction data of FIG. 33.

Then, as described above, a correction gain is calculated according to the driving pattern and the position of the discharge cell. Thereby, as shown in FIG. 34, for example, loading correction can be performed such that variations in emission luminance between the discharge cells are reduced.

In this exemplary embodiment, a plurality of correction data set for each driving pattern is stored in a memory (not shown) inside correction gain calculator 62. In response to the signal from timing generating circuit 45 showing a driving pattern, the memory selects optimum correction data and outputs a correction amount in the correction data that corresponds to the information on the position of the discharge cell output from discharge cell position determiner 64. Using the correction amount, correction gain calculator 62 calculates a correction gain.

The correction data of which example is shown in FIG. 33 may be set to an optimum value while the display image is checked.

Although FIG. 33 shows an example of correction data where the correction amount changes linearly, i.e. the amount of change is expressed by a straight line, this is only an example. Preferably, the correction amount is set optimally for the characteristics of panel 10, the characteristics of the driving circuits, or the like. However, preferably, the correction amount is changed per pixel, and set equal at least in three (R, G, and B) discharge cells forming one pixel.

FIG. 33 shows numerical values, such as 1.03, 1.12, and 1.08, as correction amounts. This is simply because a coefficient to be multiplied by the value calculated with Expression (1) is set such that the correction amounts are these values. In the present invention, preferably, the value of the correction amount to be multiplied to obtain a correction gain is set optimally for the method for calculating the correction gain, the characteristics of panel 10, the specifications of plasma display device 1, or the like.

As described above, in this exemplary embodiment, a plurality of sustain pulses where the lengths of at least one of the "rising period" and the "falling period" are different is generated, and a plurality of driving patterns (five driving patterns, herein) where the sustain pulses are generated in different combinations is set. Further, the sustain pulses are generated such that the driving patterns are switched according to the all-cell light-emitting rate and maximum partial light-emitting rate detected. This structure enables driving for reducing power consumption and suppressing variations in discharge, and thereby enhances the image display quality of panel 10. Further, a "load value" and a "maximum load value" are calculated for each discharge cell, and a correction gain is calculated according to a driving pattern selected and the position of a discharge cell. With this structure, when an image where a loading phenomenon is likely to occur is displayed on panel 10, a correction gain corresponding to the expected increase in emission luminance can be calculated with high accuracy. Further, loading correction optimum for the driving pattern and the position of the discharge cell can be performed. With this structure, even when a difference in emission luminance is produced between the discharge cells formed on one display electrode pair 24 and the difference varies with driving patterns, loading correction optimum for the driving pattern and the position of the discharge cell in the row direction can be performed. Thus, the image display quality can be enhanced.

In this exemplary embodiment, a description is provided for the structure where the luminance weight and the lighting state of a discharge cell in each subfield are multiplied, in calculation of the "load value" and the "maximum load value". Instead of the luminance weight, the number of sustain pulses in each subfield, for example, may be used.

When generally-used image processing called error diffusion is performed, the following problem can arise: an increase in the error amount diffused at a changing point of gradation values (a boundary of a pattern of a display image) emphasizes the boundary in the boundary portion having large luminance changes, and makes the image look unnatural. In order to reduce this problem, the present invention may be configured such that a correction value for error diffusion is randomly added to or subtracted from the calculated correction gain so as to give a random change to the correction gain. Such processing can reduce the problem of emphasizing the boundary of the pattern and making the image look unnatural in error diffusion.

Figure 35:
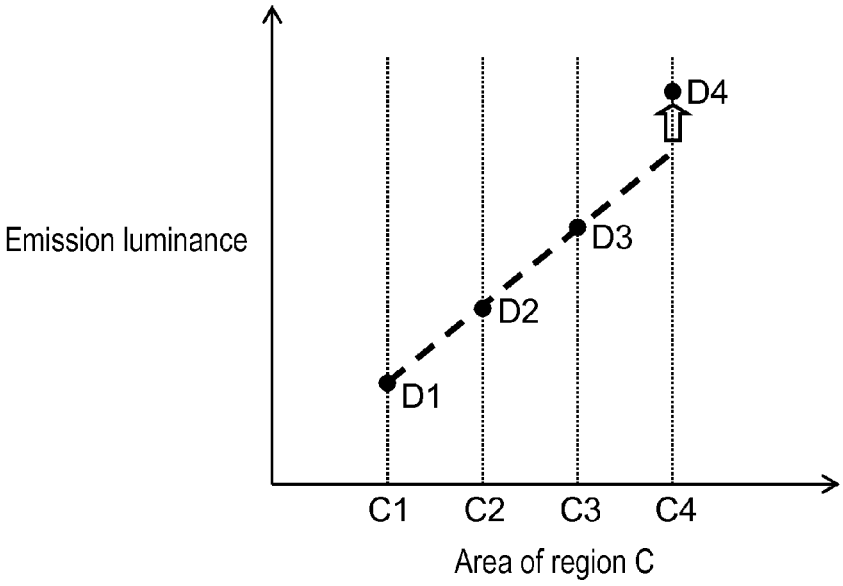
FIG. 35 is a chart showing an example of the relation between the area of region C and emission luminance in region D in a "window pattern".
Figure 36:
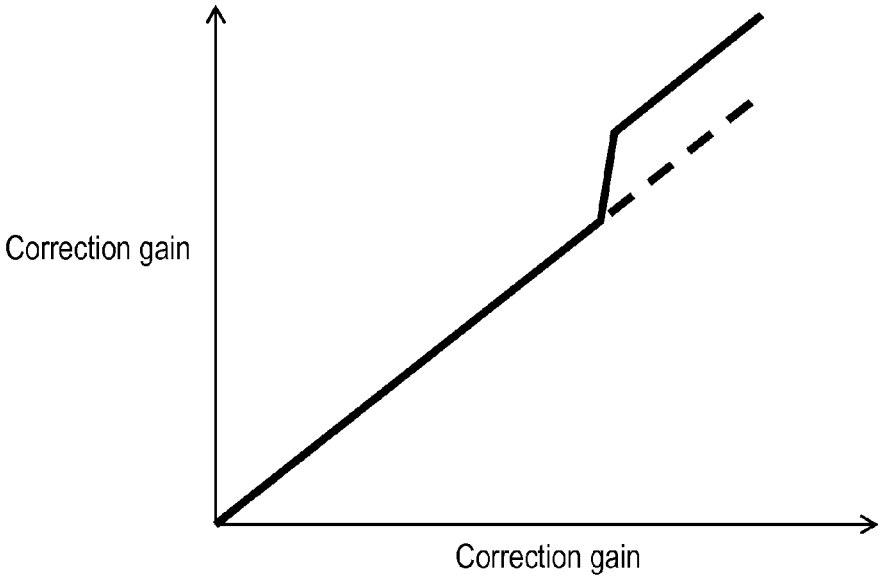
FIG. 36 is a characteristics chart showing an example of nonlinear processing of a correction gain in accordance with the exemplary embodiment of the present invention.

FIG. 26A, FIG. 26B, FIG. 26C, and FIG. 26D show an example where variations in the drive load change the emission luminance. However, depending on the characteristics of panel 10, the emission luminance not always changes linearly when a loading phenomenon occurs. FIG. 35 is a chart showing an example of the relation between the area of region C and the emission luminance in region D in the "window pattern" shown in FIG. 26A, FIG. 26B, FIG. 26C, and FIG. 26D. In some types of panel 10, when the area of region C increases (e.g. C4 in FIG. 26D), i.e. when the drive load of display electrode pairs 24 decreases, the loading phenomenon can become extremely severe and considerably increase the emission luminance in region D (e.g. D4 in FIG. 26D). The present invention may be configured such that the correction gain is weighted and nonlinearly changed according to the characteristics of such panel 10. FIG. 36 is a characteristics chart showing an example of nonlinear processing of a correction gain in accordance with the exemplary embodiment of the present invention. For example, a plurality of correction gains set according to the characteristics of panel 10 is prestored in a lookup table, and one of the correction gains is read out from the lookup table according to the calculation result of the correction gain. With this structure, as shown in FIG. 36, correction gains can be set nonlinearly.

The exemplary embodiment of the present invention can also be applied to a method for driving a panel by so-called two-phase driving. In the two-phase driving, scan electrode SC1 through scan electrode SCn are divided into a first scan electrode group and a second scan electrode group. Further, each address period is divided into two address periods: a first address period where a scan pulse is applied to each scan electrode belonging to a first scan electrode group; and a second address period where the scan pulse is applied to each scan electrode belonging to a second scan electrode group. Also in the two-phase driving, advantages similar to the above can be obtained.

The exemplary embodiment of the present invention is also effective in a panel having an electrode structure where a scan electrode is adjacent to a scan electrode and a sustain electrode is adjacent to a sustain electrode. In this electrode structure (referred to as "ABBA electrode structure"), the electrodes are arranged on the front plate in the following order: a scan electrode, a scan electrode, a sustain electrode, a sustain electrode, a scan electrode, a scan electrode, or the like.

The specific numerical values in the exemplary embodiment are set according to the characteristics of a 50-inch diagonal panel having 1080 display electrode pairs, and only show examples in the exemplary embodiment. The present invention is not limited to these numerical values. Preferably, the numerical values are set optimally for the characteristics of the panel, the specifications of the plasma display device, or the like. For each of these numerical values, variations are allowed within the range where the above advantages can be obtained.

INDUSTRIAL APPLICABILITY

The present invention can provide a plasma display device and a driving method for a panel that are capable of causing a discharge while reducing power consumption, and of enhancing the image display by unformizing the display luminance, even with a panel having a large screen and high definition. Thus, the present invention is useful as a plasma display device and a driving method for a panel.

REFERENCE SIGNS LIST

1 Plasma display device
10 Panel (plasma display panel)
21 Front plate
22 Scan electrode
23 Sustain electrode
24 Display electrode pair
25, 33 Dielectric layer
26 Protective layer
31 Rear plate
32 Data electrode
34 Barrier rib
35 Phosphor layer
41 Image signal processing circuit
42 Data electrode driving circuit
43 Scan electrode driving circuit
44 Sustain electrode driving circuit
45 Timing generating circuit
46 All-cell light-emitting rate detecting circuit
47 Partial light-emitting rate detecting circuit
48 Maximum value detecting circuit
49 Driving pattern selector
50, 80 Sustain pulse generating circuit
51, 81 Recovery circuit
52, 82 Clamp circuit
53 Initializing waveform generating circuit
54 Scan pulse generating circuit
60 Number of lit cells calculator
61 Load value calculator
62 Correction gain calculator
64 Discharge cell position determiner
68 Multiplier
69 Corrector
70 Loading correction part
72 Switch
101, 111, 112 Signal level
102, 113 Emission luminance
121, 131 Lighting state
122, 132 Calculated value
Q11, Q12, Q13, Q14, Q21, Q22, Q23, Q24, Q26, Q27, Q28, Q29, QH1 through QHn, QL1 through QLn Switching element
C10, C20, C30 Capacitor
L10, L20 Inductor
D11, D12, D21, D22, D30 Diode

The invention claimed is:

1. A plasma display device comprising:

a plasma display panel, the plasma display panel being driven by a subfield method in which a plurality of subfields is set in one field, each of the subfields has an initializing period, an address period, and a sustain period, a luminance weight is set for each of the subfields, and sustain pulses corresponding in number to the luminance weight are generated in the sustain period for gradation display, the plasma display panel having a plurality of discharge cells, the discharge cells having display electrode pairs, each of the display electrode pairs being formed of a scan electrode and a sustain electrode;

an image signal processing circuit for converting an input image signal into image data showing light emission and no light emission in the discharge cells in each subfield;

a sustain pulse generating circuit for generating and applying the sustain pulses alternately to the scan electrodes and the sustain electrodes of the display electrode pairs in the sustain period, the sustain pulse generating circuit including:

a power recovery circuit for causing resonance between an interelectrode capacitance of the display electrode pairs and an inductor, and thereby causing the sustain pulses to rise or fall; and a clamp circuit for clamping a voltage of the sustain pulses to a power supply voltage or a base voltage;

an all-cell light-emitting rate detecting circuit for detecting a rate of the number of discharge cells to be lit with respect to the number of all discharge cells in a display area of the plasma display panel, as an all-cell light-emitting rate, in each subfield; and a partial light-emitting rate detecting circuit for dividing the display area of the plasma display panel into a plurality of regions, and detecting a rate of the number of discharge cells to be lit with respect to the number of discharge cells in each of the regions, as a partial light-emitting rate, in each subfield, the sustain pulse generating circuit generates the plurality of sustain pulses where lengths of at least one of a rising period and a falling period are different, and generates the sustain pulses by selecting a driving pattern according to the all-cell light-emitting rate and the partial light-emitting rate, among a plurality of driving patterns where the sustain pulses are generated in different combinations, the image signal processing circuit includes:

the number of lit cells calculator for calculating the number of discharge cells to be lit in each display electrode pair, in each subfield;

a load value calculator for calculating a load value of each of the discharge cells, according to the calculation result in the number of lit cells calculator;

a correction gain calculator for calculating a correction gain of each of the discharge cells, according to the calculation result in the load value calculator, the driving pattern, and a position of the discharge cell; and a corrector for subtracting a multiplication result of output from the correction gain calculator and the input image signal, from the input image signal; and the load value calculator and the correction gain calculator calculate the correction gain by setting a lighting state of each of the discharge cells in each of the subfields such that lighting is 1 and non-lighting is 0;

multiplying the calculation result in the number of lit cells calculator, the luminance weight set for corresponding one of the subfields, and the lighting state in one of the discharge cells of which correction gain is to be calculated, and calculating a total sum of the multiplication results in the respective subfields as the load value;

multiplying the number of discharge cells formed on the display electrode pair, the luminance weight set for corresponding one of the subfields, and the lighting state in the discharge cell of which correction gain is to be calculated, and calculating a total sum of the multiplication results in the respective subfields as a maximum load value; and subtracting the load value from the maximum load value, and dividing the subtraction result by the maximum load value.

2. A driving method for a plasma display panel, the plasma display panel having a plurality of discharge cells, the discharge cells having display electrode pairs, each of the display electrode pairs being formed of a scan electrode and a sustain electrode, the plasma display panel being driven by a subfield method in which a plurality of subfields is set in one field, each of the subfields has an initializing period, an address period, and a sustain period, a luminance weight is set for each of the subfields, and sustain pulses for causing a discharge at the number of times corresponding to the luminance weight are generated by causing resonance between an interelectrode capacitance of the display electrode pairs and an inductor, and are applied alternately to the scan electrodes and the sustain electrodes of the display electrode pairs in the sustain period for gradation display, the driving method comprising:

detecting a rate of the number of discharge cells to be lit with respect to the number of all discharge cells in a display area of the plasma display panel, as an all-cell light-emitting rate, in each subfield, dividing the display area of the plasma display panel into a plurality of regions, and detecting a rate of the number of discharge cells to be lit with respect to the number of discharge cells in each of the regions, as a partial light-emitting rate, in each subfield;

generating the plurality of sustain pulses where lengths of at least one of a rising period and a falling period are different, setting a plurality of driving patterns where the sustain pulses are generated in different combinations, and generating the sustain pulses by selecting any one of the plurality of driving patterns, according to the all-cell light-emitting rate and the partial light-emitting rate;

calculating the number of discharge cells to be lit in each display electrode pair, in each subfield;

calculating a load value of each of the discharge cells, according to the number of discharge cells to be lit, and calculating a correction gain of each of the discharge cells, according to the load value, the driving pattern, and a position of the discharge cell;

multiplying the correction gain and an input image signal, and subtracting the multiplication result from the input image signal;

setting a lighting state of each of the discharge cells in each of the subfields such that lighting is 1 and non-lighting is 0;

multiplying the calculation result in the number of lit cells calculator, the luminance weight set for corresponding one of the subfields, and the lighting state in one of the discharge cells of which correction gain is to be calculated, and calculating a total sum of the multiplication results in the respective subfields as the load value;

multiplying the number of discharge cells formed on the display electrode pair, the luminance weight set for corresponding one of the subfields, and the lighting state in the discharge cell of which correction gain is to be calculated, and calculating a total sum of the multiplication results in the respective subfields as a maximum load value; and subtracting the load value from the maximum load value, and dividing the subtraction result by the maximum load value.

* * * * *